US006351076B1

(12) United States Patent
Yoshida et al.

(10) Patent No.: US 6,351,076 B1
(45) Date of Patent: Feb. 26, 2002

(54) LUMINESCENT DISPLAY PANEL DRIVE UNIT AND DRIVE METHOD THEREOF

(75) Inventors: Takayoshi Yoshida; Yoichi Satake, both of Yamagata (JP)

(73) Assignee: Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 09/679,516

(22) Filed: Oct. 6, 2000

(30) Foreign Application Priority Data

Oct. 6, 1999 (JP) ..... 11-285104
Oct. 6, 1999 (JP) ..... 11-285105
Oct. 6, 1999 (JP) ..... 11-285106
Oct. 12, 1999 (JP) ..... 11-289194

(51) Int. Cl.[7] ..... G09G 3/10

(52) U.S. Cl. ..... 315/169.1; 315/169.2; 315/169.3; 315/169.4; 345/214; 345/55; 345/77

(58) Field of Search ..... 315/169.1, 169.2, 315/169.3, 169.4; 345/214, 55, 77

(56) References Cited

U.S. PATENT DOCUMENTS 4,686,426 A * 8/1987 Fujioka et al. ..... 315/169.3
5,404,074 A * 4/1995 Watanabe et al. ..... 315/169.1
6,111,557 A * 8/2000 Koyama et al. ..... 345/89

* cited by examiner

*Primary Examiner*—Don Wong
*Assistant Examiner*—Jimmy T. Vu

(57) ABSTRACT

There is specified an illumination drive line assigned to a capacitive luminescent element which is connected to a single scanning line and is to be illuminated in accordance with an input video signal during a scanning period. A first potential lower than an illumination threshold voltage of the capacitive luminescent element is applied to a single scanning line, and a second potential higher than the illumination threshold voltage is applied to the scanning lines other than the single scanning line. A drive current is supplied to the illumination drive line for forwardly applying a positive voltage higher than the illumination threshold voltage to the capacitive luminescent element to be illuminated. A third potential slightly lower than the illumination threshold voltage is applied to the drive lines other than the illumination drive line. During a reset period defined between scanning periods, the second potential is applied to all the scanning lines, and a fourth potential equal to the second potential is supplied to the drive line other than the non-reset drive line.

22 Claims, 32 Drawing Sheets

LUMINESCENT DISPLAY PANEL DRIVE UNIT AND DRIVE METHOD THEREOF

BACKGROUND OF THE INVENTION

The present invention relates to a unit for driving a luminescent display panel using a capacitive luminescent element, such as an organic electro-luminescent element.

As a display which attains low power dissipation, high-quality display, and lower profile, an electro-luminescent display, in which a plurality of organic electro-luminescent elements are arranged in a matrix pattern, has attracted attention. As shown in FIG. 1, the organic electro-luminescent element is formed by means of stacking, on a transparent substrate 100 such as a glass plate on which a transparent electrode 101 is formed, at least one organic function layer 102 which is made up of an ion transport layer, a light-emitting layer; and a positive hole transport layer, and a metal electrode 103. A positive voltage is applied to the anode of the transparent electrode 101, and a negative voltage is applied to the cathode of the metal electrode 103. A d.c. current is applied across the transparent electrode 101 and the metal electrode 103, wherewith the organic function layer 102 illuminates. Use of an organic compound which can be expected to exhibit a superior luminous characteristic embodies a practicable electro-luminescent display.

The organic electro-luminescent element (hereinafter referred to simply as an "EL element") can be electrically expressed as an equivalent circuit shown in FIG. 2. As can be seen from the drawing, the EL element can be replaced with a capacitive component C and a diode component E which is connected in shunt with the capacitive component and has a diode characteristic. For this reason, the organic electro-luminescent element is considered to be a capacitive luminescent element. When a light-emitting d.c. drive voltage is applied across electrodes of the organic electro-luminescent element, electric charge is stored in the capacitive component C. When the light-emitting d.c. drive voltage exceeds a barrier voltage or threshold illumination voltage unique to the EL element, an electric current starts flowing from the electrode (i.e., the anode of the diode component E) to the organic function layer, which also acts as a light-emitting layer, whereupon the organic electro-luminescent element illuminates at an intensity proportional to the electric current.

As shown in FIG. 3, the characteristic of the EL element concerning a voltage V, a current I, and luminance L is analogous to that of a diode. The current I is considerably small at a voltage lower than the threshold illumination voltage $V_{th}$ and abruptly increases at a voltage higher than the threshold illumination voltage $V_{th}$. The electric current I is substantially proportional to the luminance L. When a drive voltage exceeding the threshold illumination voltage $V_{th}$ is applied to the EL element, the EL element illuminates at an intensity proportion to the electric current corresponding to the drive voltage. If the drive voltage to be applied to the EL element is below the threshold illumination voltage $V_{th}$ no drive current flows through the EL element, and hence the luminous intensity of the EL element remains substantially zero.

A passive matrix drive method has hitherto been known as a method of driving a luminescent display panel using a plurality of EL elements. FIG. 4 shows an example structure of a driver device of passive matrix drive type for driving a luminescent display panel. In a luminescent display panel, "n" cathode lines (i.e., metal electrodes) $B_1$ to $B_n$ are arranged in parallel with each other so as to extend in the lateral direction, and "m" anode lines (i.e., transparent electrodes) $A_1$ to $A_m$ are arranged in parallel with each other so as to extend in the longitudinal direction. In respective intersections (a total number of "n×m") between the cathode lines and the anode lines, light-emission layers of EL elements $E_1$ to $E_m$ are sandwiched. The EL elements $E_1$ to $E_m$, which serve as pixels, are arranged in a matrix pattern and are positioned in respective intersections between the anode lines A to $A_h$ and the cathode lines $B_1$ to $B_n$. One end of the EL element (i.e., the anode of the diode component E of the equivalent circuit) is connected to the anode line, and the other end of the EL element (i.e., the cathode of the diode component E of the equivalent circuit) is connected to the cathode line. The cathode line is connected to and activated by a cathode line scanning circuit 1, and the anode line is connected to and activated by an anode line drive circuit 2.

The cathode line scanning circuit 1 has scan switches $\mathbf{5}_1$ to $\mathbf{5}_n$ assigned to respective cathode lines $B_1$ to $B_n$ for determining respective electric potentials thereof. Each of the scanning switches 51 to **5*n*** connects to a corresponding cathode line either a reverse bias voltage (e.g., 10 volts) produced from a supply voltage, or a ground potential (e.g., 0 volt).

The anode drive circuit 2 has current sources $\mathbf{2}_1$ to $\mathbf{2}_m$(e.g., constant-current sources) for supplying a drive current to respective EL elements, and drive switches $\mathbf{6}_1$ to $\mathbf{6}_m$, which are assigned to the anode lines $A_1$ to $A_m$. The drive switches $\mathbf{6}_1$ to $\mathbf{6}_m$ supply a current to the respective anode lines $A_1$ to $A_n$ by means of switching operations. A voltage source, such as a constant-voltage source, can be used as a drive source. The previously-described current-luminance characteristic is stable against temperature variations, whereas a voltage-luminance characteristic is unstable against temperature variations. For this reason, a current source (a source circuit which is to be controlled such that the amount of supply current assumes a desired value) is commonly used. The amount of current supplied from current sources $\mathbf{2}_1$ to $\mathbf{2}_m$ is the amount of current required for sustaining a state in which an EL element illuminates at desired instantaneous luminance (this state will hereinafter be referred to as a "steady luminous state"). When the EL element is in a steady luminous state, electric charge corresponding to the amount of supply current is charged into the capacitive component C of the EL element. The voltage across the EL element assumes a specified value Ve corresponding to instantaneous luminance (hereinafter referred to as a "specified illumination voltage").

The anode lines $A_1$ to $A_m$ are connected to an anode line reset circuit 3. The anode line reset circuit 3 has shunt switches $\mathbf{7}_1$ to $\mathbf{7}_m$ assigned to respective anode lines $A_1$ to $A_m$. The anode lines $A_1$ to $A_m$ are brought into ground potential by means of selection of the shunt switches $\mathbf{7}_1$ to $\mathbf{7}_m$. The cathode line scanning circuit 1, the anode line drive circuit 2, and the anode line reset circuit 3 are connected to an illumination control circuit 4.

The illumination control circuit 4 controls the cathode line scanning circuit 1, the anode line drive circuit 2, and the anode line reset circuit 3, to thereby display a video in accordance with a video signal supplied from an unillustrated video signal generation system. The illumination control circuit 4 sends a scanning line selection control signal to the cathode line scanning circuit 1, to thereby perform operations for selecting a cathode line corresponding to a horizontal scanning period of a video signal and setting the thus-selected cathode line to ground potential. The scanning switches $\mathbf{5}_1$ to $\mathbf{5}_n$ are switched so as to apply a reverse bias voltage Vcc to the remaining cathode lines. The reverse bias voltage Vcc is applied from the constant-voltage line connected to the cathode line, in order to prevent illumination of EL elements connected to intersections between the anode line through which a drive current is flowing and cathode lines which are not selected for scanning, which would otherwise be caused by crosstalk. Here, the reverse bias voltage Vcc is usually set equal to the specified illumination voltage Ve. During each horizontal scanning period, the scanning switches $\mathbf{5}_1$ to $\mathbf{5}_n$ are sequentially switched to ground potential. The cathode line set to ground potential acts as a scanning line which enables illumination of an EL element connected to the cathode line.

The anode line drive circuit 2 controls illumination of the scanning line. The illumination control circuit 4 produces a drive control signal indicating a timing at which and a period of time during which the EL element connected to the scanning line is illuminated in accordance with the pixel information represented by a video signal. In accordance with the drive control signal, the anode line drive circuit 2 switches some of the drive switches $\mathbf{6}_1$ to $\mathbf{6}_m$, thereby supplying a drive current to EL elements in accordance with pixel information by way of the anode lines $A_1$ to $A_m$. The EL elements through which the drive current flows illuminate in accordance with the pixel information.

The anode line reset circuit 3 is reset in response to a reset control signal output from the illumination control circuit 4. The anode line reset circuit 4 turns on some of the shunt switches $\mathbf{7}_1$ to $\mathbf{7}_m$ corresponding to the anode lines, which lines are represented by the reset control signal and are to be reset, and turns off the remaining shunt switches.

Japanese Patent Application Laid-Open No. 232074/1997 filed by the present inventor describes a drive method for a passive matrix luminescent display panel, in which a reset operation is performed for causing discharge of the electric charges stored in each of EL elements arranged into a matrix pattern immediately before scanning lines are switched (the method is hereinafter referred to as a "reset drive method"). The reset drive method is for speeding up illumination of an EL element when a scanning line is switched. The reset drive method for a passive matrix luminescent display panel will be described by reference to FIGS. 4 through 6.

Driving operations which will be described hereinbelow and are shown in FIGS. 4 through 6 are directed to a case where, after EL elements $E_{1,1}$ and $E_{2,1}$ have been illuminated by means of scanning a cathode line $B_1$, EL elements $E_{2,2}$ and $E_{3,2}$ are illuminated by means of scanning a cathode line $B_2$. In order facilitate explanations, illuminating EL elements are depicted by diode symbols, and nonilluminating EL elements are depicted by capacitor symbols. The reverse bias voltage Vcc applied to the cathode lines $B_1$ to $B_n$ is equal to the specified illumination voltage Ve of the EL element; that is, 10 volts.

In FIG. 4, only a scanning switch $\mathbf{5}_1$ is switched to a ground potential of 0 volt, thereby scanning the cathode line $B_1$. The reverse bias voltage Vcc is applied to the remaining cathode lines $B_2$ to $B_n$ by way of the scanning switches $\mathbf{5}_2$ to $\mathbf{5}_n$. The anode line $A_1$ is connected to a current source $\mathbf{2}_1$ by way of a drive switch $\mathbf{6}_1$, and the anode line $A_2$ is connected to a current source $\mathbf{2}_2$ by way of a drive switch $\mathbf{6}_2$. The remaining anode lines $A_3$ to $A_m$ are brought into a ground potential of 0 volt by means of shunt switches $\mathbf{7}_3$ to $\mathbf{7}_m$. In connection with the circuit diagram shown in FIG. 4, only the EL elements $E_{1,1}$ and $E_{2,1}$ are forwardly biased, and a drive current flows into the EL elements $E_{1,1}$, and $E_{2,1}$ from respective current sources $\mathbf{2}_1$ and $\mathbf{2}_2$, as depicted by arrows. As a result, solely the EL elements $E_{1,1}$ and $E_{2,1}$ are illuminated. In this state, nonilluminating and hatched EL elements $E_{3,2}$ to $E_{m,n}$ are charged with a polarity such as that illustrated in the drawing.

The following reset control operation is performed immediately before a scanning operation is performed for causing the next EL elements $E_{2,2}$ and $E_{3,2}$ to illuminate from the steady luminous state shown in FIG. 4. Specifically, as shown in FIG. 5, all drive switches $\mathbf{6}_1$ to $\mathbf{6}_m$ are released, and all the scanning switches $\mathbf{5}_1$ to $\mathbf{5}_n$ and all the shunt switches $\mathbf{7}_1$ to $\mathbf{7}_m$ are brought into a ground potential of 0 volt. Further, all the anode lines $A_1$ to $A_m$ and cathode lines $B_1$ to $B_n$ are temporarily shunted to a ground potential of 0 volt, thus resetting the entire display. If the entire display is reset, all the anode and cathode lines are brought to a single voltage of 0. The electric charges stored in the EL elements are discharged by way of the route depicted by the arrows provided in the drawing. Thus, all the electric charges stored in the EL elements become momentarily empty.

After the electric charges stored in all the EL elements have been fully discharged, only the scanning switch $\mathbf{5}_2$ corresponding to the cathode line $B_2$ is switched to 0 volt, as shown in FIG. 6, thereby scanning the cathode line $B_2$. Simultaneously, the drive switches $\mathbf{6}_2$ and $\mathbf{6}_3$ are closed, thereby connecting the current sources $\mathbf{2}_2$ and $\mathbf{2}_3$ to corresponding anode lines. The shunt switches $\mathbf{7}_1$ and $\mathbf{7}_4$ through $\mathbf{7}_m$ are turned on, thus bringing anode lines $A_1$ and $A_4$ through $A_m$ to 0 volt.

As mentioned above, according to the reset drive method, illumination is controlled by means of repetition of a scanning mode during which any of the cathode lines $B_1$ to $B_n$ are made active, and a subsequent reset mode. The display is brought into the scanning mode and the reset mode every horizontal scanning period (1H). If the display is brought directly into the state shown in FIG. 6 from the state shown in FIG. 4, the drive current supplied from the current source $\mathbf{2}_3$ flows to an EL element $E_{3,2}$ and is consumed by means of canceling the reverse electric charges (illustrated in FIG. 4) stored in the EL elements $E_{3,3}$ to $E_{3,n}$. For these reasons, time is consumed for bringing the EL element $E_{3.2}$ into a steady luminous state (bringing the voltage across the EL element $E_{3,2}$ to the specified luminous voltage Ve).

When the above-described reset control operation is performed, the anode lines $A_2$ and $A_3$ assume potentials close to Vcc at the moment at which the scanning line is switched to the cathode line $B_2$. A charge current flows into EL elements $E_{2,2}$ and $E_{3,2}$ not only from the current sources $\mathbf{2}_2$ and $\mathbf{2}_3$ but also from a plurality of routes such as constant-voltage sources connected to cathode lines $B_1$ and $B_3$ to $B_n$. Parasitic capacitance is charged with the charge current, and the specified luminous voltage Ve is momentarily reached. Thus, the EL elements $E_{2,2}$ and $E_{3,2}$ can instantaneously enter a steady luminous state. During a period of time in which the cathode line $B_2$ is scanned, the amount of current supplied from the current source is set to the minimum amount of current required for maintaining the EL element in a steady luminous state at the specified luminous voltage Ve. Therefore, the electric current supplied from the current sources $\mathbf{2}_2$ and $\mathbf{2}_3$ flows into solely the EL elements $E_{2,2}$ and $E_{3,2}$. Thus, all the electric current is dissipated by illumination of the EL elements. As a result, the display is sustained in a luminous state shown in FIG. 6.

As has been described above, according to the known reset drive method, before illumination of the next scanning lines is controlled, all the cathode and anode lines are temporarily connected and reset to a ground potential of 0 volts or a voltage equal to the reverse bias voltage Vcc. Consequently, when the current scanning line has been switched to the next scanning line, there can be speeded up the charging of the EL elements to the specified luminous voltage Ve, as well as the rise and illumination of EL elements, which are connected to the scanning line and are to be illuminated.

As shown in FIGS. 4 and 6, when some cathode lines are scanned by means of application of ground potential thereto, the voltage Vcc is applied to the cathode lines which are not scanned. Further, ground potential is applied to anode lines to which an electric current is not supplied from a current source. More specifically, in the case of the circuit diagram shown in FIG. 4, a reverse bias voltage substantially equal to the voltage Vcc is applied between the anode and cathode of each of the EL elements $E_{3,2}$ to $E_{m,n}$. In the case of the circuit diagram shown in FIG. 6, a reverse bias voltage substantially equal to the voltage Vcc is applied between the anode and cathode of each of the EL elements $E_{1,1}$, $E_{4,1}$ to $E_{m,1}$, $E_{1,3}$ to $E_{1,n}$, and $E_{4,3}$ to $E_{m,n}$. The EL elements to which the reversely-biased voltage Vcc is applied are charged. The thus-charged electric charges are discharged for supplying ground potential to the cathode lines as well as for supplying an electric current from a current source. The electric charges that are charged in and discharged from the EL elements do not contribute to illumination of EL elements at all and are wasted. Power dissipation due to the charging and discharging operations of the EL elements increases in proportion to the number of EL elements. Therefore, useless power dissipation increases as the display area of a display panel increases.

SUMMARY OF THE INVENTION

The present invention is aimed at providing a luminescent display panel drive unit capable of diminishing useless power dissipation that does not contribute to illumination.

To this end, the present invention provides a luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, the drive unit comprising:

control means for setting a scanning period during which a single scanning line is selected from the plurality of scanning lines in accordance with a scan timing of an input video signal, for specifying a light-emission drive line assigned to the capacitive luminescent element which is connected to the single scanning line and is to be illuminated in accordance with the input video signal during the scanning period, and for setting a reset period during an interval between scanning periods;

scanning means for applying a first potential lower than an illumination threshold voltage of the capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to the capacitive luminescent element to be illuminated, for applying a third potential slightly lower than the illumination threshold voltage to the drive lines other than the illumination drive line, and for supplying during the reset period a fourth potential equal to the second potential to all the drive lines.

Further, according to the present invention, a first potential lower than an illumination threshold voltage is applied to a single scanning line selected for scanning, during a scanning period. A second potential higher than the illumination threshold voltage is applied to the scanning lines other than the single scanning line. A fourth potential slightly lower than the illumination threshold voltage is applied to the plurality of drive lines other than an illumination drive line connected to capacitive luminescent elements to be illuminated. Consequently, a comparatively-low reverse bias voltage is applied to respective capacitive luminescent elements located in intersections between scanning lines except the single scanning line and drive lines except the illumination drive line. Electric charges which are stored in the luminescent elements with the reverse bias voltage and which do not contribute to illumination are diminished as compared with those charged in luminescent elements in a known display panel, thus reducing useless power dissipation.

Accordingly, the present invention provides a luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, the drive unit comprising:

control means for setting a scanning period during which a single scanning line is selected from the plurality of scanning lines in accordance with a scan timing of an input video signal, for specifying a light-emission drive line assigned to the capacitive luminescent element which is connected to the single scanning line and is to be illuminated in accordance with the input video signal during the scanning period, for setting a reset period during an interval between scanning periods, and for specifying, as a non-reset drive line, at least the drive line having connected thereto the capacitive luminescent element to remain unilluminated during the scanning periods before and after the reset period;

scanning means for applying a first potential lower than an illumination threshold voltage of the capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to the capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

According to the present invention, a first potential lower than an illumination threshold voltage is applied to a single scanning line selected for scanning, during a scanning period. A second potential higher than the illumination threshold voltage is applied to the scanning lines other than the single scanning line. A fourth potential slightly lower than the illumination threshold voltage is applied to the plurality of drive lines other than an illumination drive line connected to capacitive luminescent elements to be illuminated. Consequently, a comparatively-low reverse bias voltage is applied to respective capacitive luminescent elements located in intersections between scanning lines except the single scanning line and drive lines except the illumination drive line. Electric charges which are stored in the luminescent elements with the reverse bias voltage and which do not contribute to illumination are diminished as compared with those charged in luminescent elements in a known display panel, thus reducing useless power dissipation.

Further, during the reset period, there is specified as a non-reset drive line at least the drive line connected to the capacitive luminescent element which is to remain unilluminated during the scanning periods before and after the reset period, and the second potential is applied to all the scanning lines. Moreover, a fourth potential equal to the second potential is applied to the plurality of drive lines exclusive of the non-reset drive line, and a third potential is applied to the non-reset drive line. The electric charges—which are stored in the capacitive luminescent elements connected to a non-reset drive line by means of the reverse bias voltage—are held without being discharged. Even when the reverse bias voltage is applied to the capacitive luminescent elements during the next scanning period, charging or discharging barely arises in the luminescent elements, thereby reducing useless power dissipation.

Further, accordingly, the present invention provides a luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and rive lines and which have polarities, the drive unit comprising:

control means for setting a scanning period during which a single scanning line is selected from the plurality of scanning lines in accordance with a scan timing of an input video signal, for specifying a light-emission drive line assigned to the capacitive luminescent element which is connected to the single scanning line and is to be illuminated in accordance with the input video signal during the scanning period, for setting a reset period during an interval between scanning periods, and for specifying, as anon-reset drive line, only the drive line having connected thereto the capacitive luminescent element to remain unilluminated during the scanning periods before and after the reset period;

scanning means for applying a first potential lower than an illumination threshold voltage of the capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to the capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

According to the present invention, a first potential lower than an illumination threshold voltage is applied to a single scanning line selected for scanning, during a scanning period. A second potential higher than the illumination threshold voltage is applied to the scanning lines other than the single scanning line. A fourth potential slightly lower than the illumination threshold voltage is applied to the plurality of drive lines other than an illumination drive line connected to capacitive luminescent elements to be illuminated. Consequently, a comparatively-low reverse bias voltage is applied to respective capacitive luminescent elements located in intersections between scanning lines except the single scanning line and drive lines except the illumination drive line. Electric charges which are stored in the luminescent elements with the reverse bias voltage and which do not contribute to illumination are diminished as compared with those charged in luminescent elements in a known display panel, thus reducing useless power dissipation.

Further, during the reset period, there is specified as a non-reset drive line only the drive line connected to the capacitive luminescent element which is to remain unilluminated during the scanning periods before and after the reset period, and the second potential is applied to all the scanning lines. Moreover, a fourth potential equal to the second potential is applied to the plurality of drive lines exclusive of the non-reset drive line, and a third potential is applied to the non-reset drive line. The electric charges—which are stored in the capacitive luminescent elements connected to a non-reset drive line by means of the reverse bias voltage—are held without being discharged. Even when the reverse bias voltage is applied to the capacitive luminescent elements during the next scanning period, charging or discharging barely arises in the luminescent elements, thereby reducing useless power dissipation.

The present invention also provides a luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, the drive unit comprising:

control means for setting a scanning period during which a single scanning line is selected from the plurality of scanning lines in accordance with a scan timing of an input video signal, for specifying a light-emission drive line assigned to the capacitive luminescent element which is connected to the single scanning line and is to be illuminated in accordance with the input video signal during the scanning period, for setting a reset period during an interval between scanning periods, and for specifying, as a non-reset drive line, only the drive line having connected to the capacitive luminescent element to remain unilluminated during the scanning period subsequent to the reset period;

scanning means for applying a first potential lower than an illumination threshold voltage of the capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to the capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

According to the present invention, a first potential lower than an illumination threshold voltage is applied to a single scanning line selected for scanning, during a scanning period. A second potential higher than the illumination threshold voltage is applied to the scanning lines other than the single scanning line. A fourth potential slightly lower than the illumination threshold voltage is applied to the plurality of drive lines other than an illumination drive line connected to capacitive luminescent elements to be illuminated. Consequently, a comparatively-low reverse bias voltage is applied to respective capacitive luminescent elements located in intersections between scanning lines except the single scanning line and drive lines except the illumination drive line. Electric charges which are stored in the luminescent elements with the reverse bias voltage and which do not contribute to illumination are diminished as compared with those charged in luminescent elements in a known display panel, thus reducing useless power dissipation.

Further, during the reset period, there is specified as a non-reset drive line only the drive line connected to the capacitive luminescent element which is to remain unilluminated during a scanning period subsequent to the reset period, and the second potential is applied to all the scanning lines. Moreover, a fourth potential equal to the second potential is applied to the plurality of drive lines exclusive of the non-reset drive line, and a third potential is applied to the non-reset drive line. The electric charges—which are stored in the capacitive luminescent elements connected to non-reset drive line by means of the reverse bias voltage—are held without being discharged. Even when the reverse bias voltage is applied to the capacitive luminescent elements during the next scanning period, charging or discharging barely arises in the luminescent elements, thereby reducing useless power dissipation.

Further, the present invention provides a luminescent display panel drive unit including a plurality of drive lines and a plurality of scanning lines, which intersect each other; and a plurality of capacitive luminescent elements which are provided in respective intersections between the drive lines and the scanning lines and are connected to the scanning lines and drive lines and which have polarities, the drive unit comprising:

determination means for distinguishing, as real scanning lines from the plurality of scanning lines, scanning lines which are connected to capacitive luminescent elements to be illuminated during each scanning period;

control means which sequentially specifies one scanning line from the real scanning lines and specifies light-emission drive lines assigned to the capacitive luminescent elements to be illuminated every time one scanning line is specified, the luminescent elements being connected to the specified scanning line; and drive means for forwardly supplying a drive current to the capacitive luminescent elements to be illuminated, by way of the scanning line and the light-emission drive line every time one scanning line is specified.

Further, the present invention also provides a method of driving a luminescent display panel including a plurality of drive lines and a plurality of scanning lines, which intersect each other; and a plurality of capacitive luminescent elements which are provided in respective intersections between the drive lines and the scanning lines and are connected to the scanning lines and drive lines and which have polarities, the method comprising the steps of:

distinguishing, as real scanning lines from the plurality of scanning lines, scanning lines which are connected to capacitive luminescent elements to be illuminated during each scanning period;

sequentially specifying one scanning line from the real scanning lines and specifies light-emission drive lines assigned to the capacitive luminescent elements to be illuminated every time one scanning line is specified, the luminescent elements being connected to the specified scanning line; and forwardly supplying a drive current to the capacitive luminescent elements to be illuminated, by way of the scanning line and the light-emission drive line every time one scanning line is specified.

By means of the configuration embodied by the present invention, scanning lines to which capacitive luminescent elements to be illuminated are connected are scanned, and the remaining scanning lines are not scanned. Useless power dissipation can be diminished, by the amount corresponding to the power required for scanning the scanning lines to which capacitive luminescent elements to be illuminated are not connected.

DETAILED DESCRIPTION OF THE PREFERRED EMBODIMENTS

An embodiment of the present invention will be described hereinbelow in detail by reference to the accompanying drawings.

Figure 7:
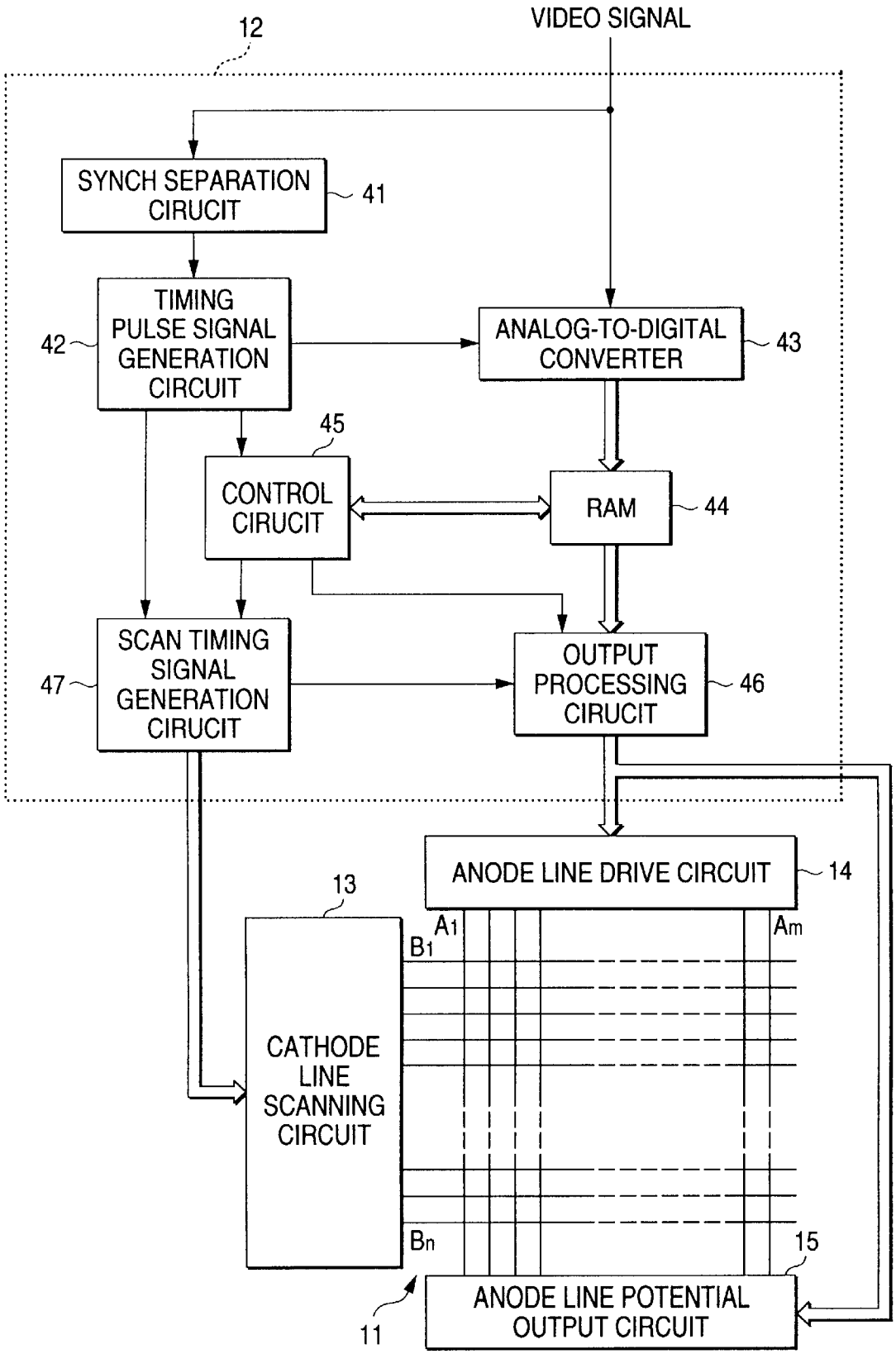
FIG. 7 is a block diagram showing the configuration of a luminescent display panel drive unit according to the present invention.

FIG. 7 schematically shows the configuration of a display which is embodied by application of the present invention to a luminescent display panel using EL elements as capacitive luminescent elements. The display comprises a capacitive luminescent display panel 11; a light-emission control section 12; a cathode line scanning circuit 13; an anode drive circuit 14; and an anode line potential output circuit 15.

Figure 4:
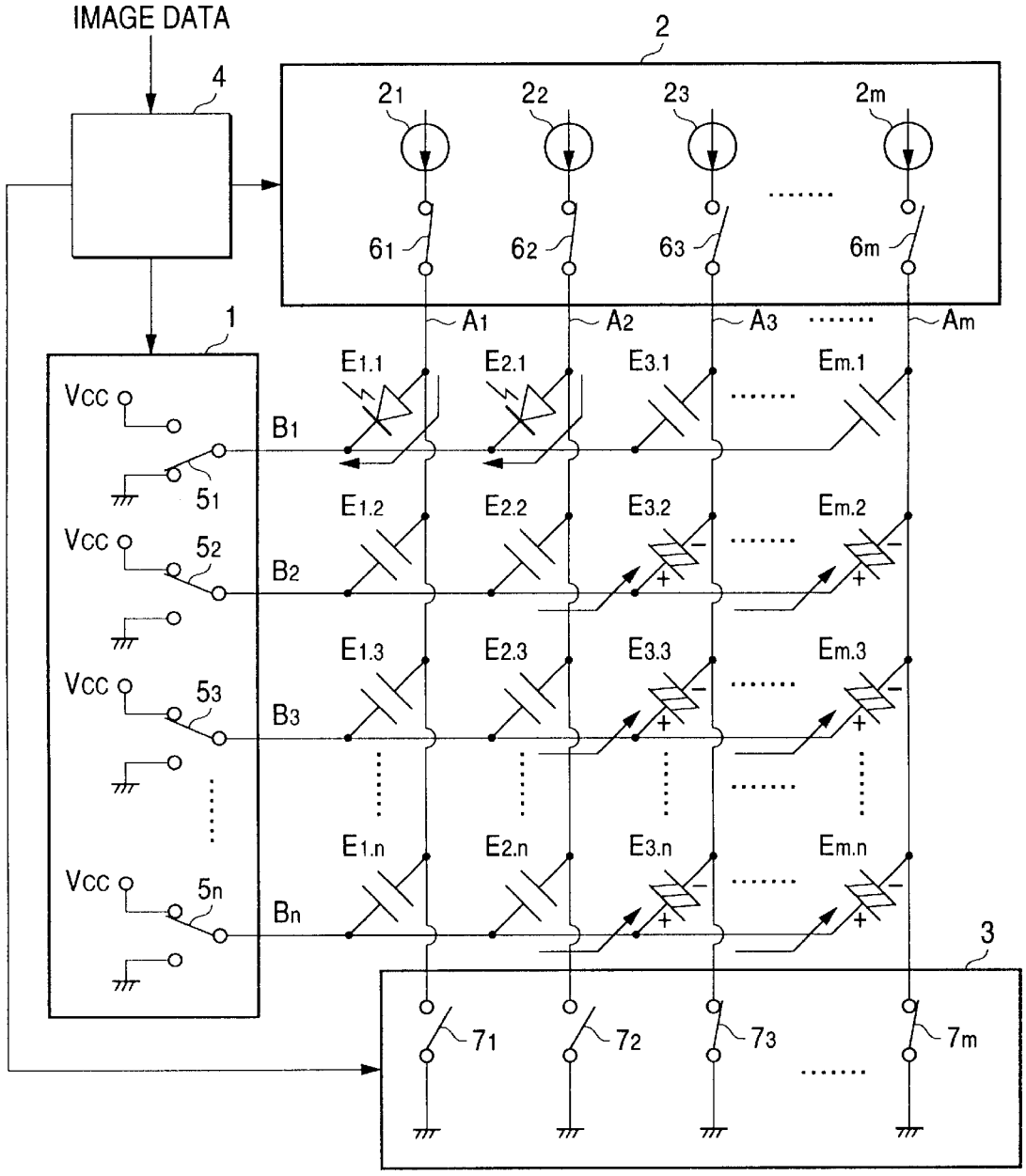
FIG. 4 is a block diagram for describing a reset drive method applied to a known luminescent display panel drive unit using EL elements.
Figure 5:
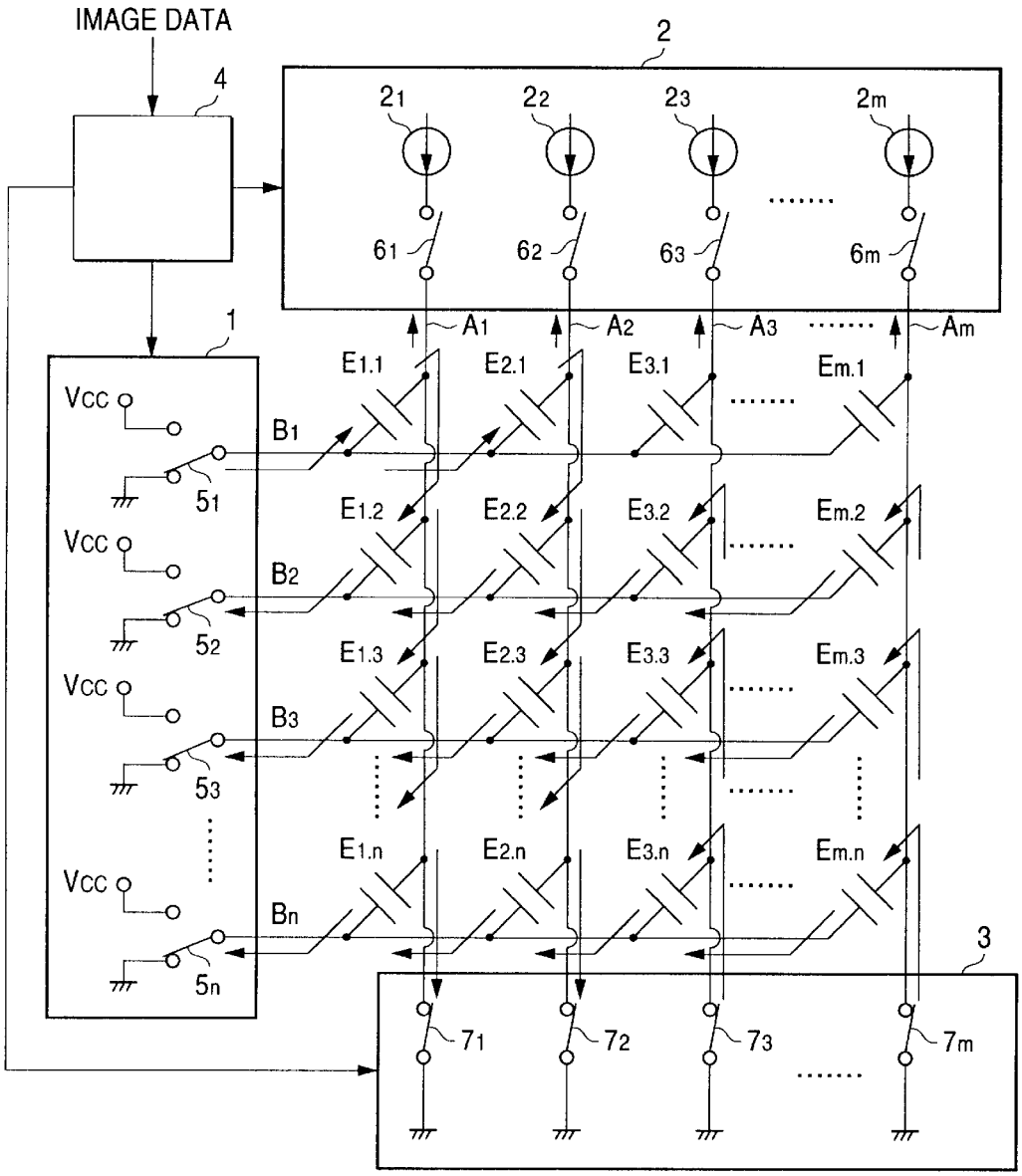
FIG. 5 is a block diagram for describing a reset drive method applied to a known luminescent display panel drive unit using EL elements.
Figure 6:
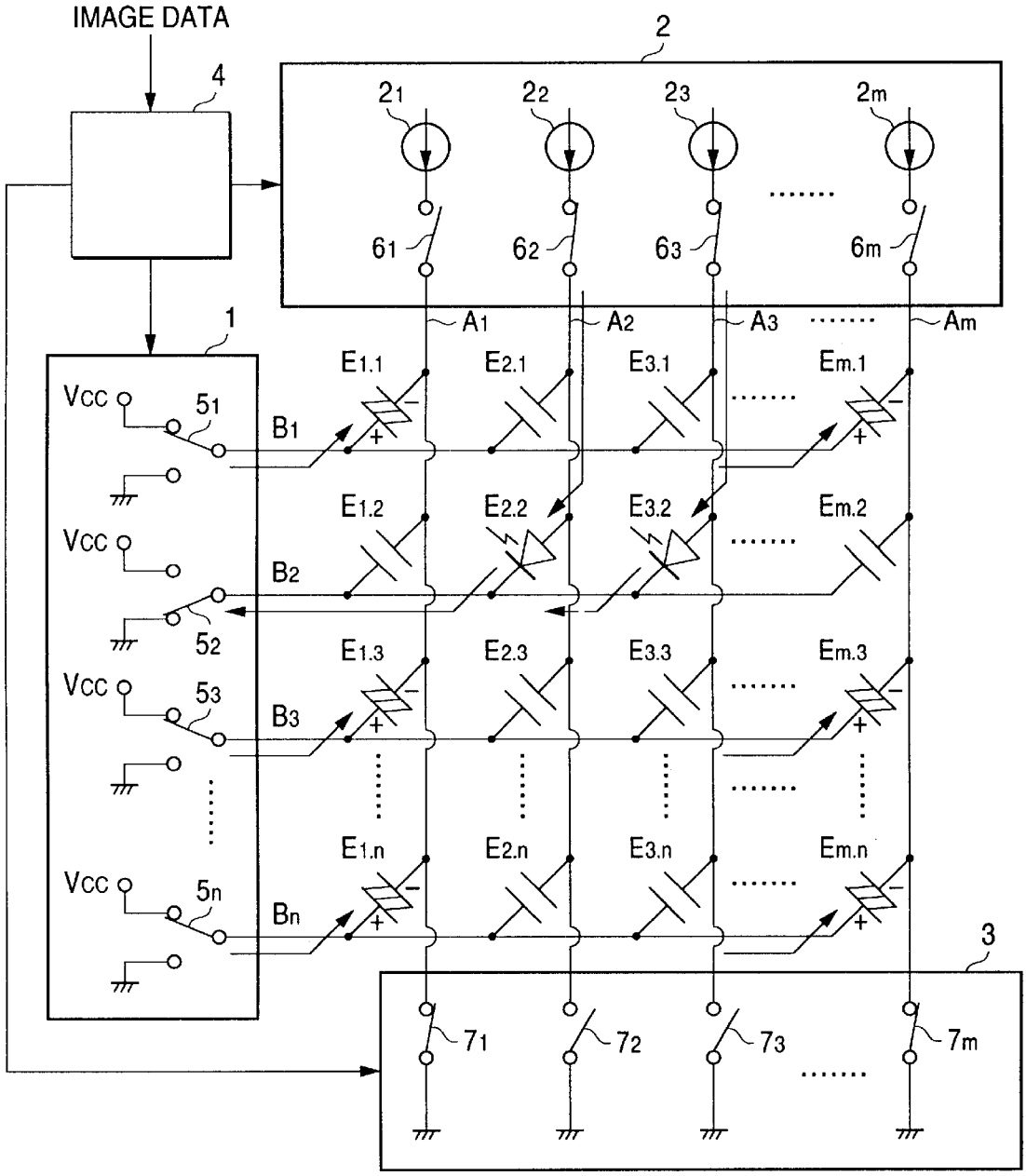
FIG. 6 is a block diagram for describing a reset drive method applied to a known luminescent display panel drive unit using EL elements.
Figure 8:
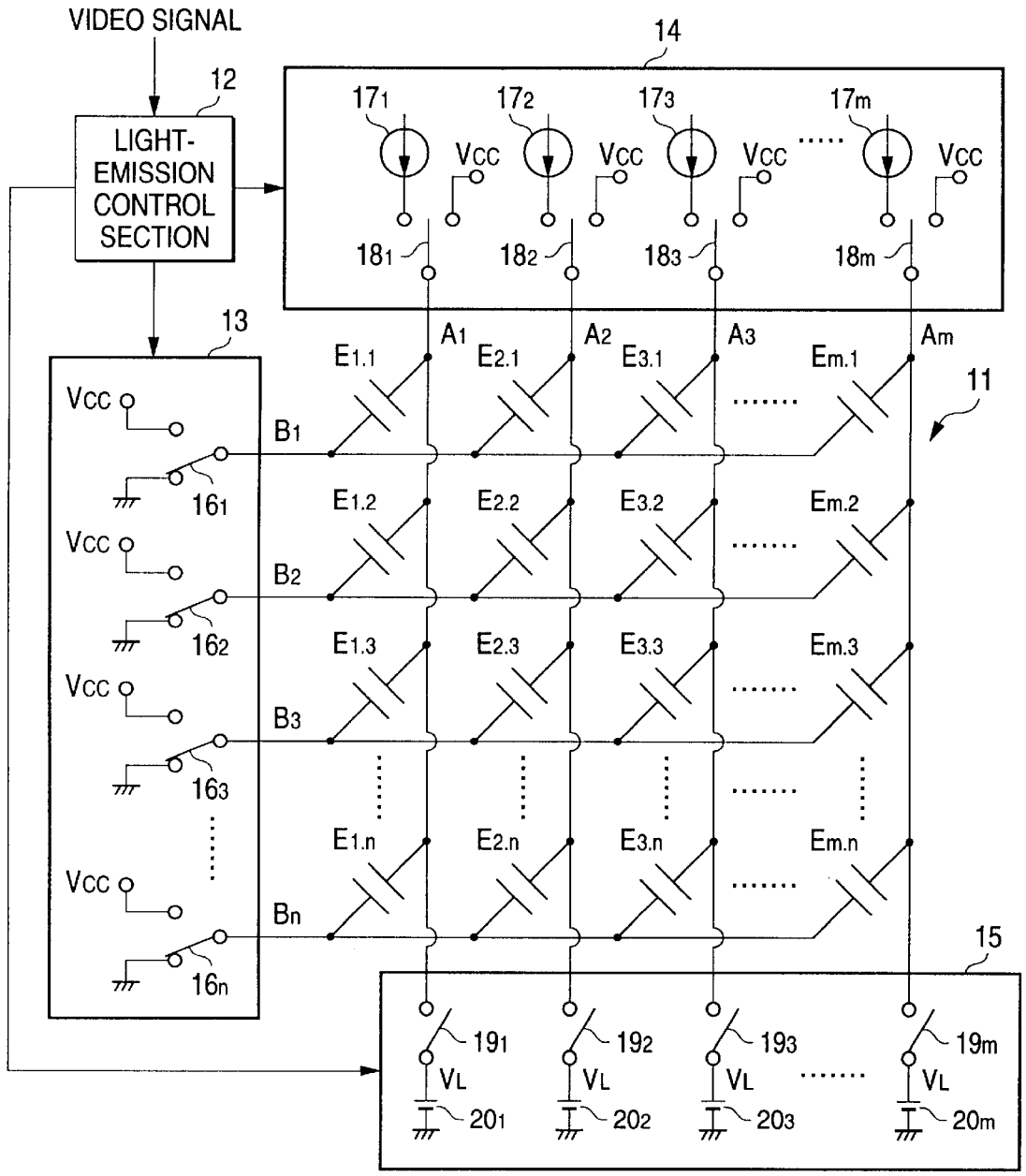
FIG. 8 is a block diagram specifically showing a luminescent display panel, a cathode line scanning circuit, and an anode line drive circuit of the drive unit shown in FIG. 7.

As shown in FIG. 8, the luminescent display panel 11 comprises a plurality of EL elements $E_{I,j}$ ($1 \leqq i \leqq m$, $1 \leqq j \leqq n$). As in the case of the EL elements shown in FIGS. 4 through 6, the plurality of EL elements are arranged in a matrix pattern at respective intersections between anode lines $A_1$ to $A_m$ serving as drive lines and cathode lines $B_1$ to $B_n$ serving as scanning lines. The EL elements are connected to the scanning lines and the drive lines. In other words, the EL elements are located at respective intersections between a plurality of drive lines extending substantially in parallel with each other and a plurality of scanning lines extending substantially at right angles to the drive lines. Each of the EL elements is connected to the scanning line and the drive line. The EL elements $E_{I,j}$ shown in FIG. 8 are depicted by capacitor symbols.

In the luminescent display panel 11, the cathode lines $B_1$ to $B_n$ are connected to the cathode line scanning circuit 13, and the anode lines $A_1$ to $A_m$ are connected to the anode line drive circuit 14. The cathode line scanning circuit 13 has scanning switches $\mathbf{16}_1$ to $\mathbf{16}_n$ assigned to the respective cathode lines $B_1$ to $B_n$. Each of the scanning switches $\mathbf{16}_1$ to $\mathbf{16}_n$ supplies to a corresponding cathode line ground potential or a reverse bias voltage Vcc. Under control of the light-emission control section 12, the scanning switches $\mathbf{16}_1$ to $\mathbf{16}_n$ are sequentially switched to ground potential every horizontal scanning period. Accordingly, the cathode lines $B_1$ to $B_n$ set to ground potential act as scanning lines which enable illumination of EL elements connected to the cathode lines $B_1$ to $B_n$.

The anode line drive circuit 14 has current sources $\mathbf{17}_1$ to $\mathbf{17}_m$ and drive switches $\mathbf{18}_1$ to $\mathbf{18}_m$. Each of the drive switches $\mathbf{18}_1$ to $\mathbf{18}_m$ corresponds to a changeover switch having two stationary contacts and a neutral position. An electric current is supplied from one of the current sources $\mathbf{17}_1$ to $\mathbf{17}_m$ to a corresponding anode line by way of one of the two stationary contacts. Further, a voltage Vcc is supplied by way of the remaining stationary contact. The voltage Vcc is supplied from an unillustrated voltage source.

The anode line potential output circuit 15 has potential application switches $\mathbf{19}_1$ to $\mathbf{19}_m$ and voltage sources $\mathbf{20}_1$ to $\mathbf{20}_m$, which are provided so as to correspond to the respective anode lines $A_1$ to $A_m$. A voltage $V_L$ develops between the positive and negative terminals of each of the voltage sources $\mathbf{20}_1$ to $\mathbf{20}_m$. The voltage $V_L$ is lower than and close to a threshold illumination voltage $V_{th}$. Switching operations of each of the potential application switches $\mathbf{19}_1$ to $\mathbf{19}_m$ are controlled by the light-emission control section 12. When the potential application switches $\mathbf{19}_1$ to $\mathbf{19}_m$ are in an ON state, the positive terminals of the respective voltage sources $\mathbf{20}_1$ to $\mathbf{20}_m$ are connected to the anode lines $A_1$ to $A_m$. The negative terminals of the voltage sources $\mathbf{20}_1$ to $\mathbf{20}_m$ are grounded.

The light-emission control section 12 controls the cathode line scanning circuit 13, the anode line drive circuit 14, and the anode line potential output circuit 15 so as to cause the luminescent display panel to display an image in accordance with a video signal supplied from an unillustrated video signal generation system. Such a control operation is performed while being divided into a reset period and a scanning period.

The light-emission control section 12 sends a scanning line selection control signal to the cathode line scanning circuit 13 during the scanning period. The scanning switches $\mathbf{16}_1$ to $\mathbf{16}_n$ are switched such that one from the cathode lines $B_1$ to $B_n$ corresponding to the horizontal scanning period of a video signal is selected and set to ground potential and such that a reverse bias voltage Vcc is applied to the remaining cathode lines. In order to prevent illumination of EL elements connected to the intersections between the anode lines to which the drive current is applied and the cathode lines which are not selected for scanning, which would otherwise be caused by crosstalk, a constant-voltage source (not shown) connected to the cathode lines supplies the reverse bias voltage Vcc. Since the scanning switches $\mathbf{16}_1$ to $\mathbf{16}_n$ are sequentially switched to ground potential during every horizontal scanning period, the cathode lines $B_1$ to $B_n$ set to ground potential act as scanning lines which enable illumination of the EL elements connected to the cathode lines $B_1$ to $B_n$.

The light-emission control section 12 produces a drive control signal indicating that one among the EL elements connected to a scanning line is to be illuminated, at any timing and for any period of time, in accordance with pixel information represented by a video signal during a scanning period. The thus-produced drive control signal is delivered to the anode line drive circuit 14. In response to the drive control signal, the anode line drive circuit 14 switches, to the current source side, the one among the drive switches $\mathbf{18}_1$ to $\mathbf{18}_m$ assigned to the anode line connected to the EL elements to be illuminated. By way of the corresponding one of the anode lines $A_1$ to $A_m$, a drive current corresponding to the pixel information is supplied to the EL elements. The remaining drive switches 18 are switched to neutral positions. The anode line potential output circuit 15 turns off some of the potential application switches $\mathbf{20}_1$ to $\mathbf{20}_m$ corresponding to anode lines connected to EL elements to be illuminated, in accordance with the drive control signal. The remaining potential application switches are turned on, and the voltage $V_L$ is supplied to corresponding anode lines.

The light-emission control section 12 produces a reset signal during a reset period, and the thus-produced reset signal is delivered to the cathode line scanning circuit 13, the anode line drive circuit 14, and the anode line potential output circuit 15. The cathode line scanning circuit 13 performs a control operation for switching the scanning switches $\mathbf{16}_1$ to $\mathbf{16}_n$ such that a reverse bias voltage Vcc is applied to all the cathode lines $B_1$ to $B_n$ in accordance with the reset signal. The anode line drive circuit 14 performs a control operation for switching the drive switches $\mathbf{18}_1$ to $\mathbf{18}_n$ such that a voltage Vcc is applied to the anode lines $A_1$ to $A_n$ in accordance with the reset signal. The anode line potential output circuit 15 turns off the potential application switches $\mathbf{20}_1$ to $\mathbf{20}_m$ in accordance with the reset signal.

The internal circuit of the light-emission control circuit 12 is configured as shown in FIG. 7. As shown in FIG. 7, a synch separation circuit 41 extracts horizontal and vertical synch signals from a supplied input video signal. The thus-extracted horizontal and vertical synch signals are supplied to a timing pulse signal generation circuit 42. On the basis of the thus-extracted horizontal and vertical synch signals, the timing pulse signal generation circuit 42 produces a synch signal timing pulse signal. The thus-produced synch signal timing pulse signal is supplied to an analog-to-digital converter 43, a control circuit 45, and a scan timing signal generation circuit 47. The analog-to-digital converter 43 converts an input video signal into digital pixel data on a per-pixel basis, in synchronism with the synch signal timing pulse signal. The input video signal is supplied to the memory 44. The control circuit 45 supplies a write signal and a read signal, which are synchronized with the synch signal timing pulse signal, to the memory 44 according to a drive method to be described later. In response to the write signal, the memory 44 sequentially captures the pixel data supplied from the analog-to-digital converter 43. Further, in response to the read signal, the memory 44 sequentially reads pixel data stored therein and supplies the thus-read pixel data to an output processing circuit 46 provided in a subsequent stage. The scan timing signal generation circuit 47 produces various timing signals for controlling a scanning switch and a drive switch and delivers the thus-produced signals to the cathode line scanning circuit 13 and the output processing circuit 46. As a result, the scan timing signal generation circuit 47 supplies a scan selection control signal to the cathode line scanning circuit 13. In synchronism with a timing signal output from the scan timing signal generation circuit 47, the output processing circuit 46 supplies, to the anode line drive circuit 14 and the anode line potential output circuit 15, a drive control signal corresponding to the pixel data supplied from the memory 44. During a reset period, the control circuit 45 supplies a reset signal to the anode line drive circuit 14 and the anode lines potential output circuit 15 by way of the output processing circuit 46, as well as to the cathode line scanning circuit 13 by way of the scan timing signal generation circuit 47.

Figure 9:
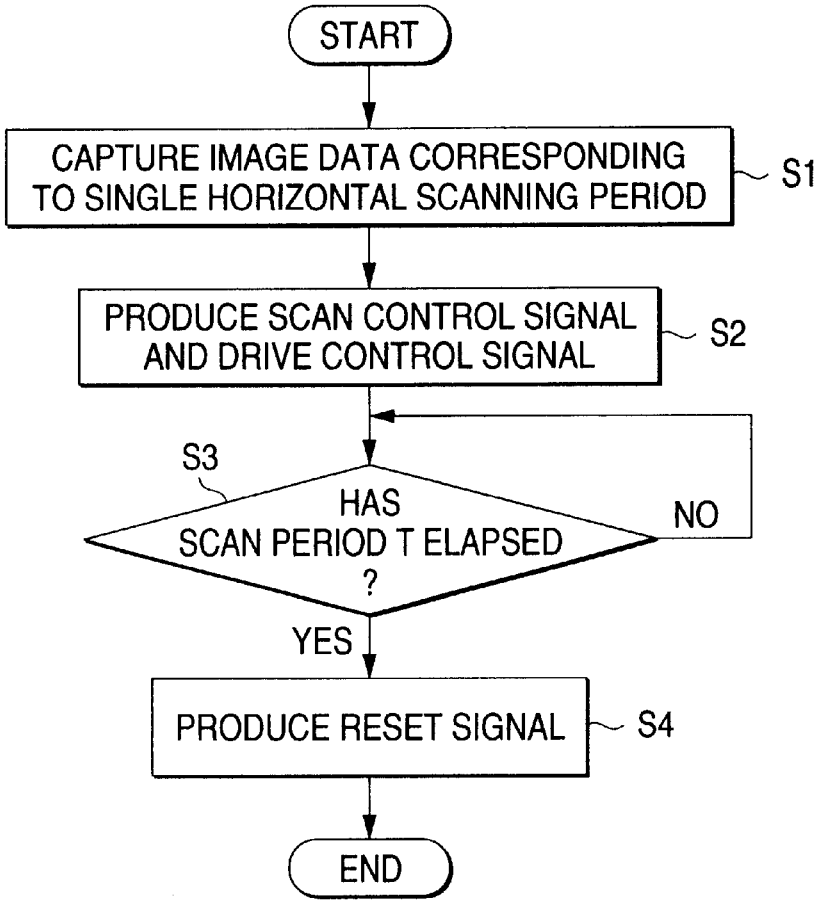
FIG. 9 is a flowchart for describing an illumination drive operation performed by a light-emission control circuit.

The drive operation of the capacitive luminescent display panel performed by the control circuit 45 of the light-emission control section 12 will now be described by reference to a flowchart shown in FIG. 9.

The control circuit 45 executes a light-emission control routine for every horizontal scanning period of the supplied pixel data. In the light-emission control routine, pixel data corresponding to a horizontal scanning period are acquired from RAM 44 (step S1). In accordance with pixel information represented by the pixel data corresponding to a horizontal scanning period, the scan selection control signal and the drive control signal are supplied (step S2).

The scan selection control signal is delivered to the cathode line scanning circuit 13. The cathode line scanning circuit 13 switches, to ground, a scanning switch (a single scanning switch $\mathbf{16}_s$ in the range of $\mathbf{16}_1$ to $\mathbf{16}_n$, where "S" designates a numeral in the range of 1 to "n") assigned to one of the cathode lines $B_1$ to $B_n$, which cathode line corresponds to the current horizontal scanning period represented by the scan selection control signal.

The drive control signal is supplied to the anode line drive circuit 14 and the anode line potential output circuit 15. In the anode line drive circuit 14, a drive switch (any one of the drive switches $\mathbf{18}_1$ to $\mathbf{18}_m$) is switched to a second stationary contact connected to a current source (i.e., the corresponding one of the current sources $17_1$ to $17_m$). Here, the drive switch is assigned to one of the anode lines $A_1$ to $A_m$,_which anode line is connected to an EL element to be illuminated Luring the current horizontal scanning period represented by the drive control signal. Drive switches 18 assigned to the remaining anode lines A are switched to the first stationary contacts connected to voltage sources (corresponding ones of voltage sources $20_1$ to $20_m$). The anode line potential output circuit 15 turns off some of the potential application switches (some of the application switches $19_1$ to $19_m$) corresponding to anode lines connected to the EL elements to be illuminated, during the current horizontal scanning period represented by the drive control signal. The potential application switches corresponding to the remaining anode lines are turned on.

For example, in a case where the drive switch $18_1$ is switched to a current source $17_1$, a drive current flows from the current source $17_1$ to a drive switch $18_1$, the anode line $A_1$, an EL element $E_{1,s}$ a cathode line $B_s$, a scanning switch $16_s$, and ground. The EL element $E_{1,s}$ to which the drive current is supplied illuminates in accordance with the pixel data.

If the drive switch switched to the neutral position is assigned $18_3$, the potential application switch $19_3$ is turned on. The voltage Vcc is applied to an anode line $A_3$ from a voltage source $20_3$ by way of the potential application switch $19_3$. The voltage VCC-$V_L$ is applied to EL elements $E_{3,1}$ to $E_{3,n}$ exclusive of an EL element $E_{3,s}$.

After having performed processing pertaining to step S2, the control circuit 45 determines whether or not a preset scanning period T has elapsed (step S3). The scanning period T is set in accordance with, for example, brightness information included in the pixel data and a preset horizontal scanning period. The scanning period is determined through use of an unillustrated internal counter.

The control circuit 45 produces a reset signal if the scanning period T has elapsed (step S4). The reset signal is delivered to the cathode line scanning circuit 13, the anode line drive circuit 14, and the anode line potential output circuit 15. The cathode line scanning circuit 13 switches the movable contacts of all the scanning switches $16_1$ to $16_n$ in accordance with the reset signal. The anode line drive circuit 14 switches the movable contacts of all the drive switches $18_1$ to $18_n$ to the stationary contacts of Vcc in accordance with the reset signal. The anode line potential output circuit 15 turns off the potential application switches $20_1$ to $20_m$, in accordance with the reset signal. As a result, a voltage Vcc develops between the terminal of each of the EL elements i,j, and the electric charge stored in the EL elements is discharged.

The reset period may be constant or may change in accordance with the scanning period T.

Figure 10:
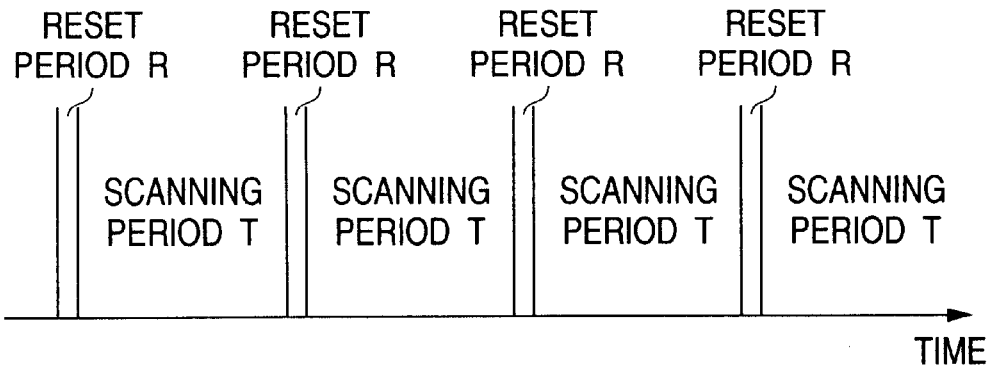
FIG. 10 is an illustration showing the relationship between scanning periods and reset periods.

After having performed processing pertaining to step S5, the control circuit 45 terminates the light-emission control routine and Enters a standby state until the next horizontal scanning period begins. Even during a period in which the control circuit 45 awaits the beginning of the next horizontal scanning period, processing pertaining to steps S1 to S4 is repeated. FIG. 10 shows the relationship between the scanning period and the scanning period of the light-emission drive operation.

Figure 12:
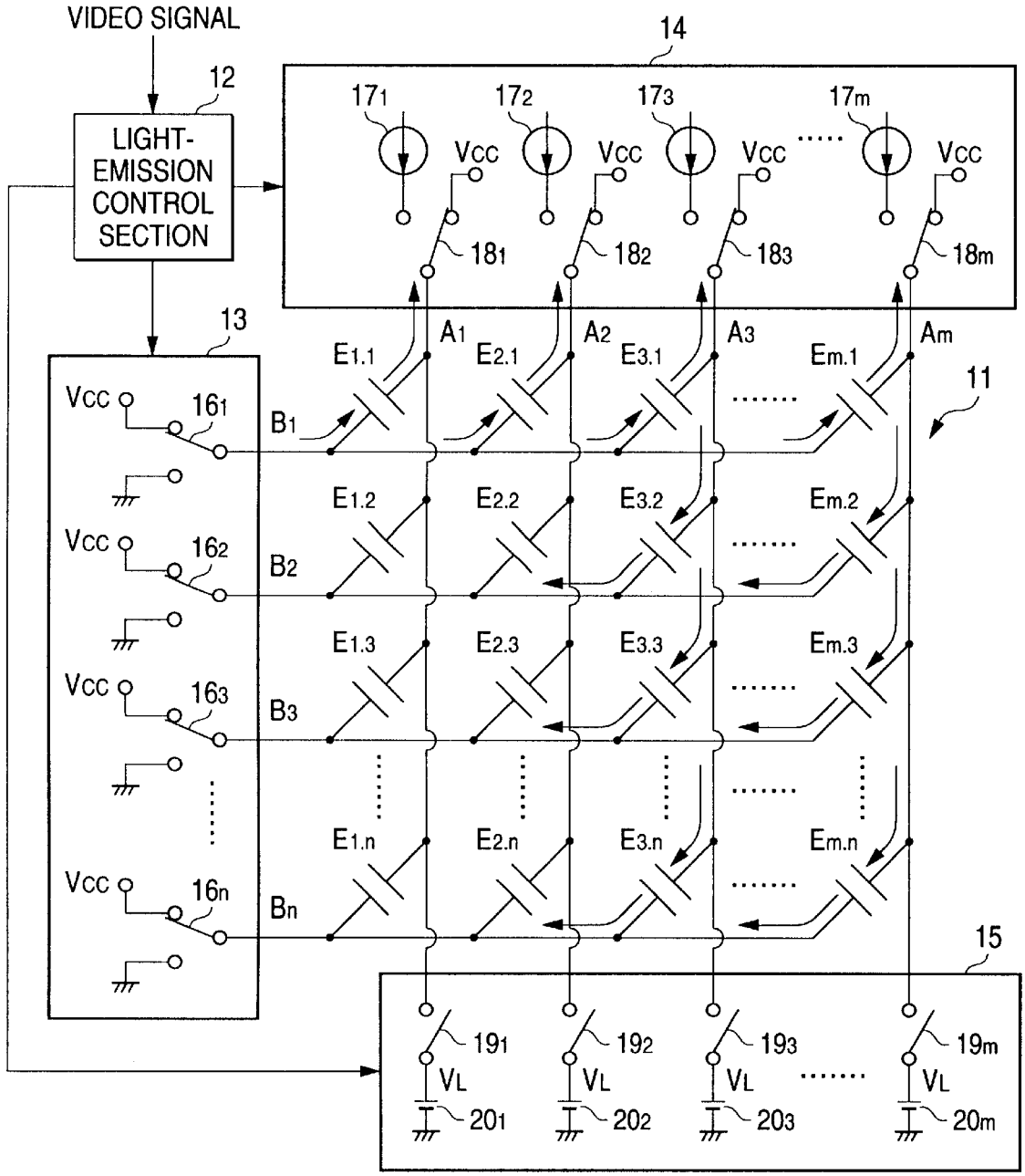
FIG. 12 is a block diagram for describing the illumination drive operation shown in FIG. 9.
Figure 13:
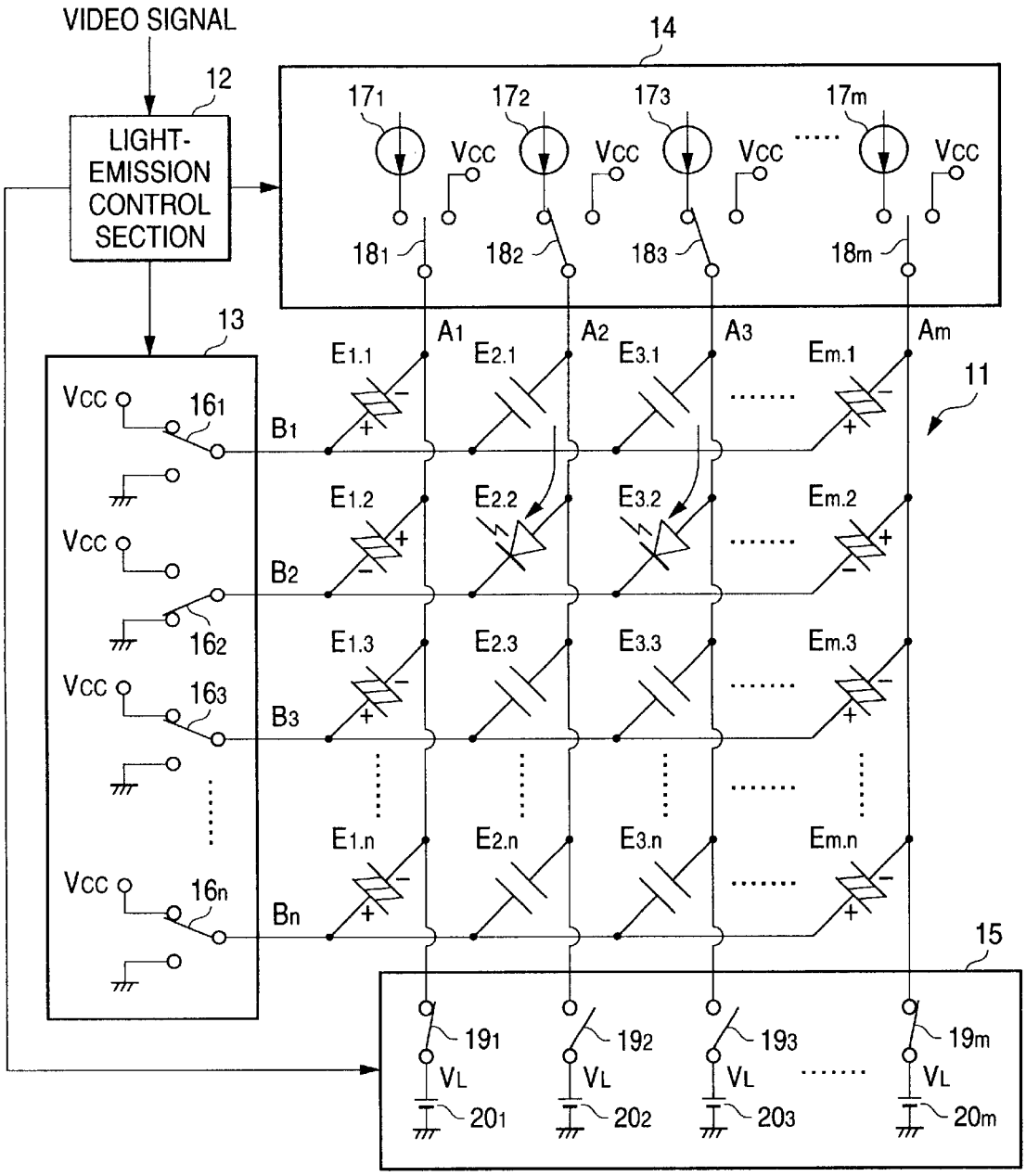
FIG. 13 is a block diagram for describing the illumination drive operation shown in FIG. 9.

By reference to FIGS. 11 through 13, next will be described a case where, after a cathode line $B_1$ has been scanned by means of the control operation of the control circuit 45, to thereby cause elements $E_{1.1}$ and $E_{2.1}$ to illuminate, a cathode line $B_2$ is scanned, to thereby cause elements $E_{2.2}$ and $E_{3,2}$ to illuminate. In order to facilitate explanations, illuminating EL elements shown in FIGS. 11 through 13 are depicted by diode symbols, and nonilluminating EL elements are depicted by capacitor symbols.

Figure 11:
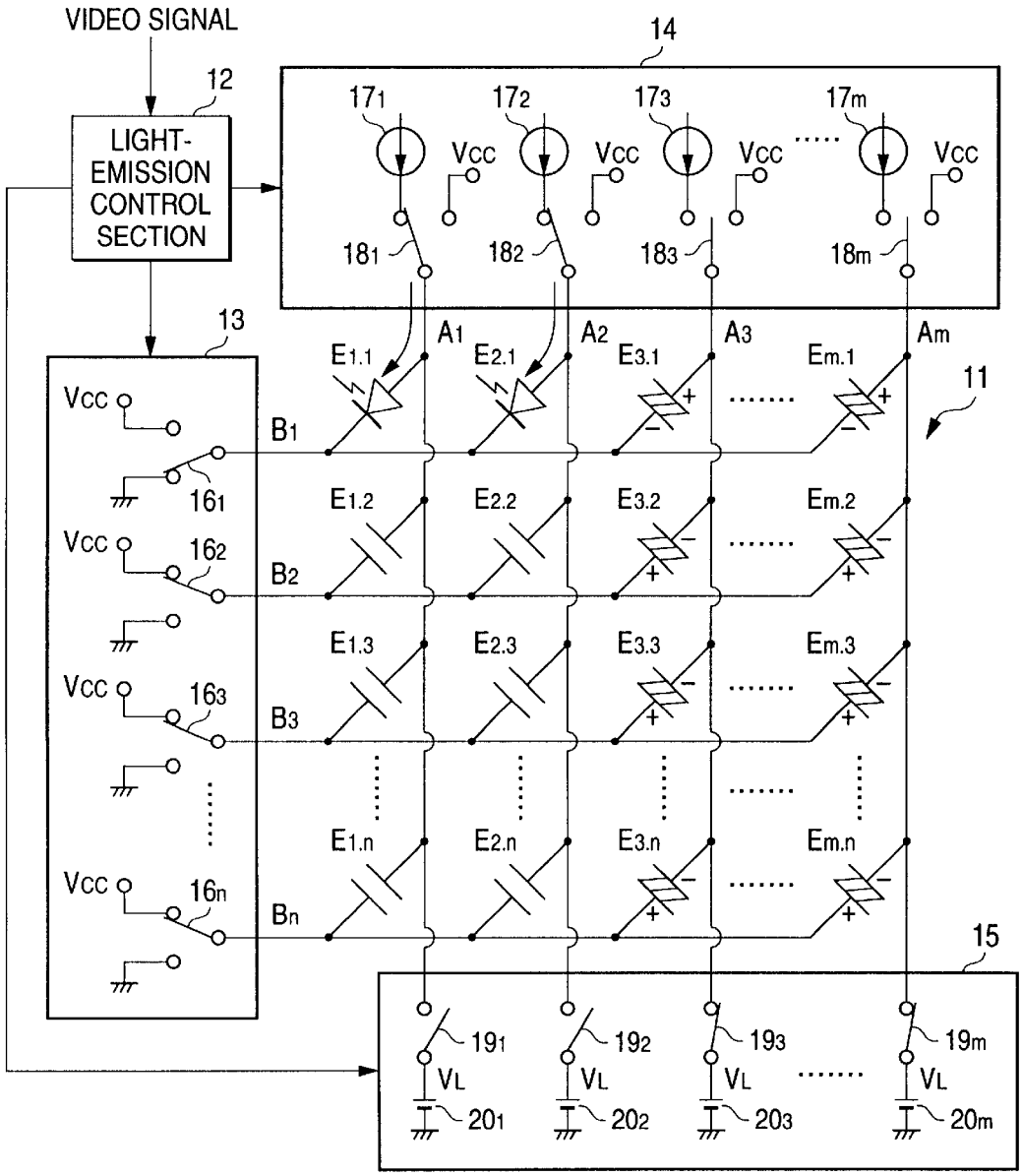
FIG. 11 is a block diagram for describing the illumination drive operation shown in FIG. 9.

In connection with FIG. 11, only a scanning switch $16_1$ is switched to a ground potential of 0 volt, thereby scanning a cathode line $B_1$. A reverse bias voltage Vcc is applied to the remaining cathode lines $B_2$ to $B_n$ by way of corresponding scanning switches $16_2$ to $16_n$. Simultaneously, the anode line $A_1$ is connected to the current source $17_1$ by way of the drive switch $18_1$, and the anode line $A_2$ is connected to the current source $17_2$ by way of the drive switch $18_2$. The drive switches $18_3$ to $18_m$ are placed in neutral positions. The voltage $V_L$ is applied to the remaining anode lines $A_3$ to $A_m$ by way of the potential application switches $19_3$ to $19_m$. In the circuit configuration shown in FIG. 11, only the EL elements $E_{1,1}$ and $E_{2,1}$ are forwardly biased, and a drive current flows into the EL elements $E_{1,1}$ and $E_{2,1}$ from the current sources $17_1$ and $17_2$, as designated by arrows. As a result, only the elements $E_{1,1}$ and $E_{2,1}$ are illuminated. In an illuminated state, a reverse bias voltage Vcc-$V_L$ is applied between the anode and cathode electrodes of each of non-illuminating and hatched EL elements $E_{3,2}$ to $E_{m,n}$. The EL elements $E_{3,2}$ to $E_{m,n}$ are charged with illustrated polarities, respectively. Since the voltage Vcc-$V_L$ is sufficiently low, the electric charges stored in the EL element are smaller than those charged in an EL element of a known flat display panel. Although the voltage $V_L$ is forwardly applied between the anode and cathode electrodes of each of the hatched and nonilluminating EL elements $E_{3,1}$ to $E_{m.i}$, the voltage $V_L$ is lower than the illumination threshold voltage $V_{th}$, and hence the EL elements $E_{3,1}$ to $E_{m.i}$ remain unilluminated and are charged solely.

If the illuminated state of the EL elements shown in FIG. 11 have been effected for only the scanning period T, a reset control operation is performed before there is effected the next scanning operation for causing the EL elements $E_{2,2}$ and $E_{3,2}$ to illuminate. As shown in FIG. 12, all the drive switches $18_1$ to $18_3$ and all the scanning switches $16_1$ to $16_n$ are switched to the potential Vcc. Since all the potential application switches $19_1$ to $19_m$ are turned off, the positive lines $A_1$ to $A_3$ and the negative lines $B_1$ to $B_n$ are made equal to the potential Vcc. Through such a reset control operation, all the anode and cathode lines are made equal to the potential Vcc. The electric charge stored in the EL elements are discharged by way of the path such as that designated by an arrow, whereby the electric charge stored in all the EL elements disappears immediately.

When the next horizontal scanning period beings after the electric charges stored in the EL elements have been discharged to zero, only a scanning switch $16_2$ corresponding to a cathode line $B_2$ is switched to 0 voltage, thus scanning the cathode line $B_2$. Simultaneously, the drive switches $18_2$ and $18_3$ are switched to the current sources $17_2$ and $17_3$, and the output terminals of the current sources are connected to the corresponding anode lines. Further, the remaining drive switches $18_1$ and $18_4$ to $18_m$ are switched to neutral positions. The potential application switches $19_1$ to $19_4$ to $19_m$ are turned, to thereby impart the potential $V_L$ to the anode lines $A_1$ and $A_4$ to $A_m$. In connection with the circuit configuration shown in FIG. 13, only the EL elements $E_{2,2}$ and $E_{3,2}$ are forwardly biased, so that a drive current flows from current sources $17_2$ and $17_3$ to the EL elements $E_{2,2}$ and $E_{3,2}$ thereby causing only the elements $E_{2,2}$ and $E_{3,2}$ to illuminate. In such an illuminated state, the reverse bias voltage VCC-$V_L$ is applied, in a reversely-biased manner, between the anode and cathode electrodes of each of hatched and nonilluminating EL elements $E_{1,1}$, $E_{1,3}$ to $E_{1,n}$, $E_{4,1}$ to $E_{m,1}$, and $E_{4,3}$ to $E_{m,n}$. The EL elements are charged with polarities, as illustrated. Since the voltage VCC-$V_L$ is sufficiently low, the electric charge stored in the EL elements is smaller than that stored in EL elements of a known display. Although the voltage VCC-$V_L$ is forwardly applied between the anode and cathode electrodes of each of hatched and nonilluminating EL elements $E_{1,1}$ and $E_{4,1}$ to $E_{m,1}$. Since the voltage $V_L$ is lower than the illumination threshold voltage $V_{th}$, the EL elements $E_{1,2}$ and $E_{4,2}$ to $E_{m,2}$ remain unilluminated and are charged only.

As mentioned above, the reverse bias voltage VCC-$V_L$ applied to the nonilluminating EL elements during the scanning period is lower than that employed in the known display panel.

In the previous embodiment, the first potential is made equal to ground potential, and the second and fourth potentials are set to a potential Vcc which is substantially equal to the specified illumination voltage Ve of a capacitive luminescent element. However, the present invention is not limited to such an embodiment.

Although in the previous embodiment the anode line drive circuit 14 and the anode line potential output circuit 15 are formed separately, there may be formed the anode line drive circuit 14 including the configuration of the anode line potential output circuit 15 without formation thereof.

In the previous embodiment the reset period is set so as to follow the scanning period during the light-emission control operation. However, the reset period may be set such that the scanning period follows the reset period.

The present invention also provides a luminescent display panel-drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, the drive unit comprising:

control means for setting a scanning period during which a single scanning line is selected from the plurality of scanning lines in accordance with a scan timing of an input video signal, for specifying a light-emission drive line assigned to the capacitive luminescent element which is connected to the single scanning line and is to be illuminated in accordance with the input video signal during the scanning period, for setting a reset period during an interval between scanning periods, and for specifying, as a non-reset drive line, only the drive line having connected to the capacitive luminescent element to remain unilluminated during the scanning period subsequent to the reset period;

scanning means for applying a first potential lower than an illumination threshold voltage of the capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to the capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

According to the present invention, a first potential lower than an illumination threshold voltage is applied to a single scanning line selected for scanning, during a scanning period. A second potential higher than the illumination threshold voltage is applied to the scanning lines other than the single scanning line. A fourth potential slightly lower than the illumination threshold voltage is applied to the plurality of drive lines other than an illumination drive line connected to capacitive luminescent elements to be illuminated. Consequently, a comparatively-low reverse bias voltage is applied to respective capacitive luminescent elements located in intersections between scanning lines except the single scanning line and drive lines except the illumination drive line. Electric charges which are stored in the luminescent elements with the reverse bias voltage and which do not contribute to illumination are diminished as compared with those charged in luminescent elements in a known display panel, thus reducing useless power dissipation.

Further, during the reset period, there is specified as a non-reset drive line only the drive line connected to the capacitive luminescent element which is to remain unilluminated during a scanning period subsequent to the reset period, and the second potential is applied to all the scanning lines. Moreover, a fourth potential equal to the second potential is applied to the plurality of drive lines exclusive of the non-reset drive line. As a result, the electric charges—which are stored in the capacitive luminescent elements connected to non-reset drive line by means of the reverse bias voltage—are held during the current reset period without being discharged. Even when the reverse bias voltage is applied to the capacitive luminescent elements during the next scanning period, charging or discharging barely arises in the luminescent elements, thereby reducing useless power dissipation.

Further, an embodiment of the present invention will be described hereinbelow in detail by reference to the accompanying drawings.

Figure 14:
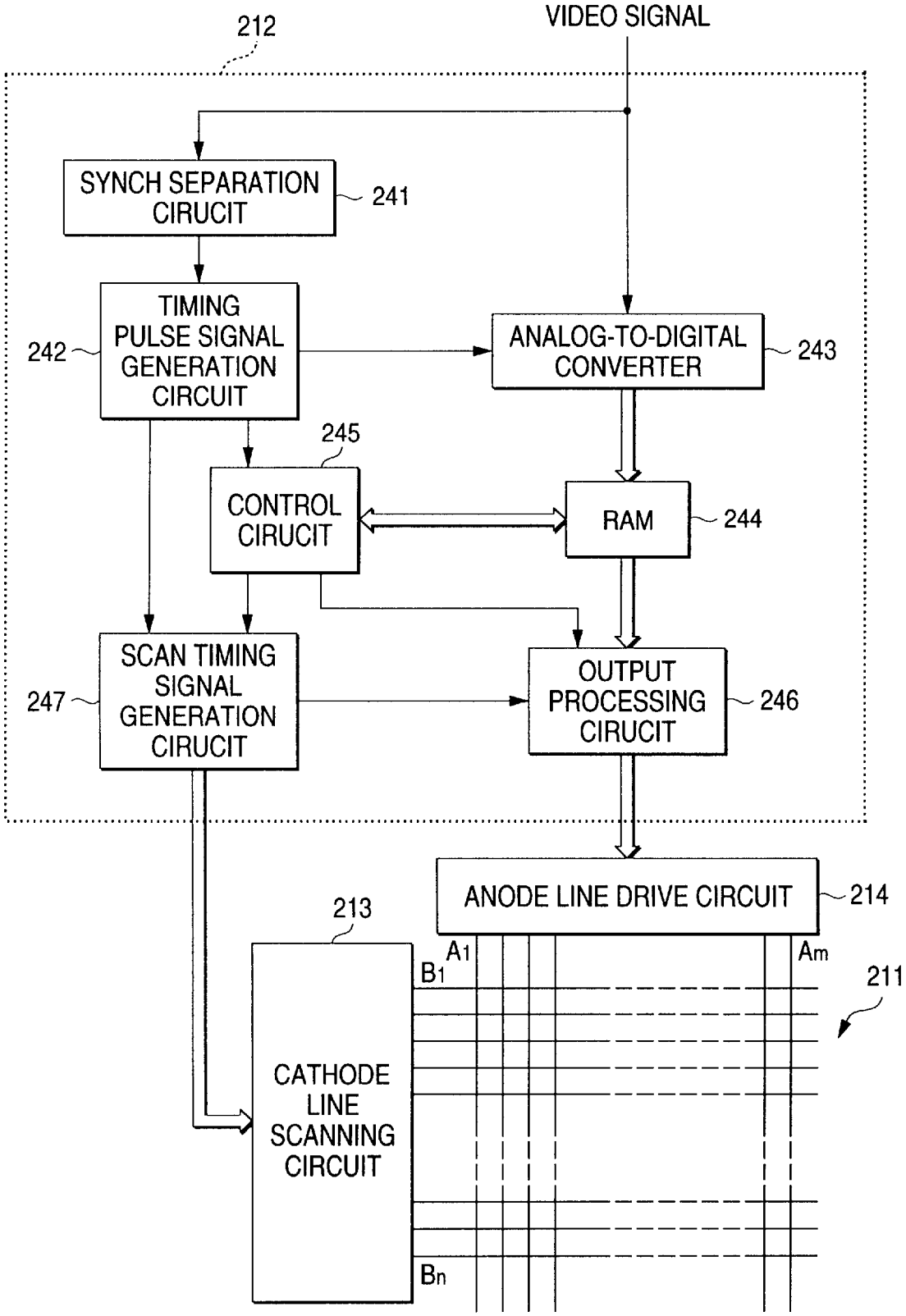
FIG. 14 is a block diagram showing the configuration of a luminescent display panel drive unit according to the present invention.

FIG. 14 schematically shows the configuration of a display which is embodied by application of the present invention to A luminescent display panel using EL elements as capacitive luminescent elements. The display comprises a capacitive luminescent display panel 211; a light-emission control section 212; a cathode line scanning circuit 213; and an anode drive circuit 214.

Figure 15:
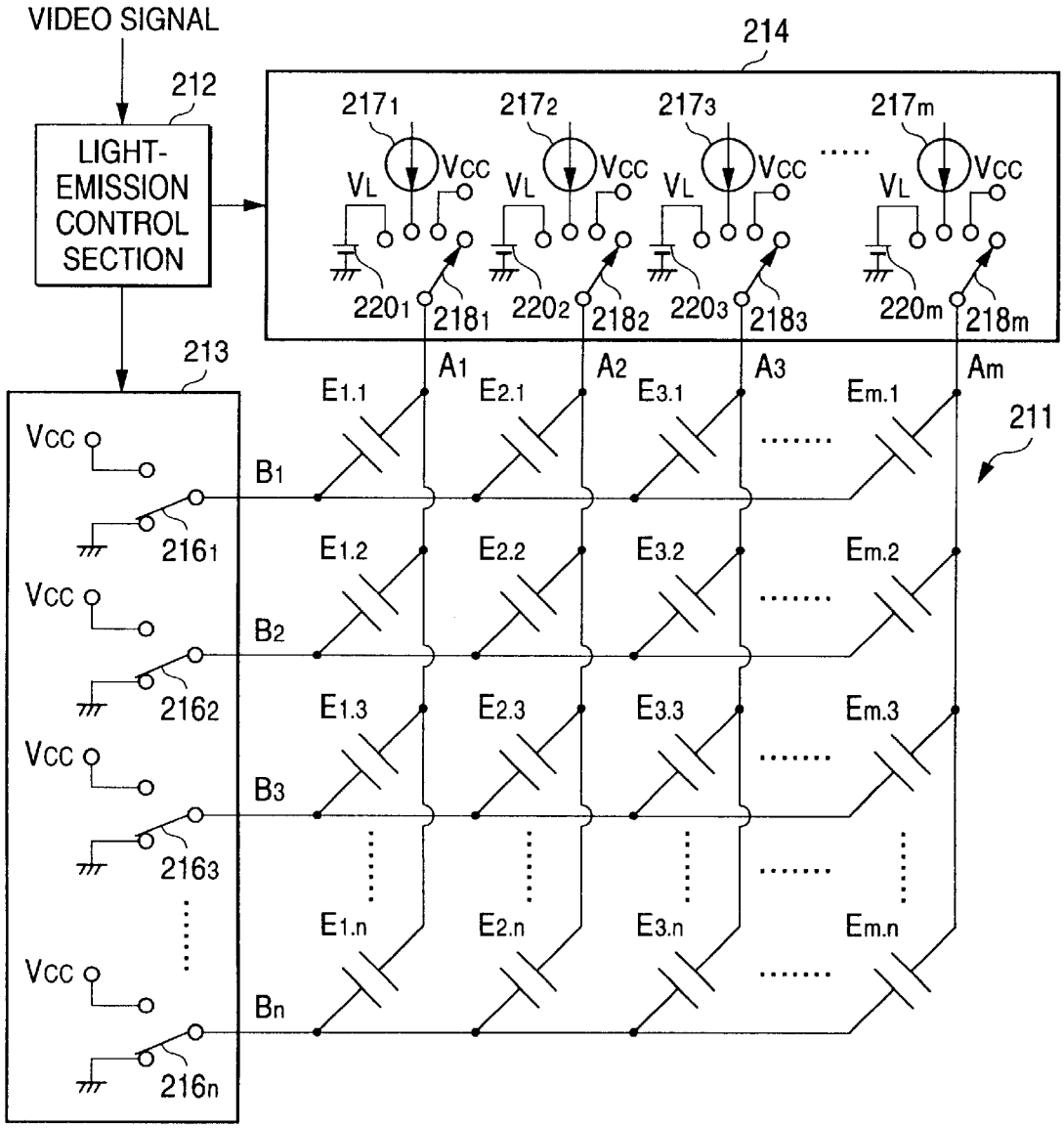
FIG. 15 is a block diagram specifically showing a luminescent display panel, a cathode line scanning circuit, and an anode line drive circuit of the drive unit shown in FIG. 14.

As shown in FIG. 15, the luminescent display panel 211 comprises a plurality of EL elements $E_{I,j}$ ($1 \leqq i \leqq m$, $1 \leqq j \leqq n$). As in the case of the EL elements shown in FIGS. 4 through 6, the plurality of EL elements are arranged in a matrix pattern at respective intersections between anode lines $A_1$ to $A_m$ serving as drive lines and cathode lines $B_1$ to $B_n$ serving as scanning lines. The EL elements are connected to the scanning lines and the drive lines. In other words, the EL elements are located at respective intersections between a plurality of drive lines extending substantially in parallel with each other and a plurality of scanning lines extending substantially at right angles to the drive lines. Each of the EL elements is connected to the scanning line and the drive line. The EL elements $E_{I,j}$ shown in FIG. 15 are depicted by capacitor symbols.

In the luminescent display panel 211, the cathode lines $B_1$ to $B_n$ are connected to the cathode line scanning circuit 213, and the anode lines $A_1$ to $A_m$ are connected to the anode line drive circuit. 214. The cathode line scanning circuit 213 has scanning switches $\mathbf{216}_1$ to $\mathbf{216}_n$ assigned to the respective cathode lines $B_1$ to $B_n$. Each of the scanning switches $\mathbf{216}_1$ to $\mathbf{216}_n$ supplies to a corresponding cathode line ground potential or a reverse bias voltage Vcc. Under control of the light-emission control section 212, the scanning switches $\mathbf{216}_1$ to $\mathbf{216}_n$ are sequentially switched to ground potential every horizontal scanning period. Accordingly, the cathode lines $B_1$ to $B_n$ set to ground potential act as scanning lines which enable illumination of EL elements connected to the cathode lines $B_1$ to $B_n$.

The anode line drive circuit 214 has current sources $\mathbf{217}_1$ to $\mathbf{217}_m$, drive switches $\mathbf{218}_1$ to $\mathbf{218}_m$, and voltage sources $\mathbf{220}_1$ to $\mathbf{220}_m$, which are provided so as to correspond to the anode lines $A_1$ to $A_m$. A voltage $V_L$ develops between the positive and negative terminals of each of the voltage sources $\mathbf{220}_1$ to $\mathbf{220}_m$. The voltage $V_L$ is lower than and close to the threshold illumination voltage $V_{th}$. Each of the drive switches $\mathbf{218}_1$ to $\mathbf{218}_m$ corresponds to a changeover switch having three stationary contacts. A moving contact of each of the drive switches $\mathbf{218}_1$ to $\mathbf{218}_m$ is connected to a corresponding one of the anode lines $A_1$ to $A_m$. A first stationary contact of each of the drive switches $\mathbf{218}_1$ to $\mathbf{218}_m$ is connected to a positive terminal of a corresponding one of the voltage sources $\mathbf{220}_1$ to $\mathbf{220}_m$. A second stationary contact of each of the drive switches $\mathbf{218}_1$ to $\mathbf{218}_m$ is connected to an output terminal of a corresponding one of the current sources $\mathbf{217}_1$ to $\mathbf{217}_m$. Further, a voltage Vcc is applied to the third stationary contact of each of the drive switches $\mathbf{218}_1$ to $\mathbf{218}_m$. The negative terminal of each of the voltage sources $\mathbf{220}_1$ to $\mathbf{220}_m$ is connected to ground. Moreover, the voltage Vcc is output from an unillustrated voltage source.

The light-emission control section 212 controls the cathode line scanning circuit 213 and the anode line drive circuit 214, so as to cause the luminescent display panel 211 to display an image in accordance with a video signal supplied from an unillustrated video signal generation system. Such a control operation is performed while being divided into a reset period and a scanning period.

The light-emission control section 212 produces a reset signal during a reset period, and the thus-produced reset signal is delivered to the cathode line scanning circuit 213 and the anode line drive circuit 214. The cathode line scanning circuit 213 performs a control operation for switching the scanning switches $\mathbf{216}_1$ to $\mathbf{216}_n$ such that a reverse bias voltage Vcc is applied to all the cathode lines $B_1$ to $B_n$ in accordance with the reset signal. The anode line drive circuit 214 performs a control operation for switching the drive switches $\mathbf{218}_1$ to $\mathbf{218}_n$ such that a voltage Vcc is applied to the anode lines $A_1$ to $A_n$ in accordance with the reset signal. As will be described later, the drive switches $\mathbf{218}_1$ to $\mathbf{218}_m$ are controlled such that a voltage $V_L$ is applied to the anode lines not connected to the EL elements which have been illuminated during the previous scanning period or which are to illuminate during the current scanning period (i.e., non-reset drive lines).

The light-emission control section 212 sends a scanning line selection control signal to the cathode line scanning circuit 213 during the scanning period. The scanning switches $\mathbf{216}_1$ to $\mathbf{216}_n$ are switched such that any one of the cathode lines $B_1$ to $B_n$ corresponding to the horizontal scanning period of a video signal is selected and set to ground potential and such that a reverse bias voltage Vcc is applied to the remaining cathode lines. In order to prevent illumination of EL elements connected to the intersections between the anode lines to which the drive current is applied and the cathode lines which are not selected for scanning, which would otherwise be caused by crosstalk, a constant-voltage source (not shown) connected to the cathode lines supplies the reverse bias voltage Vcc. Since the scanning switches $\mathbf{216}_1$ to $\mathbf{216}_n$ are sequentially switched to ground potential during every horizontal scanning period, the cathode lines $B_1$ to $B_n$ set to ground potential act as scanning lines which enable illumination of the EL elements connected to the cathode lines $B_1$ to $B_n$.

The light-emission control section 212 produces a drive control signal indicating that one among the EL elements connected to a scanning line is to be illuminated, at any timing and for any period of time, in accordance with pixel information represented by a video signal during a scanning period. The thus-produced drive control signal is delivered to the anode line drive circuit 214. In response to the drive control signal, the anode lines drive circuit 214 switches, to the current source side, the ones among the drive switches $\mathbf{218}_1$ to $\mathbf{218}_m$ assigned to the anode line connected to the EL elements to be illuminated. By way of the corresponding one of the anode lines $A_1$ to $A_m$, a drive current corresponding to the pixel information is supplied to the EL elements. The remaining drive switches 18 are switched to the first stationary contacts, and the voltage $V_L$ is supplied to the drive switches from the voltage sources $\mathbf{220}_1$ to $\mathbf{220}_m$.

The internal circuit of the light-emission control circuit 212 is configured as shown in FIG. 14. As shown in FIG. 14, a such separation circuit 241 extracts horizontal and vertical synch signals from a supplied input video signal. The thus-extracted horizontal and vertical synch signals are supplied to a timing pulse signal generation circuit 242. On the basis of the thus-extracted horizontal and vertical synch signals, the timing pulse signal generation circuit 242 produces a synch signal timing pulse signal. The thus-produced synch signal timing pulse signal is supplied to an analog-to-digital converter 243, a control circuit 245, and a scan timing signal generation circuit 247. The analog-to-digital converter 243 converts an input video signal into digital pixel data on a per-pixel basis, in synchronism with the synch signal timing pulse signal. The input video signal is supplied to the memory 244. The control circuit 245 supplies a write signal and a read signal, which are synchronized with the synch signal timing pulse signal, to the memory 244 according to a drive method to be described later. In response to the write signal, the memory 244 sequentially captures the pixel data supplied from the analog-to-digital converter 243. Further, in response to the read signal, the memory 244 sequentially reads pixel data stored therein and supplies the thus-read pixel data to an output processing circuit 246 provided in a subsequent stage. The scan timing signal generation circuit 247 produces various timing signals for controlling a scanning switch and a drive switch and delivers the thus-produced signals to the cathode line scanning circuit 213 and the output processing circuit 246. As a result, the scan timing signal generation circuit 247 supplies a scan selection control signal to the cathode line scanning circuit 213. In synchronism with a timing signal output from the scan timing signal generation circuit 247, the output processing circuit 246 supplies, to the anode line drive circuit 214, a drive control signal corresponding to the pixel data supplied from the memory 244. During a reset period, the control circuit 245 supplies a reset signal to the anode line drive circuit 214 by way of the output processing circuit 246, as well as to the cathode line scanning circuit 213 by way of the scan timing signal generation circuit 247.

Figure 16:
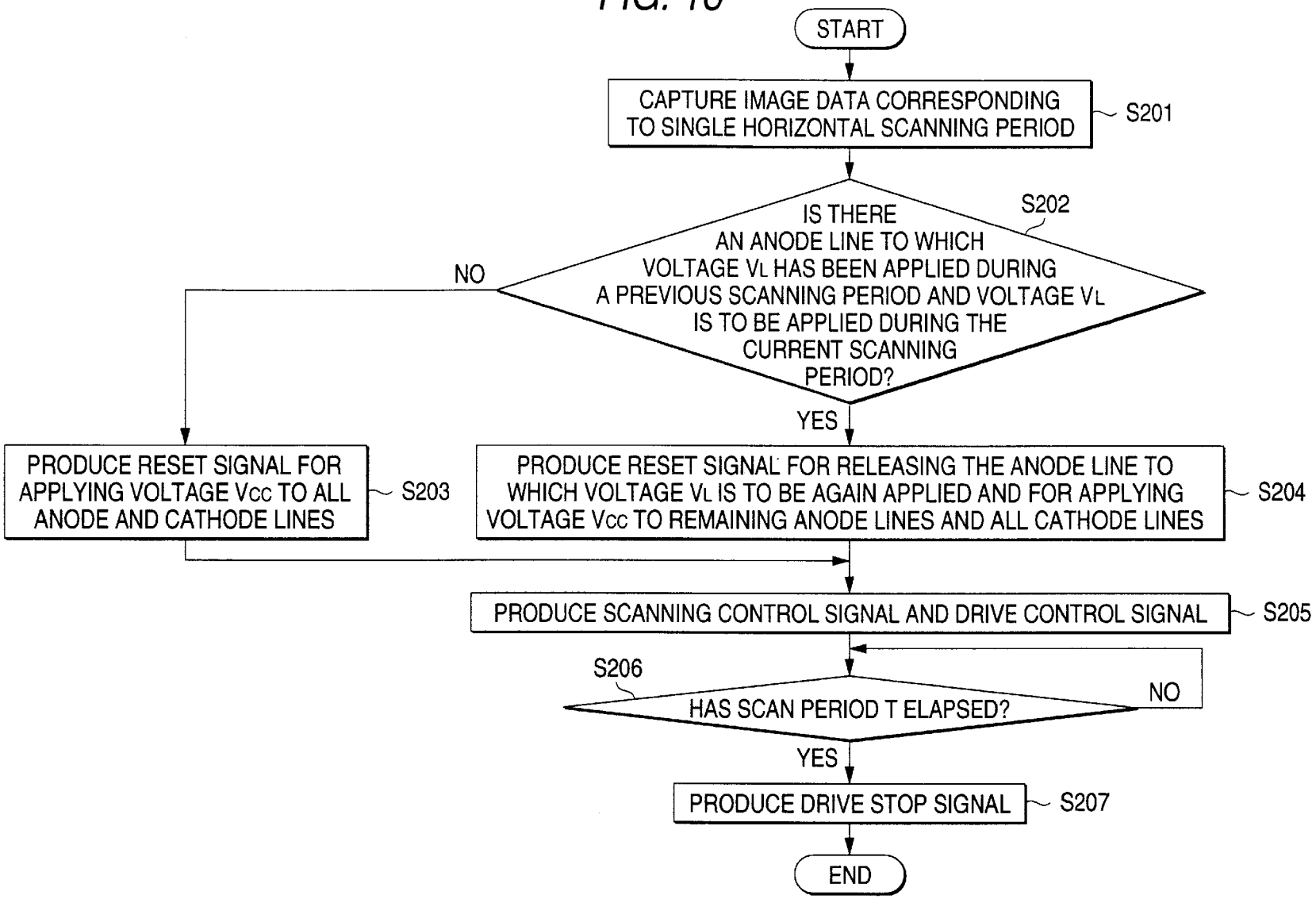
FIG. 16 is a flowchart for describing an illumination drive operation performed by a light-emission control circuit.

The drive operation of the capacitive luminescent display panel performed by the control circuit 245 of the light-emission control section 212 will now be described by reference to a flowchart shown in FIG. 16.

The control circuit 245 executes a light-emission control routine for every horizontal scanning period of the supplied pixel data. In the light-emission control routine, pixel data corresponding to a horizontal scanning period are acquired (step S201). A determination is made as to whether or not an anode line (non-reset drive line) to which the voltage $V_L$ has been applied during the previous scanning period is included in the anode lines to which the voltage $V_L$ is to be applied during a current scanning period in accordance with the pixel data (step S202). When the voltage $V_L$ has been applied to an anode line during the previous scanning period and is to be applied to the anode line during the current scanning period, all the EL elements connected to the anode line remain extinct during both the previous and current scanning periods. In connection with the determination, a determination may be made as to whether or not a drive switch which have been switched to the first stationary contact during the previous scanning period is included in the drive switches to be switched to the first stationary contact during the current scanning period.

If there is no anode line to which the voltage $V_L$ has been applied during either the previous scanning period and is to be applied during current scanning period, there is issued a reset signal for applying a voltage Vcc to all the positive lines $A_1$ to $A_m$ and all the cathode lines $B_1$ to $B_n$ (step S203). In contrast, if there is an anode line to which the voltage $V_L$ has been applied during the previous scanning period and is to be applied during the current scanning period, there is produced a reset signal for releasing the anode line, for applying the voltage $V_L$ to the anode line, and for applying the voltage Vcc to the remaining positive lines and all the cathode lines $B_1$ to $B_n$ (step S204). The reset signal is supplied to the cathode line scanning circuit 213 and the anode line drive circuit 214.

In the case of the reset signal produced in step S203, the cathode line scanning circuit 213 switches movable contacts of all the scanning switches $\mathbf{216}_1$ to $\mathbf{216}_n$ to the stationary points of voltage Vcc in accordance with the reset signal. In accordance with the reset signal, the anode line drive circuit 214 switches the movable contacts of all the drive switches $\mathbf{218}_1$ to $\mathbf{218}_n$ to the third stationary contacts of voltage Vcc. As a result, the voltage developing across each EL element $E_{I,j}$ becomes equal to the voltage Vcc, thereby discharging the electric charges stored in the EL elements.

In the case of the reset signal produced in step S204, the cathode line scanning circuit 213 switches the movable contacts of all the scanning switches $\mathbf{216}_1$ to $\mathbf{216}_n$ to the stationary contacts of voltage Vcc in accordance with the reset signal. In the anode line drive circuit 214, drive switches corresponding to the anode lines—to which the voltage $V_L$ has been applied during the previous scanning period and is to be applied during the current scanning period—are switched to the fourth stationary contact. The drive switches corresponding to the remaining anode lines are switched to third stationary contacts of voltage Vcc. Provided that there is an anode line $A_k$ ("k" corresponds to at least one numeral in the range of 1 through "mm") to which the voltage $V_L$ has been applied during the previous scanning period and to which the voltage $V_L$ is to be applied during the current scanning period, a voltage developing across EL elements $E_{I,j}$ excluding the EL element $E_{k,j}$ becomes equal to the voltage Vcc. The electric charges stored in the EL elements are discharged. A voltage Vcc-$V_L$ is applied between the terminals of each of the EL element $E_{k,j}$ connected to the anode line $A_k$ in a reversely-biased manner.

The reset period may be constant or may vary in length in accordance with a scanning period T.

The control circuit 245 produces a scan selection control signal and a drive control signal in accordance with pixel information represented by the pixel data, which data have been captured in step S201 and correspond to a single horizontal scanning period (step S205).

The scan selection control signal is delivered to the cathode line scanning circuit 213. The cathode line scanning circuit 213 switches, to ground, a scanning switch (a single scanning switch $\mathbf{216}_S$ in the range of $\mathbf{216}_1$ to $\mathbf{216}_n$, where "S" designates a numeral in the range of 1 to "n") assigned to one of the cathode lines $B_1$ to $B_n$, which cathode line corresponds to the current horizontal scanning period represented by the scan selection control signal.

The drive control signal is supplied to the anode line drive circuit 214. In the anode line drive circuit 214, a drive switch (any one of the drive switches $\mathbf{218}_1$ to $\mathbf{218}_m$) is switched to a second stationary contact connected to a current source (i.e., the corresponding one of the current sources $\mathbf{217}_1$ to $\mathbf{217}_m$). Here, the drive switch is assigned to one of the anode lines $A_1$ to $A_m$, which anode line is connected to an EL element to be illuminated during the current horizontal scanning period represented by the drive control signal. Drive switches 218 assigned to the remaining anode lines A are switched to the first stationary contacts connected to voltage sources (corresponding ones of voltage sources $\mathbf{220}_1$ to $\mathbf{220}_m$).

For example, in a case where the drive switch $\mathbf{218}_1$ is switched to a current source $\mathbf{217}_1$, a drive current flows from the current source $\mathbf{217}_1$ to a drive switch $\mathbf{218}_1$, the anode line $A_1$, an EL element $E_{1,s}$, a cathode line $B_s$, a scanning switch $\mathbf{216}_S$, and ground. The EL element $E_{1,s}$ to which the drive current is supplied illuminates in accordance with the pixel data.

If the drive switch switched to the first contact is assigned $\mathbf{218}_3$, the voltage $V_L$ is applied to an anode line $A_3$ from a voltage source $\mathbf{220}_3$ by way of a drive switch. The voltage Vcc-$V_L$ is applied to EL elements $E_{3,1}$ to $E_{3,n}$ exclusive of an EL element $E_{3,s}$ in a reversely-biased manner. The voltage $V_L$ lower than the illumination threshold voltage $V_{th}$ is forwardly applied to the EL element $E_{3,s}$, wherewith the EL elements $E_{3,1}$, to $E_{3,n}$ are charged with an applied voltage.

After having performed processing pertaining to step S205, the control circuit 245 determines whether or not a preset scanning period T has elapsed (step S206). The scanning period T is set in accordance with, for example, brightness information included in the pixel data and a preset horizontal scanning period. The scanning period is determined through use of an unillustrated internal counter.

If the scanning period T has elapsed, processing proceeds to step S207, where the control circuit 245 produces a drive stop signal, to thereby terminate the light-emission control routine. The control circuit 245 enters a stand-by state until the next horizontal scanning period begins. When the next horizontal scanning period begins, processing pertaining to steps S201 to S207 is repeated. FIG. 10 shows the relationship between a reset period and a scanning period T, which are required for the foregoing illumination and drive operations. The scanning period T shown in FIG. 10 designates a period starting from the end of the reset period to the start of the next horizontal scanning period. As mentioned above, if the scanning period T continues to the start of the next horizontal scanning period, steps S206 and S207 may be omitted.

Figure 18:
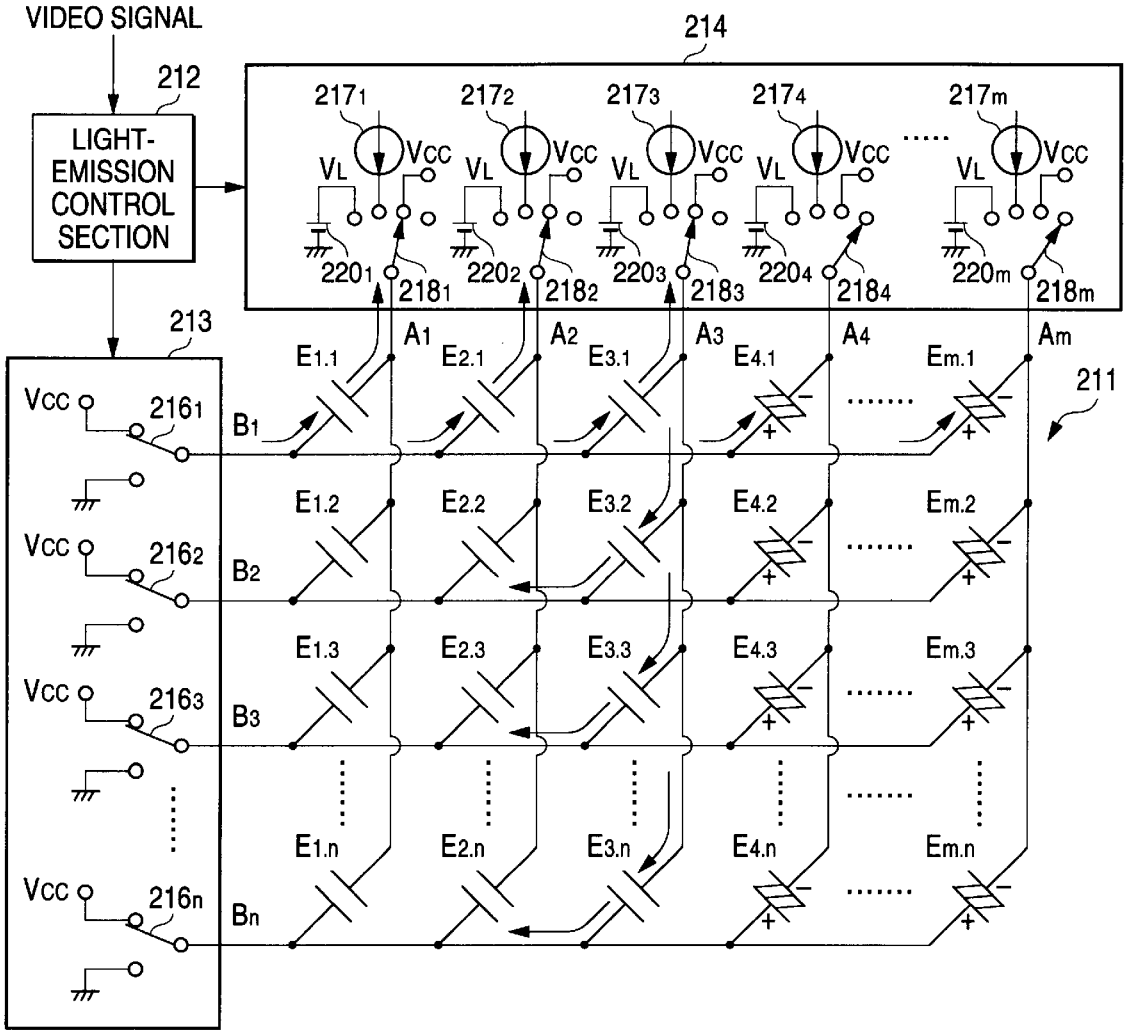
FIG. 18 is a block diagram for describing the illumination drive operation shown in FIG. 16.
Figure 19:
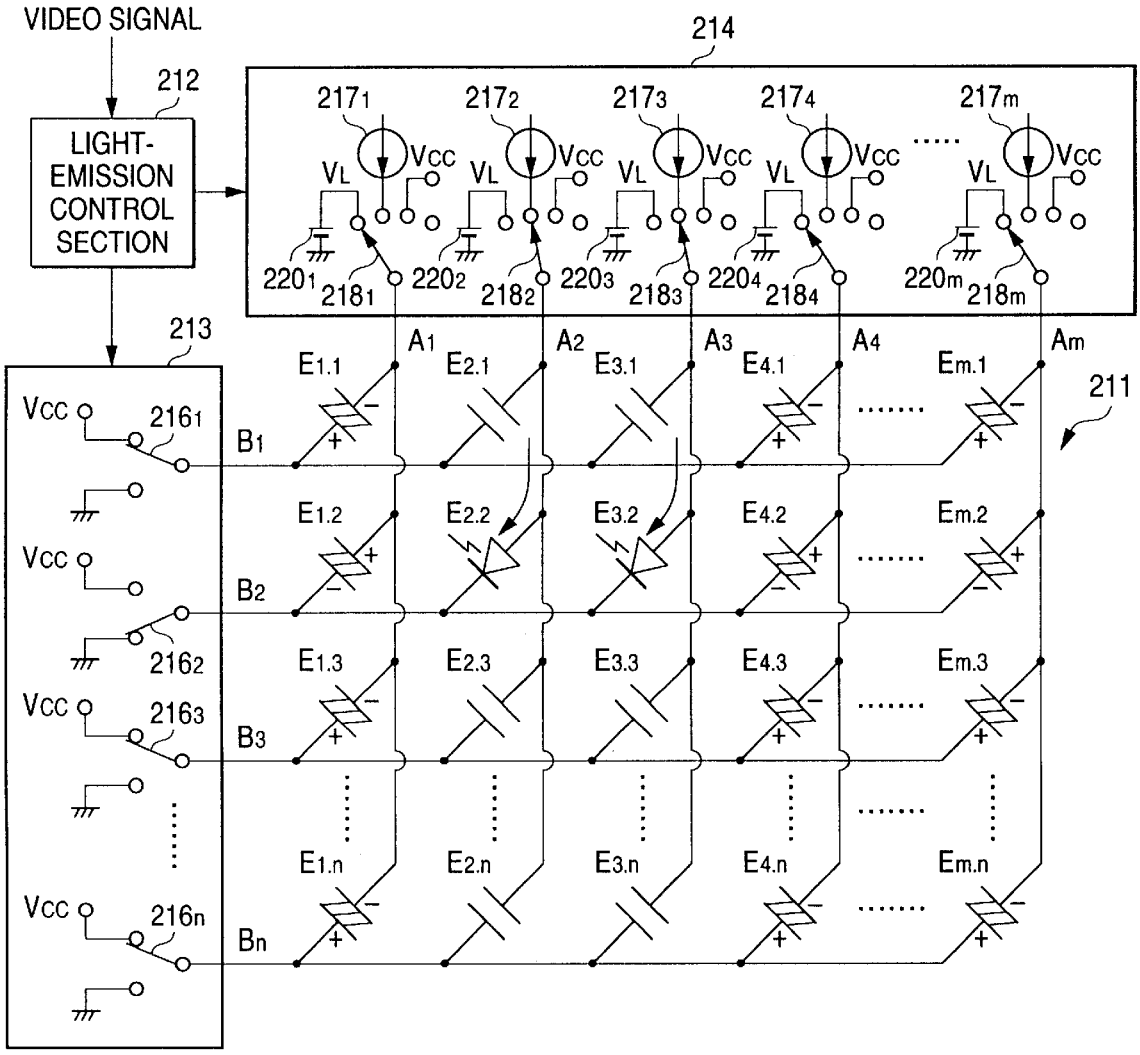
FIG. 19 is a block diagram for describing the illumination drive operation shown in FIG. 16.

By reference to FIGS. 17 through 19, next will be described a case where, after a cathode line $B_1$ has been scanned by means of the control operation of the control circuit 245, to thereby cause elements $E_{1.1}$ and $E_{2.1}$ to illuminate, a cathode line $B_2$ is scanned, to thereby cause elements $E_{2.2}$ and $E_{3.2}$ to illuminate. In order to facilitate explanations, illuminating EL elements shown in FIGS. 17 through 19 are depicted by diode symbols, and nonilluminating EL elements are depicted by capacitor symbols.

Figure 17:
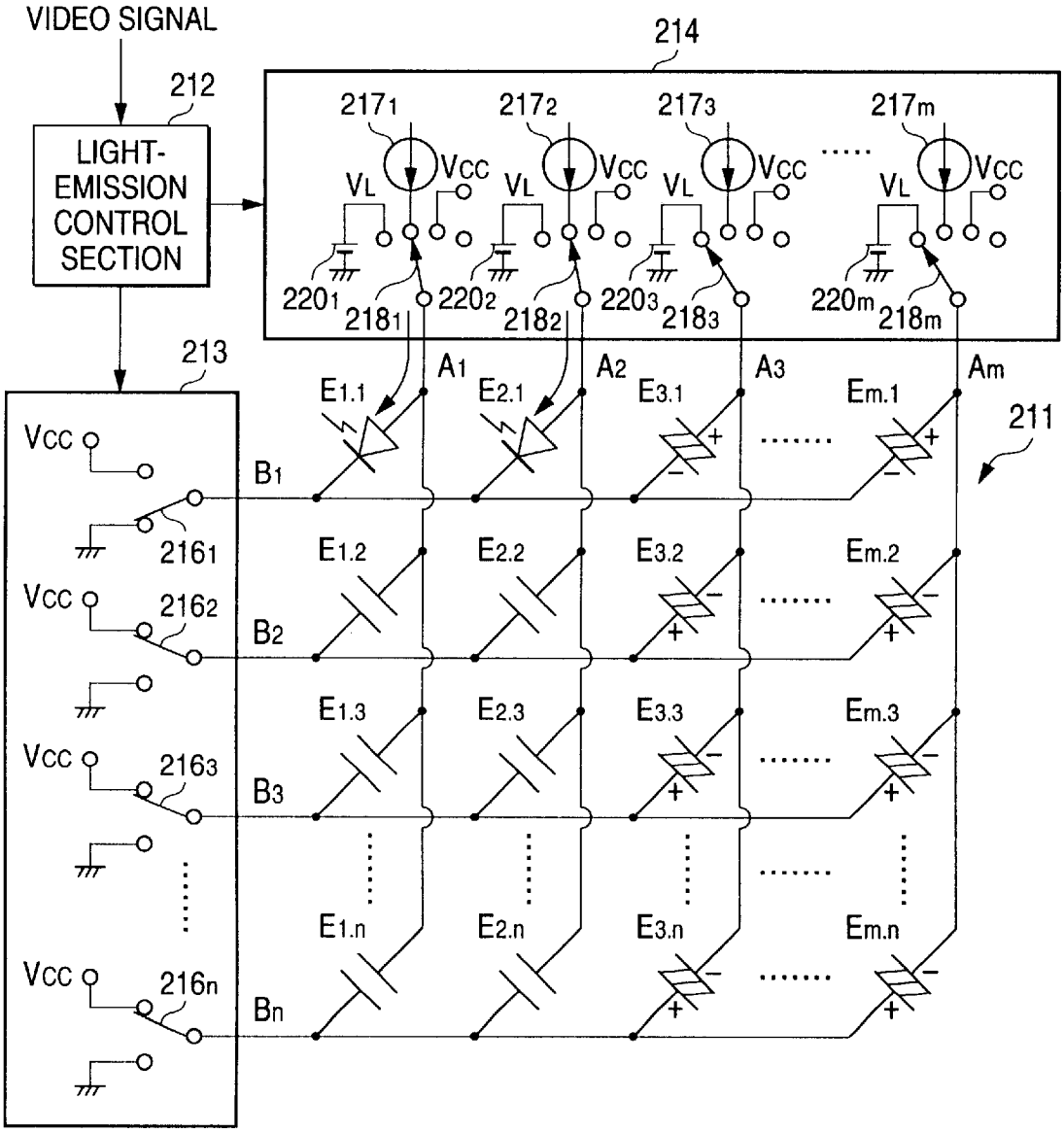
FIG. 17 is a block diagram for describing the illumination drive operation shown in FIG. 16.

In connection with FIG. 17, only a scanning switch $\mathbf{216}_1$ is switched to a ground potential of 0 volt, thereby scanning a cathode line $B_1$. A reverse bias voltage Vcc is applied to the remaining cathode lines $B_2$ to $B_n$ by way of corresponding scanning switches $\mathbf{216}_2$ to $\mathbf{216}_n$. Simultaneously, the anode line $A_1$ is connected to the current source $\mathbf{217}_1$ by way of the drive switch $\mathbf{218}_1$, and the anode line $A_2$ is connected to the current source $\mathbf{217}_2$ by way of the drive switch $\mathbf{218}_2$. The voltage $V_L$ is applied to the remaining anode lines $A_3$ to $A_m$ by way of the drive switches $\mathbf{218}_3$ to $\mathbf{218}_m$. In the circuit configuration shown in FIG. 17, only the EL elements $E_{1,1}$ and $E_{2,1}$ are forwardly biased, and a drive current flows into the EL elements $E_{1,1}$, and $E_{2,1}$ from the current sources $\mathbf{217}_1$ and $\mathbf{217}_2$, as designated by arrows. As a result, only the elements $E_{1,1}$, and $E_{2,1}$ are illuminated. In an illuminated state, a reverse bias voltage Vcc-$V_L$ is applied between the anode and cathode electrodes of each of nonilluminating and hatched EL elements $E_{3,2}$ to $E_{m,n}$. The EL elements $E_{3,2}$ lo $E_{m,n}$ are charged with illustrated polarities, respectively. Since the voltage VCC-$V_L$ is sufficiently low, the electric charges stored in the EL element are smaller than those charged in an EL element of a known flat display panel. Although the voltage $V_L$ is forwardly applied between the anode and cathode electrodes of each of the hatched and nonilluminating EL elements $E_{3.1}$ to $E_{m.i}$, the voltage $V_L$ is lower than the illumination threshold voltage $V_{th}$, and hence the EL elements $E_{3.1}$ to $E_{m.i}$ remain unilluminated and are charged solely.

If the illuminated state of the EL elements shown in FIG. 17 have been effected for only the scanning period T, a reset control operation is performed before illumination of the EL elements $E_{2,2}$ and $E_{3,2}$ during the next horizontal scanning period. As shown in FIG. 18, the drive switches $\mathbf{218}_1$ to $\mathbf{218}_3$ and all the scanning switches $\mathbf{216}_1$ to $\mathbf{216}_n$ are switched to the potential Vcc. Accordingly, the positive lines $A_1$ to $A_3$ and the negative lines $B_1$ to $B_n$ are made equal to the potential Vcc. Through such a reset control operation, the electric charges stored in the respective EL elements $E_{1,1}$ to $E_{3,n}$ are discharged by way of the path designated by arrows in the drawing, wherewith the electric charges stored in all the EL elements become momentarily zero. Even during the current scanning period, no drive current for illumination purpose is supplied to the anode lines $A_4$ to $A_m$. Hence, the anode lines $A_4$ to $A_m$ are released by way of drive switches $\mathbf{218}_4$ to $\mathbf{218}_m$. Accordingly, the voltage Vcc is applied to the cathode of each of the EL elements $E_{4,1}$ to $E_{m,n}$. The anodes of the EL elements $A_{4,1}$ to $E_{m,n}$ are commonly connected to respective anode lines $A_4$ to $A_m$. Therefore, there is discharged the electric charge that has been stored in the EL elements $E_{4,1}$ to $E_{m,1}$ as a result of forward application of the voltage $V_L$ during the scanning period shown in FIG. 17. An electric current further flows into and are charged into the EL elements $E_{4,3}$ to $E_{m,1}$. The electric charge that has been stored during the scanning period shown in FIG. 17 are held in the EL elements $E_{4,2}$ to $E_{m,n}$ exclusive of the EL elements $E_{4,1}$ to $E_{m,1}$. Consequently, the EL elements $E_{4,1}$ to $E_{m,1}$ are equally charged with the polarities such as those shown in FIG. 18.

When the next horizontal scanning period beings after the electric charges stored in the EL elements $E_{1,1}$to $E_{3,n}$ have been discharged to zero, only a scanning switch $\mathbf{216}_2$ corresponding to a cathode line $B_2$ is switched to 0 volt, thus scanning the cathode line $B_2$. Simultaneously, the drive switches $\mathbf{218}_2$ and $\mathbf{218}_3$ are switched to the current sources $\mathbf{217}_2$ and $\mathbf{2}_{173}$, and the output terminals of the current sources $\mathbf{217}_2$ and $\mathbf{217}_3$ are connected to the corresponding anode lines $A_2$ and $A_3$. The remaining drive switches $\mathbf{218}_1$ and $\mathbf{218}_4$ to $\mathbf{218}_m$ are switched to the first stationary contact of potential $V_L$, and the voltage $V_L$ is supplied to the anode lines $A_1$ and $A_4$ through $A_m$. In connection with the circuit configuration shown in FIG. 19, only the EL elements $E_{2,2}$ and $E_{3,2}$ are forwardly biased, so that a drive current flows from current sources $\mathbf{217}_2$ and $\mathbf{217}_3$ to the EL elements $E_{2,2}$ and $E_{3,2}$, thereby causing only the elements $E_{2,2}$ and $E_{3,2}$ to illuminate. In such an illuminated state, the reverse bias voltage VCC-$V_L$ is applied across the anode and cathode electrodes of each of hatched and nonilluminating EL elements $E_{1,1}$, $E_{1,3}$ to $E_{1,n}$, $E_{4,1}$ to $E_{m,1}$, and $E_{4,3}$ to $E_{m,n}$. The EL elements $E_{1,1}$, and $E_{1,3}$ to $E_{1,n}$ are newly charged with polarities, as illustrated. Since the electric charges are held in the EL elements $E_{4,3}$ to $E_{m,n}$, the electric charge are continuously sustained without application of a voltage VCC-$V_L$ even when the voltage VCC-$V_L$ is applied to the EL elements $E_{4,3}$ to $E_{m,n}$.

As mentioned above, the reverse bias voltage VCC-$V_L$ applied to the nonilluminating EL elements during the scanning period is lower than that employed in the known display panel. The electric charges which are charged by the reverse bias voltage VCC-$V_L$ and do not contribute to illumination are diminished as compared with those which arise in the conventional display panel. In connection with anode lines (non-reset drive lines) to which the voltage $V_L$ has been applied during the previous scanning period and the voltage $V_L$ is to be applied during the current scanning period, none of the EL elements are connected to the non-reset drive line illuminate during the previous and current scanning periods. The electric charges charged with the reverse bias voltage VCC-$V_L$ are held without being discharged during the current reset period. Therefore, in the foregoing example, the total of electric charge charged with the reverse bias voltage Vcc-$V_L$ during the current scanning period can be diminished by the amount of electric charge corresponding to that stored in the EL elements $E_{4,3}$ to $E_{m,n}$.

In the previous embodiment, the first potential is made equal to ground potential, and the second and fourth potentials are set to a potential Vcc which is substantially equal to the specified illumination voltage Ve of a capacitive luminescent element. However, the present invention is not limited to such an embodiment.

Of the anode lines to which the voltage $V_L$ is to be applied during a single horizontal scanning period (i.e., a current scanning period), the anode line to which the voltage $V_L$ has been applied during the previous scanning period is specified as a non-reset drive line by the light-emission control routine in the previous embodiment. Alternatively, the anode lines to which the voltage $V_L$ is to be applied during a single horizontal scanning period may be specified as non-reset drive lines. In such a case, in step S202 a determination may be made as to whether or not there is an anode line to which the voltage $V_L$ is to be applied during the current scanning period.

Further, an embodiment of the present invention will be described hereinbelow in detail by reference to the accompanying drawings.

FIG. 7 schematically shows the configuration of a display which is embodied by application of the present invention to a luminescent display panel using EL elements as capacitive luminescent elements. The display comprises a capacitive luminescent display panel 311; a light-emission control section 312; a cathode line scanning circuit 313; and an anode drive circuit 314.

Figure 20:
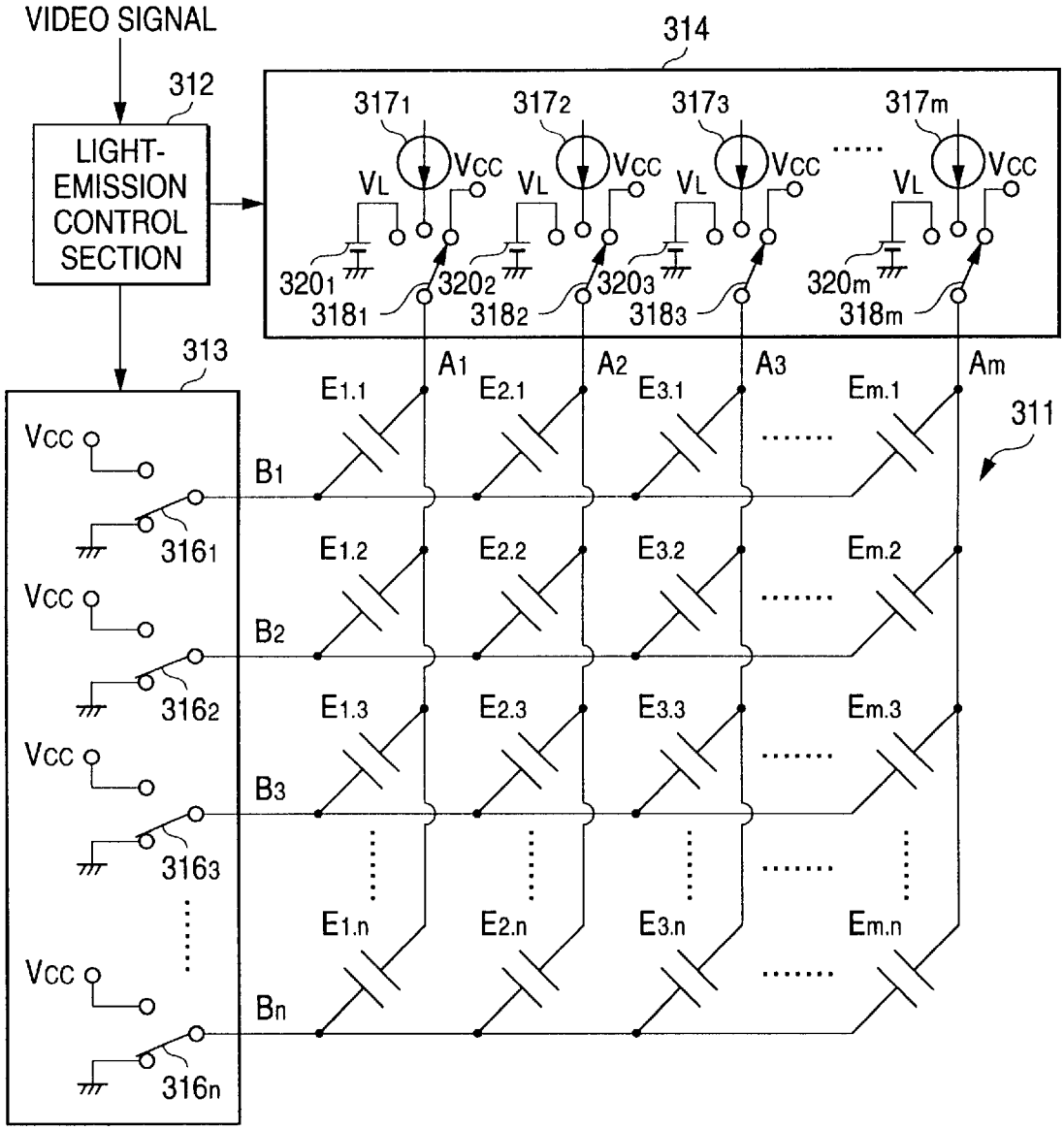
FIG. 20 is a block diagram specifically showing a luminescent display panel, a cathode line scanning circuit, and an anode line drive circuit of the drive unit shown in FIG. 7.

As shown in FIG. 20, the luminescent display panel 311 comprises a plurality of EL elements $E_{I,j}$ ($1 \leqq i \leqq m$, $1 \leqq j \leqq n$). As in the case of the EL elements shown in FIGS. 4 through 6, the plurality of EL elements are arranged in a matrix pattern at respective intersections between anode lines $A_1$ to $A_n$ serving as drive lines and cathode lines $B_1$ to $B_n$ serving as scanning lines. The EL elements are connected to the scanning lines and the drive lines. In other words, the EL elements are located at respective intersections between a plurality of drive lines extending substantially in parallel with each other and a plurality of scanning lines extending substantially at right angles to the drive lines. Each of the EL elements is connected to the scanning line and the drive line. The EL elements $E_{I,j}$. Shown in FIG. 20 are depicted by capacitor symbols.

In the luminescent display panel 311, the cathode lines $B_1$ to $B_n$ are connected to the cathode line scanning circuit 313, and the anode lines $A_1$ to $A_1$ are connected to the anode line drive circuit 314. The cathode line scanning circuit 313 has scanning switches $\mathbf{316}_1$ to $\mathbf{316}_1$ assigned to the respective cathode lines $B_1$ to $B_n$. Each of the scanning switches $\mathbf{316}_1$ to $\mathbf{316}_n$ suppliers to a corresponding cathode line ground potential or a reverse bias voltage Vcc. Under control of the light-emission control section 312, the scanning switches $\mathbf{316}_1$ to $\mathbf{316}_1$ are sequentially switched to ground potential every horizontal scanning period. Accordingly, the cathode lines $B_1$ to $B_n$ set to ground potential act as scanning lines which enable illumination of EL elements connected to the cathode lines $B_n$ to Br, The anode line drive circuit 314 has current sources $\mathbf{317}_1$ to 317w, drive switches $\mathbf{318}_1$ to $\mathbf{318}_m$, and voltage sources $\mathbf{320}_1$ to 320, which are provided so as to correspond to the anode lines $A_1$ to $A_m$. A voltage $V_L$ develops between the positive and negative terminals of each of the voltage sources $\mathbf{320}_1$ to $\mathbf{320}_m$ The voltage $V_L$ is lower than and close to the threshold illumination voltage $V_{th}$. Each of the drive switches $\mathbf{318}_1$ to $\mathbf{318}_m$ corresponds to a changeover switch having three stationary contacts. A moving contact of each of the drive switches $\mathbf{318}_1$ to 318 is connected to a corresponding one of the anode lines $A_1$ to PA. A first stationary contact of each of the drive switches 318, to $\mathbf{318}_m$ is connected to a positive terminal of a corresponding one of the voltage sources $\mathbf{320}_1$ to $\mathbf{320}_m$. A second stationary contact of each of the drive switches $\mathbf{318}_1$ to $\mathbf{318}_m$ is connected to an output terminal of a corresponding one of the current sources $\mathbf{317}_1$ to $\mathbf{317}_m$ Further, a voltage Vcc is applied to the third stationary contact of each of the drive switches $\mathbf{318}_1$ to $\mathbf{318}_m$. The negative terminal of each of the voltage sources $\mathbf{320}_1$ to $\mathbf{320}_m$ is connected to ground. Moreover, the voltage Vcc is output from an unillustrated voltage source.

The light-emission control section 312 controls the cathode line scanning circuit 313 and the anode line drive circuit 314, so as to cause the luminescent display panel 311 to display an image in accordance with a video signal supplied from an unillustrated video signal generation system. Such a control operation is performed while being divided into a reset period and a scanning period.

The light-emission control section 312 produces a reset signal during a reset period, and the thus-produced reset signal is delivered to the cathode line scanning circuit 313 and the anode line drive circuit 314. The cathode line scanning circuit 313 performs a control operation for switching the scanning switches $\mathbf{316}_1$ to $\mathbf{316}_n$ such that a reverse bias voltage Vcc is applied to all the cathode lines $B_1$ to $B_n$ in accordance with the reset signal. The anode line drive circuit 314 performs a control operation for switching the drive switches $\mathbf{318}_1$ to $\mathbf{318}_n$ such that a voltage Vcc is applied to the anode lines $A_1$ to $A_n$ in accordance with the reset signal. As will be described later, the drive switches $\mathbf{318}_1$ to $\mathbf{318}_m$ are controlled such that a voltage $V_L$ is applied to the anode lines not connected to the EL elements which have been illuminated during the previous scanning period or which are to illuminate during the current scanning period (i.e., non-reset drive lines).

The light-emission control section 312 sends a scanning line selection control signal to the cathode line scanning circuit 313 during the scanning period. The scanning switches $\mathbf{316}_1$ to $\mathbf{316}_n$ are switched such that any one of the cathode lines $B_1$ to $B_n$ corresponding to the horizontal scanning period of a video signal is selected and set to ground potential and such that a reverse bias voltage Vcc is applied to the remaining cathode lines. In order to prevent illumination of EL elements connected to the intersections between the anode lines to which the drive current is applied and the cathode lines which are not selected for scanning, which would otherwise be caused by crosstalk, a constant-voltage source (not shown) connected to the cathode lines supplies the reverse bias voltage Vcc. Since the scanning switches $\mathbf{316}_1$ to $\mathbf{316}_n$ are sequentially switched to ground potential during every horizontal scanning period, the cathode lines $B_1$ to $B_n$ set to ground potential act as scanning lines which enable illumination of the EL elements connected to the cathode lines $B_1$ to $B_n$.

The light-emission control section 312 produces a drive control signal indicating that one among the EL elements connected to a scanning line is to be illuminated, at any timing and for any period of time, in accordance with pixel information represented by a video signal during a scanning period. The thus-produced drive control signal is delivered to the anode line drive circuit 314. In response to the drive control signal, the anode line drive circuit 314 switches, to the current source side, the one among the drive switches $\mathbf{318}_1$ to $\mathbf{318}_m$ assigned to the anode line connected to the EL elements to be illuminated. By way of the corresponding one of the anode lines $A_1$ to $A_m$, a drive current corresponding to the pixel information is supplied to the EL elements. The remaining drive switches 318 are switched to the first stationary contacts, and the voltage $V_L$ is supplied to the drive switches from the voltage sources $\mathbf{320}_1$ to $\mathbf{320}_m$.

The internal circuit of the light-emission control circuit 312 is configured as shown in FIG. 7. As shown in FIG. 7, a synch separation circuit 341 extracts horizontal and vertical synch signals from a supplied input video signal. The thus-extracted horizontal and vertical synch signals are supplied to a timing pulse signal generation circuit 342. On the basis of the thus-extracted horizontal and vertical synch signals, the timing pulse signal generation circuit 342 produces a synch signal timing pulse signal. The thus-produced synch signal timing pulse signal is supplied to an analog-to-digital converter 343, a control circuit 345, and a scan timing signal generation circuit 347. The analog-to-digital converter 343 converts an input video signal into digital pixel data on a per-pixel basis, in synchronism with the synch signal timing pulse signal. The input video signal is supplied to the memory 344. The control circuit 345 supplies a write signal and a read signal, which are synchronized with the synch signal timing pulse signal, to the memory 344 according to a drive method to be described later. In response to the write signal, the memory 344 sequentially captures the pixel data supplied from the analog-to-digital converter 343. Further, in response to the read signal, the memory 344 sequentially reads pixel data stored therein and supplies the thus-read pixel data to an output processing circuit 346 provided in a subsequent stage. The scan timing signal generation circuit 347 produces various timing signals for controlling a scanning switch and a drive switch and delivers the thus-produced signals to the cathode line scanning circuit 313 and the output processing circuit 346. As a result, the scan timing signal generation circuit 347 supplies a scan selection control signal to the cathode line scanning circuit 313. In synchronism with a timing signal output from the scan timing signal generation circuit 347, the output processing circuit 346 supplies, to the anode line drive circuit 314, a drive control signal corresponding to the pixel data supplied from the memory 344. During a reset period, the control circuit 345 supplies a reset signal to the anode line drive circuit 314 by way of the output processing circuit 346, as well as to the cathode line scanning circuit 313 by way of the scan timing signal generation circuit 347.

The drive operation of the capacitive luminescent display panel performed by the control circuit 345 of the light-emission control section 312 will now be described by reference to a flowchart shown in FIG. 21.

The control circuit 345 executes a light-emission control routine for every horizontal scanning period of the supplied pixel data. In the light-emission control routine, pixel data corresponding to a horizontal scanning period are acquired (step S301). A determination is made as to whether or not an anode line (non-reset drive line) to which the voltage $V_L$ has been applied during the previous scanning period is included in the anode lines to which the voltage $V_L$ is to be applied during a current scanning period in accordance with the pixel data (step S302). When the voltage $V_L$ has been applied to an anode line during the previous scanning period and is to be applied to the anode line during the current scanning period, all the EL elements connected to the anode line remain extinct during both the previous and current scanning periods. In connection with the determination, a determination may be made as to whether or not a drive switch which have been switched to the first stationary contact during the previous scanning period is included in the drive switches to be switched to the first stationary contact during the current scanning period.

If there is no anode line to which the voltage $V_L$ has been applied during either the previous scanning period and is to be applied during current scanning period, there is issued a reset signal for applying a voltage Vcc to all the positive lines $A_1$ to $A_m$ and all the cathode lines $B_1$ to $B_n$ (step S303). In contrast, if there is an anode line to which the voltage $V_L$ has been applied during the previous scanning period and is to be applied during the current scanning period, there is produced a reset signal for applying the voltage $V_L$ to the anode line and applying the voltage Vcc to the remaining positive lines and all the cathode lines $B_1$ to $B_n$ (step S304). The reset signal is supplied to the cathode line scanning circuit 313 and the anode line drive circuit 314.

In the case of the reset signal produced in step S303, the cathode line scanning circuit 313 switches movable contacts of all the scanning switches $\mathbf{316}_1$ to $\mathbf{316}_n$ to the stationary points of voltage Vcc in accordance with the reset signal. In accordance with the reset signal, the anode line drive circuit 314 switches the movable contacts of all the drive switches $\mathbf{318}_1$ to $\mathbf{318}_n$ to the third stationary contacts of voltage Vcc. As a result, the voltage developing across each EL element $E_{I,j}$ becomes equal to the voltage Vcc, thereby discharging the electric charges stored in the EL elements.

In the case of the reset signal produced in step S304, the cathode line scanning circuit 313 switches the movable contacts of all the scanning switches $\mathbf{316}_1$ to $\mathbf{316}_n$ to the stationary contacts of voltage Vcc in accordance with the reset signal. In the anode line drive circuit 314, drive switches corresponding to the anode lines—to which the voltage $V_L$ has been applied during the previous scanning period and is to be applied during the current scanning period—remain in contact with the first stationary contacts of voltage $V_L$. The drive switches corresponding to the remaining anode lines are switched to third stationary contacts of voltage Vcc. Provided that: there is an anode line $A_k$ ("k" corresponds to at least one numeral in the range of 1 through "m") to which the voltage $V_L$ has been applied during the previous scanning period and to which the voltage $V_L$ is to be applied during the current scanning period, a voltage developing across EL elements $E_{I,j}$ excluding the EL element $E_{k,j}$ becomes equal to the voltage Vcc. The electric charges stored in the EL elements are discharged. A voltage Vcc-$V_L$ is applied to the EL element $E_{k,j}$ in a reversely-biased manner.

The reset period may be constant or may vary in length in accordance with a scanning period T.

The control circuit 345 produces a scan selection control signal and c, drive control signal in accordance with pixel information represented by the pixel data, which data have been captured in step S301 and correspond to a single horizontal scanning period (step S305).

The scan selection control signal is delivered to the cathode line scanning circuit 313. The cathode line scanning circuit 313 switches, to ground, a scanning switch (a single scanning switch $\mathbf{316}_s$ in the range of $\mathbf{316}_1$ to $\mathbf{316}_n$, where "S" designates a numeral in the range of 1 to "n") assigned to one of the cathode lines $B_1$ to $B_n$, which cathode line corresponds to the current horizontal scanning period represented by the scan selection control signal.

The drive control signal is supplied to the anode line drive circuit 314. In the anode line drive circuit 314, a drive switch (any one of the drive switches $\mathbf{318}_1$ to $\mathbf{318}_m$) is switched to a second stationary contact connected to a current source (i.e., the corresponding one of the current sources $\mathbf{317}_1$ to $\mathbf{317}_m$) Here, the drive switch is assigned to one of the anode lines $A_1$ to $A_m$, _which anode line is connected to an EL element to be illuminated during the current horizontal scanning period represented by the drive control signal. Drive switches 318 assigned to the remaining anode lines A are switched to the first stationary contacts connected to voltage sources (corresponding ones of voltage sources $\mathbf{320}_1$ to $\mathbf{320}_m$).

For example, in a case where the drive switch $\mathbf{318}_1$ is switched to a current source $\mathbf{317}_1$, a drive current flows from the current source $\mathbf{317}_1$ to a drive switch $\mathbf{318}_1$, the anode line $A_1$, an EL element $E_{1,s}$, a cathode line $B_s$, a scanning switch $\mathbf{316}_s$, and ground. The EL element $E_{1,s}$ to which the drive current is supplied illuminates in accordance with the pixel data.

If the drive switch switched to the first contact is assigned $\mathbf{318}_3$, the voltage $V_L$ is applied to an anode line $A_3$ from a voltage source $\mathbf{320}_3$ by way of a drive switch. The voltage Vcc-$V_L$ is applied to EL elements $E_{3,1}$ to $E_{3,n}$ exclusive of an EL element $E_{3,s}$. The voltage $V_L$ lower than the illumination threshold voltage $V_{th}$ is forwardly applied to the EL element $E_{3,s}$, wherewith the EL elements $E_{3,1}$ to $E_{3,n}$ are charged with an applied voltage.

After having performed processing pertaining to step S305, the control circuit 345 determines whether or not a preset scanning period T has elapsed (step S306). The scanning period T is set in accordance with, for example, brightness information included in the pixel data and a preset horizontal scanning period. The scanning period is determined through use of an unillustrated internal counter.

If the scanning period T has elapsed, a drive stop signal is produced (step S307). If the scanning period T has elapsed, processing proceeds to step S307, where the control circuit 345 produces a drive stop signal, to thereby terminate the light-emission control routine. The control circuit 345 enters a stand-by state until the next horizontal scanning period begins. When the next horizontal scanning period begins, processing pertaining to steps S301 to S307 is repeated. FIG. 10 shows the relationship between a reset period and a scanning period T, which are required for the foregoing illumination and drive operations. The scanning period T shown in FIG. 10 designates a period starting from the end of the reset period to the start of the next horizontal scanning period. As mentioned above, if the scanning period T continues to the start of the next horizontal scanning period, steps S306 and S307 may be omitted.

Figure 22:
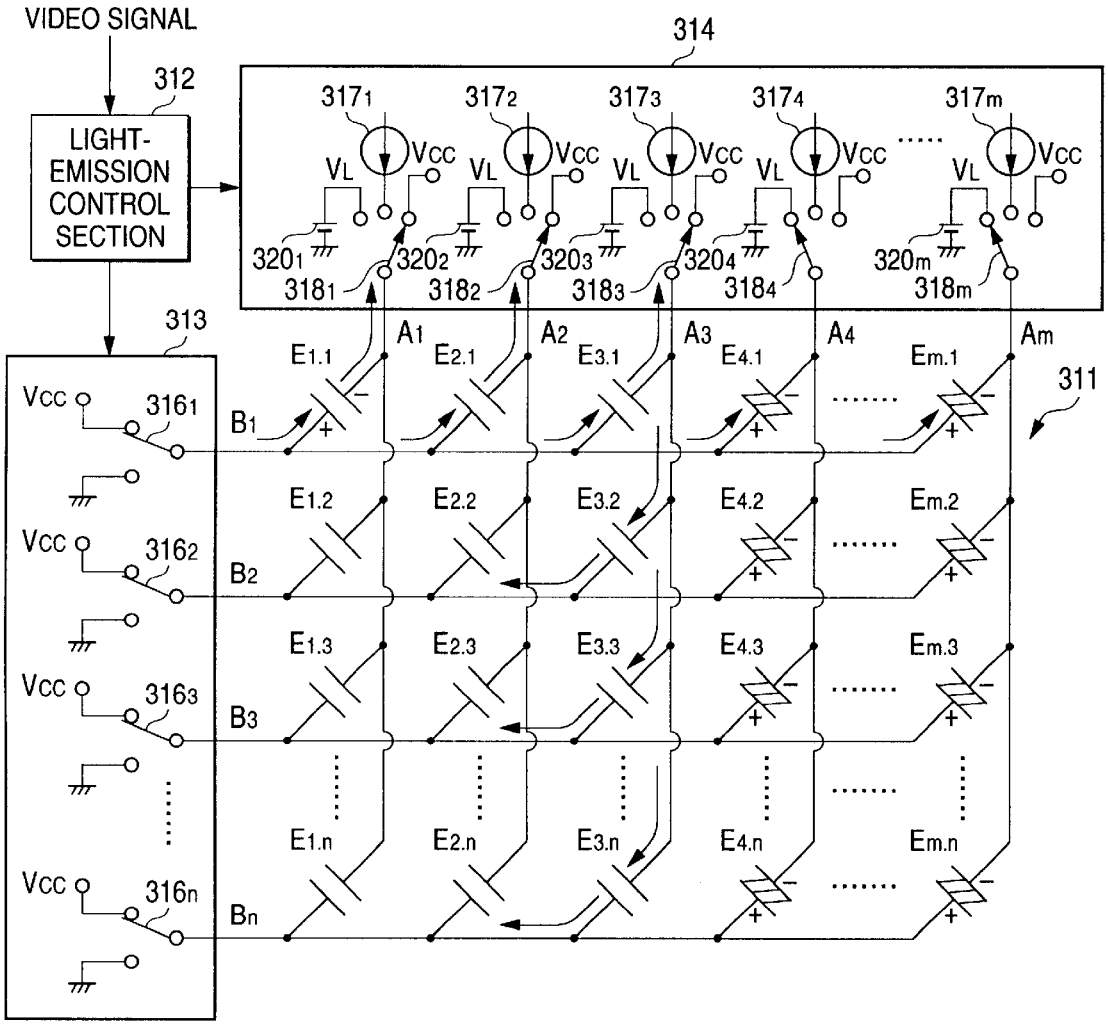
FIG. 22 is a block diagram for describing the illumination drive operation shown in FIG. 9.
Figure 23:
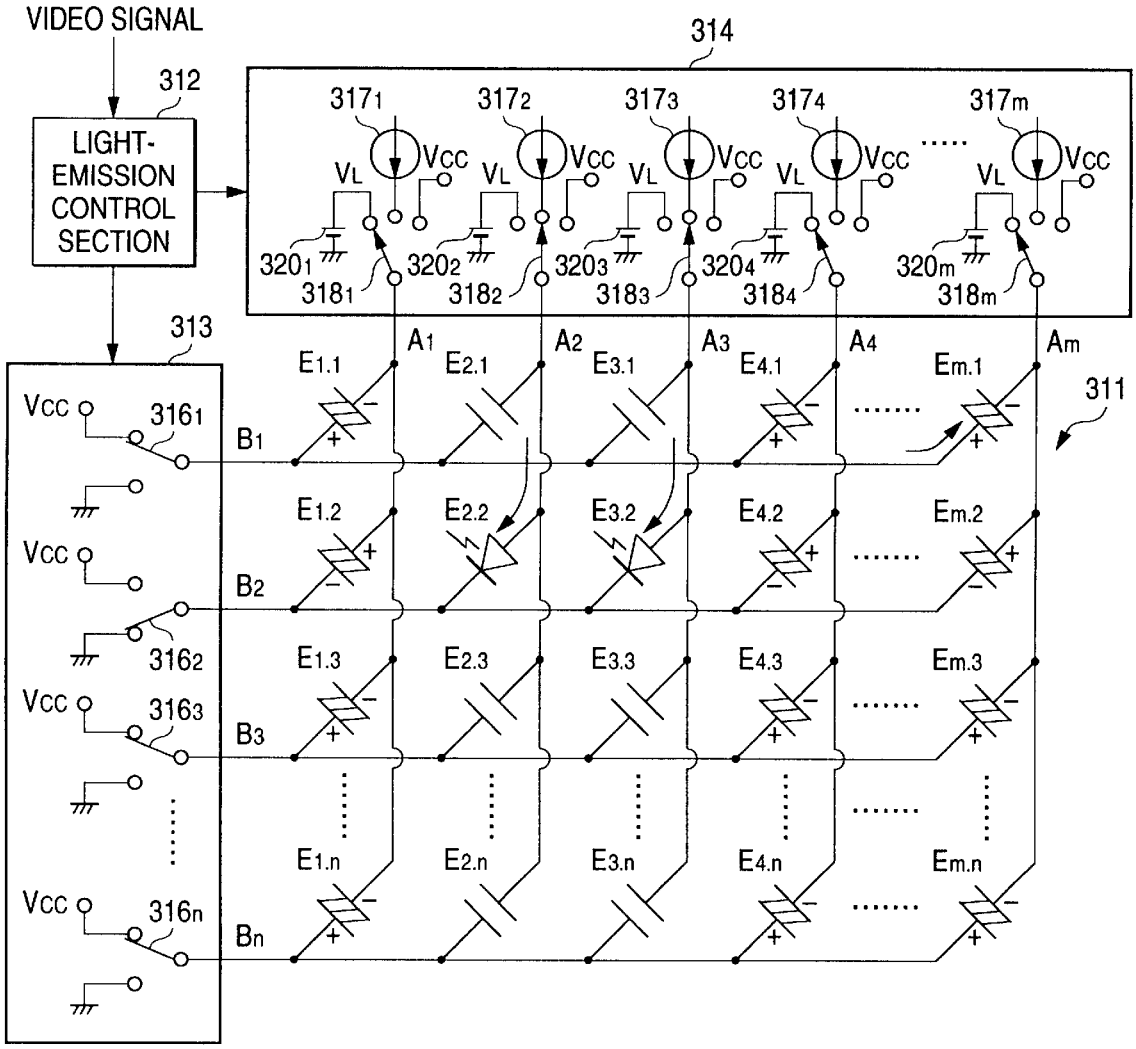
FIG. 23 is a block diagram for describing the illumination drive operation shown in FIG. 9.

By reference to FIGS. 21 through 23, next will be described a case where, after a cathode line $B_1$ has been scanned by means of the control operation of the control circuit 345, to thereby cause elements $E_{1,1}$ and $E_{2.1}$ to illuminate, a cathode line $B_2$ is scanned, to thereby cause elements $E_{2.2}$ and $E_{3.2}$ to illuminate. In order to facilitate explanations, illuminating EL elements shown in FIGS. 21 through 23 are depicted by diode symbols, and nonilluminating EL elements are depicted by capacitor symbols.

Figure 21:
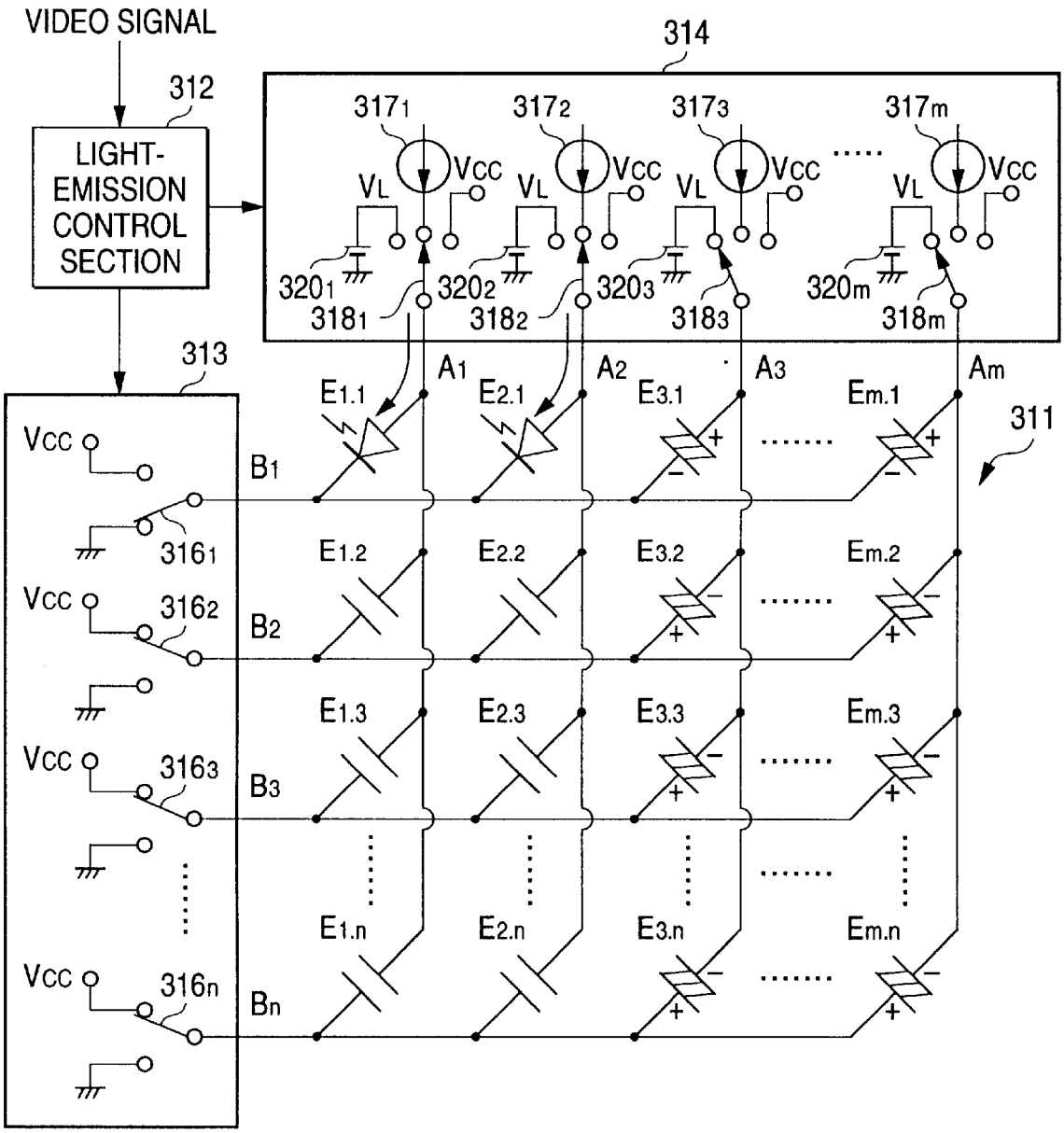
FIG. 21 is a block diagram for describing the illumination drive operation shown in FIG. 9.

In connection with FIG. 21, only a scanning switch $\mathbf{316}_1$ is switched to a ground potential of 0 volt, thereby scanning a cathode line $B_1$. A reverse bias voltage Vcc is applied to the remaining cathode lines $B_2$ to $B_n$ by way of corresponding scanning switches $\mathbf{316}_2$ to $\mathbf{316}_n$. Simultaneously, the anode line $A_1$ is connected to the current source $\mathbf{317}_1$ by way of the drive switch $\mathbf{318}_1$, and the anode line $A_2$ is connected to the current source $\mathbf{317}_2$ by way of the drive switch $\mathbf{318}_2$. The voltage $V_L$ is applied to the remaining anode lines $A_3$ to $A_m$ by way of the drive switches $\mathbf{318}_3$ to $\mathbf{318}_m$. In the circuit configuration shown in FIG. 21, only the EL elements $E_{1,1}$, and $E_{2,1}$ are forwardly biased, and a drive current flows into the EL elements $E_{1,1}$ and $E_{2,1}$ from the current sources $\mathbf{317}_1$ and $\mathbf{317}_2$, as designated by arrows. As a result, only the elements $E_{1,1}$ and $E_{2,1}$ are illuminated. In an illuminated state, a reverse bias voltage Vcc-$V_L$ is applied between the anode and cathode electrodes of each of nonilluminating and hatched EL elements $E_{3,2}$ to $E_{m,n}$. The EL elements $E_{3,2}$ to $E_{m,n}$ are charged with illustrated polarities, respectively. Since the voltage VCC-$V_L$ is sufficiently low, the electric charges stored in the EL element are smaller than those charged in an EL element of a known flat display panel. Although the voltage $V_L$ is forwardly applied between the anode and cathode electrodes of each of the hatched and nonilluminating EL elements $E_{3.1}$ to $E_{m.i}$, the voltage $V_L$ is lower than the illumination threshold voltage $V_{th}$, and hence the EL elements $E_{3.1}$ to $E_{m.i}$ remain unilluminated and are charged solely.

If the illuminated state of the EL elements shown in FIG. 21 have been effected for only the scanning period T, a reset control operation is performed before illumination of the EL elements $E_{2,2}$ and $E_{3,2}$ during the next horizontal scanning period. As shown in FIG. 22, the drive switches $\mathbf{318}_1$ to $\mathbf{318}_3$ and all the scanning switches $\mathbf{316}_1$ to $\mathbf{316}_n$ are switched to the potential Vcc. Accordingly, the positive lines $A_1$ to $A_3$ and the negative lines $B_1$ to $N_n$ are made equal to the potential Vcc. Through such a reset control operation, the electric charges stored in the respective EL elements $E_{1,1}$, to $E_{3,n}$ are discharged by way of the path designated by arrows in the drawing, wherewith the electric charges stored in all the EL elements become momentarily zero. Even during the current scanning period, no drive current for illumination purpose is supplied to the anode lines $A_4$ to $A_m$. Hence, the voltage $V_L$ is applied to the anode lines $A_4$ to $A_m$ by way of drive switches $\mathbf{318}_4$ to $\mathbf{318}_m$. Since the voltage Vcc-$V_L$ is applied to the EL elements $E_{4,1}$ to $E_{m,n}$ the electric charges which have been stored in the EL elements $E_{4,2}$ to $E_{m,n}$ during the scanning period shown in FIG. 21 are held as they are. The electric charges stored in the EL elements $E_{4,1}$ to $E_{m,1}$ are immediately discharged, and the EL elements $E_{4,1}$ to $E_{m,1}$ are charged with the applied voltage Vcc-$V_L$.

When the next horizontal scanning period beings after the electric charges stored in the EL elements $E_{1.1}$ to $E_{3,n}$ have been discharged to zero, only a scanning switch $\mathbf{316}_2$ corresponding to a cathode line $B_2$ is switched to ground potential, thus scanning the cathode line $B_2$. Simultaneously, the drive switches $\mathbf{318}_2$ and $\mathbf{318}_3$ are switched to the current sources $\mathbf{317}_2$ and $\mathbf{317}_3$, and the output terminals of the current sources $\mathbf{317}_2$ and $\mathbf{317}_3$ are connected to the corresponding anode lines $A_2$ and $A_3$. Further, the drive switch $\mathbf{318}_1$ is newly switched to the first stationary contact of potential $V_L$, and the voltage $V_L$ is supplied to the anode lines $A_1$ and $A_4$ through $A_m$. In connection with the circuit configuration shown in FIG. 23, only the EL elements $E_{2,2}$ and $E_{3,2}$ are forwardly biased, so that a drive current flows from current sources $\mathbf{317}_2$ and $\mathbf{317}_3$ to the EL elements $E_{2,2}$ and $E_{3,2}$, thereby causing only the elements $E_{2,2}$ and $E_{3,2}$ to illuminate. In such an illuminated state, the reverse bias voltage Vcc-$V_L$ is applied across the anode and cathode electrodes of each of hatched and nonilluminating EL elements $E_{1,1}$, $E_{1,3}$ to $E_{1,n}$, $E_{4,1}$ to $E_{m,1}$ and $E_{4,3}$ to $E_{m,n}$. The EL elements El, and $E_{1,3}$ to $E_1$, are newly charged with polarities, as illustrated. Since the electric charges are held in the EL elements $E_{,3}$ to $E_{m,n}$ charging or discharging barely arises in the EL elements $E_{4,3}$ to $E_{m,n}$ even when the voltage VCC-$V_L$ is applied to the EL elements $E_{4,3}$ to $E_{m,n}$.

As mentioned above, the reverse bias voltage VCC-$V_L$ applied to the nonilluminating EL elements during the scanning period is lower than that employed in the known display panel. The electric charges which are charged by the reverse bias voltage Vcc-$V_L$ and do not contribute to illumination are diminished as compared with those which arise in the conventional display panel. In connection with anode lines (non-reset drive lines) to which the voltage $V_L$ has been applied during the previous scanning period and the voltage $V_L$ is to be applied during the current scanning period, none of the EL elements are connected to the non-reset drive line illuminate during the previous and current scanning periods. The electric charges charged with the reverse bias voltage VCC-$V_L$ are held without being discharged during the current reset period. Therefore, in the foregoing example, the total of electric charge charged with the reverse bias voltage Vcc-$V_L$ during the current scanning period can be diminished by the amount of electric charge corresponding to that stored in the EL elements $E_{4,3}$ to $E_{m,1}$.

Figure 24:
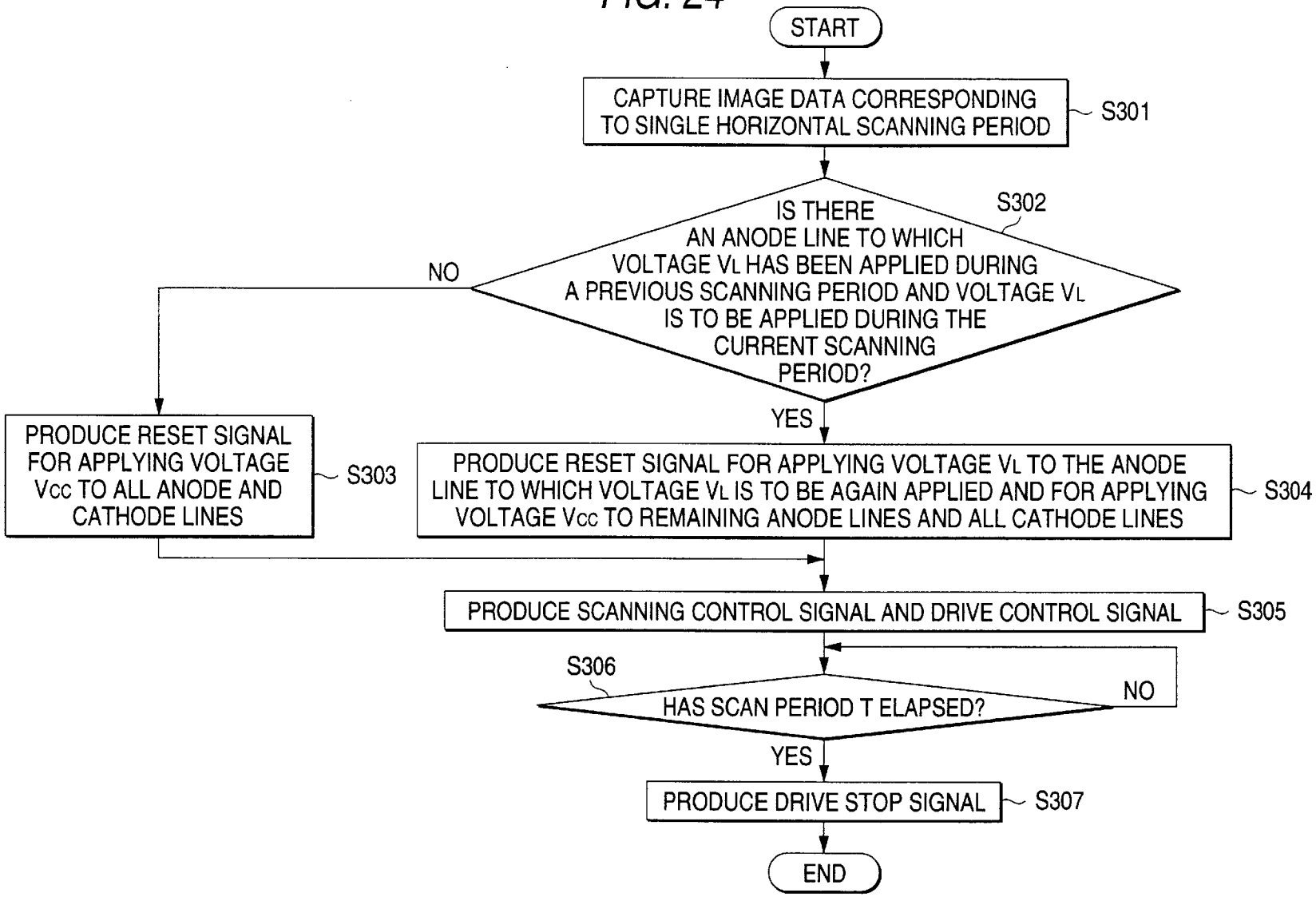
FIG. 24 is a flowchart for describing another example of illumination drive operation performed by a light-emission control circuit.

In the foregoing embodiment, in step S302 a determination is made as to whether or not an anode line (non-reset drive line) to which the voltage $V_L$ has been applied during the previous scanning period is included in the anode lines to which the voltage $V_L$ is to be applied during the current scanning period. However, as shown in FIG. 24, in step S302 a determination may be made as to whether or not there is an anode line (non-reset drive line) to which the voltage $V_L$ is to be applied during the current scanning period. If there is not any anode line to which the voltage $V_L$ is to be applied during the current scanning period, processing proceeds to step S303. In contrast, if there is an anode line to which the voltage $V_L$ is to be applied during the current scanning period, processing proceeds to step S304.

Figure 25:
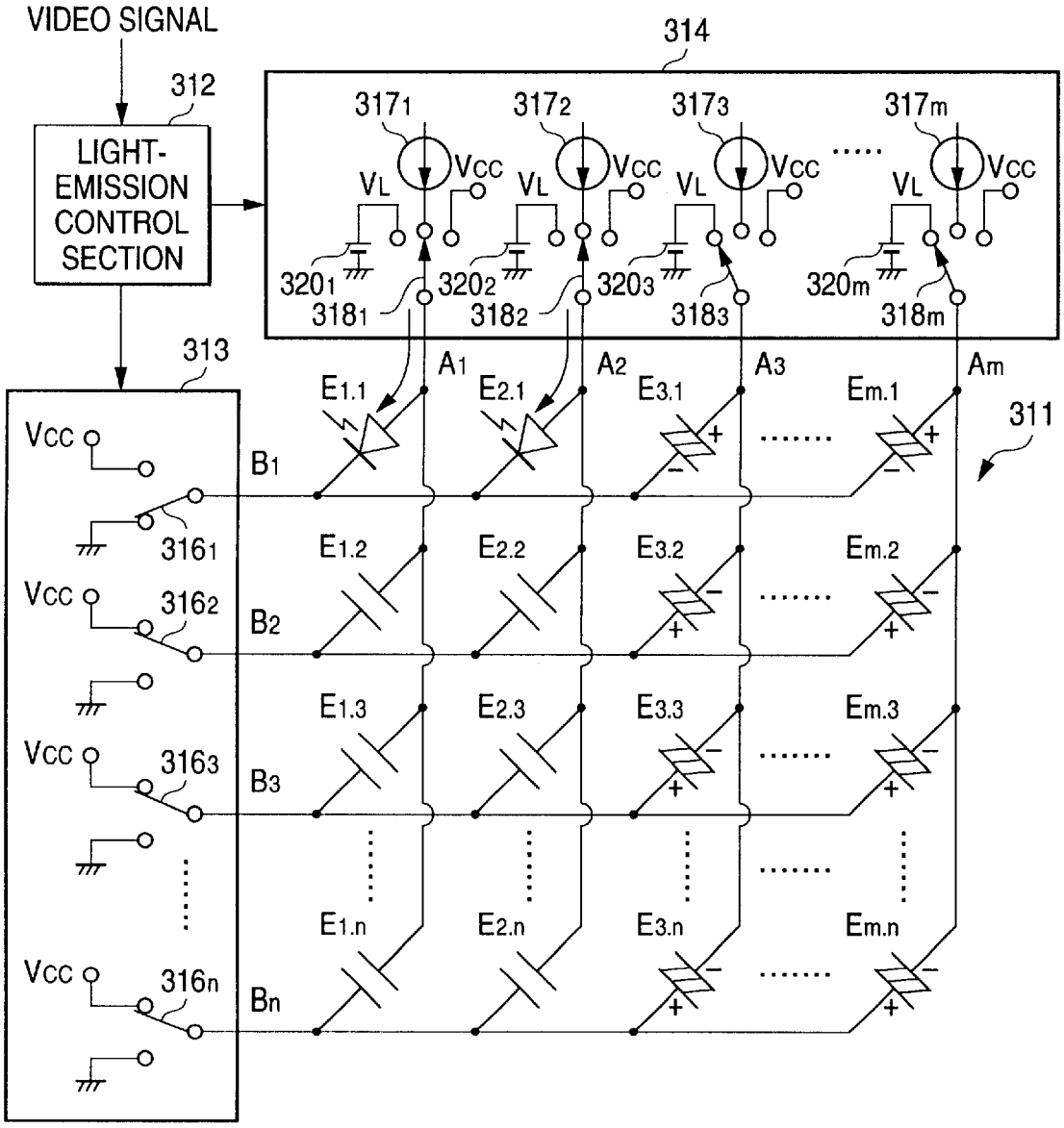
FIG. 25 is a block diagram for describing the illumination drive operation shown in FIG. 24.
Figure 26:
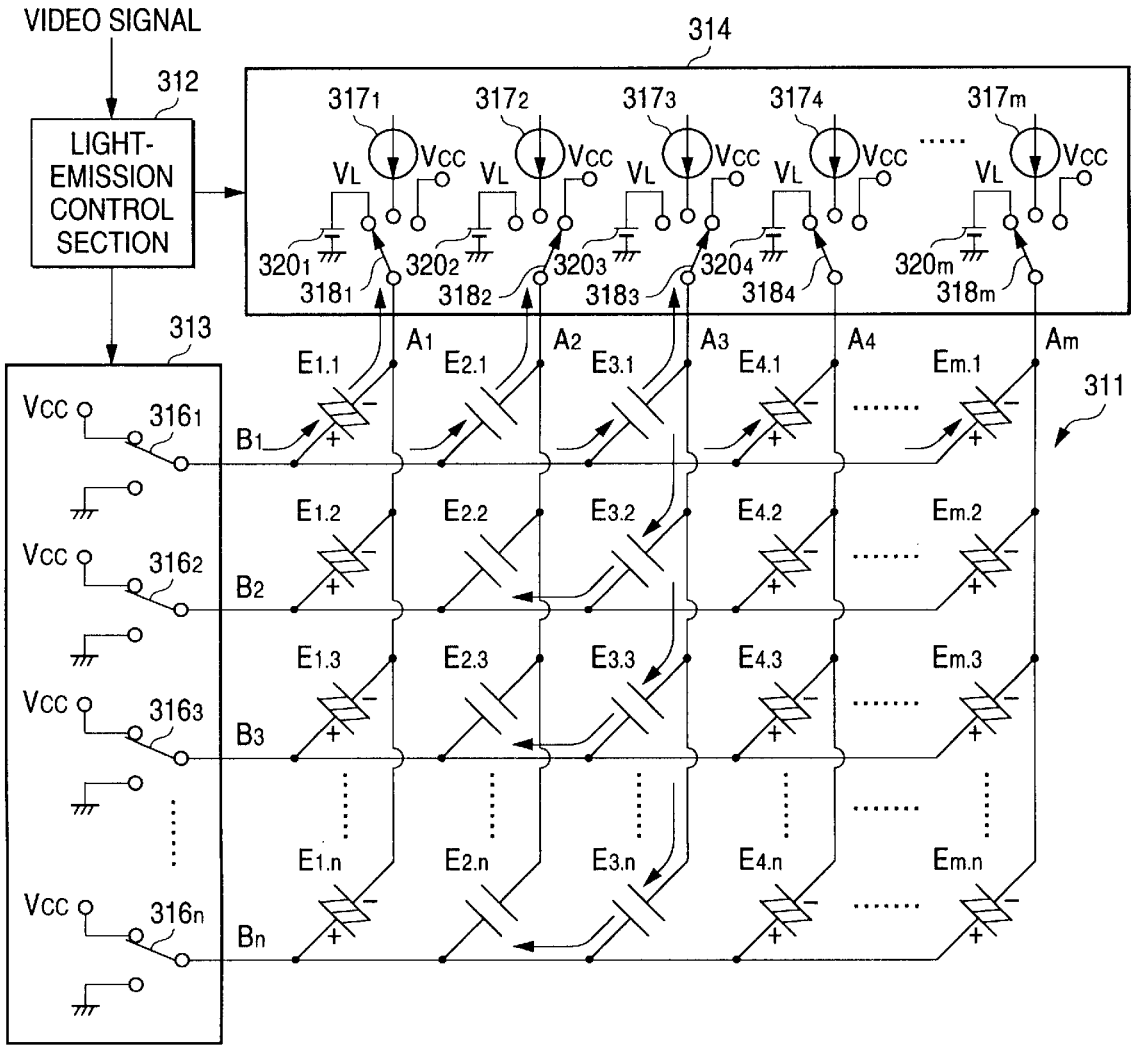
FIG. 26 is a block diagram for describing the illumination drive operation shown in FIG. 24.
Figure 27:
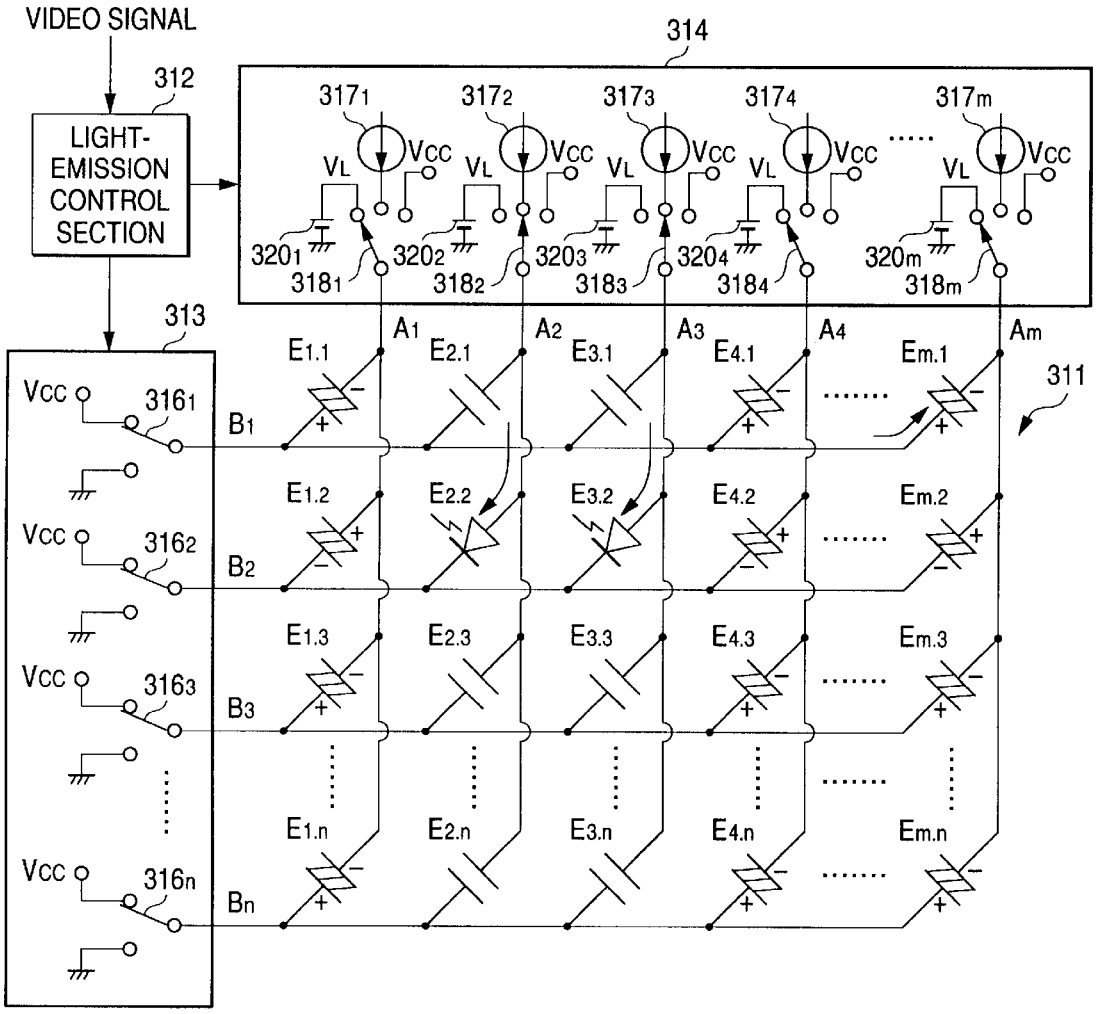
FIG. 27 is a block diagram for describing the illumination drive operation shown in FIG. 24.

FIGS. 25 through 27 show an operating state of a display panel in which, after the cathode line $B_1$ has been scanned through the control operation shown in FIG. 24, to thereby cause elements $E_{1,1}$ and $E_{2,1}$ to illuminate, the cathode line $B_2$ is scanned so as to cause elements $E_{2,2}$ and $E_{3,2}$ to illuminate. FIG. 25 shows a scanning period during which the EL elements $E_{1,1}$, and $E_{2,1}$ are illuminated, as in the case of that shown in FIG. 21.

If the illuminating state of the EL elements shown in FIG. 25 has been effected only for the scanning period T, a reset control operation is performed before the next cathode line is scanned for causing the EL elements $E_{2,2}$ and $E_{3,2}$ to illuminate during the next horizontal scanning period. As shown in FIG. 26, the drive switches $\mathbf{318}_2$ and $\mathbf{318}_3$ and all the scanning switches $\mathbf{316}_1$ to $\mathbf{316}_n$ are switched to the voltage Vcc, and hence the voltages of the anode lines $A_2$ and $A_3$ and the voltages of the cathode lines $B_1$ to $B_n$ are made equal to the voltage Vcc. By means of such a reset control operation, the electric charges stored in the respective EL elements $E_{2,1}$ to $E_{2,n}$ and $E_{3,1}$ to $E_{3,n}$ are discharged by way of the path designated by arrows shown in the drawing, wherewith the electric charges stored in all the EL elements become momentarily zero. Even during the current scanning period, a drive current for illumination purpose is not supplied to the anode lines $A_1$ and $A_4$ to $A_m$. The voltage $V_L$ is applied to the anode lines $A_1$ and $A_4$ to $A_m$ by way of the drive switches $\mathbf{318}_1$ and $\mathbf{318}_4$ to $\mathbf{318}_m$. As a result, the voltage VCC-$V_L$ is applied to the EL elements $E_{1,1}$ to $E_{1,n}$ and $E_{4,1}$ to $E_{m,n}$. The electric charges stored in the EL elements $E_{4,2}$ to $E_{m,1}$ during the scanning period shown in FIG. 21 are held as they are. The electric charges which have been stored in the EL elements $E_{1,1}$ and $E_{4,1}$ to $E_{m,1}$ thus far are discharged immediately, and the EL elements $E_{1,1}$, and $E_{4,1}$ are charged with the applied voltage Vcc-$V_L$.

When the next horizontal scanning period beings after the electric charges stored in the EL elements $E_{2,1}$ to $E_{3,n}$ have been discharged to zero in the manner as mentioned above, only the scanning switch $\mathbf{316}_2$ assigned to the cathode line $B_2$ is switched to ground potential, whereby the cathode line $B_2$ is scanned. Simultaneously, the drive switch $\mathbf{318}_2$ is switched to the current source $\mathbf{317}_2$, and the drive switch $\mathbf{318}_3$ is switched to the current source $\mathbf{317}_3$, as in the case shown in FIG. 23. Only the EL elements $E_{2,2}$ and $E_{3,2}$ are forwardly biased, and a drive current flows into the EL elements $E_{2,2}$ and $E_{3,2}$ from the current sources $\mathbf{317}_2$ and $\mathbf{317}_3$, as indicated by arrows, thereby causing only the EL elements $E_{2,2}$ and $E_{3,2}$ to illuminate, as in the case shown in FIG. 23. In the illuminated state of these EL elements, a reverse bias voltage Vcc-$V_L$ is applied between the anode and cathode electrodes of each of hatched and nonilluminating EL elements $E_{1,1}$, $E_{1,3}$ to $E_{1,n}$, $E_{4,1}$ to $E_{m,1}$ and $E_{4,3}$ to $E_{m,n}$. Since the electric charges are held in the EL elements $E_{1,1}$, $E_{1,3}$ to $E_{1,n}$ and $E_{4,3}$ to $E_{m,n}$, charging or discharge barely arises in the L elements even when the voltage Vcc-$V_L$ is applied to the EL elements.

In the previous embodiment, the first potential is made equal to ground potential, and the second and fourth potentials are set to a potential Vcc which is substantially equal to the specified illumination voltage Ve of a capacitive luminescent element. However, the present invention is not limited to such an embodiment.

Further, an embodiment of the present invention will be described hereinbelow in detail by reference to the accompanying drawings.

Figure 28:
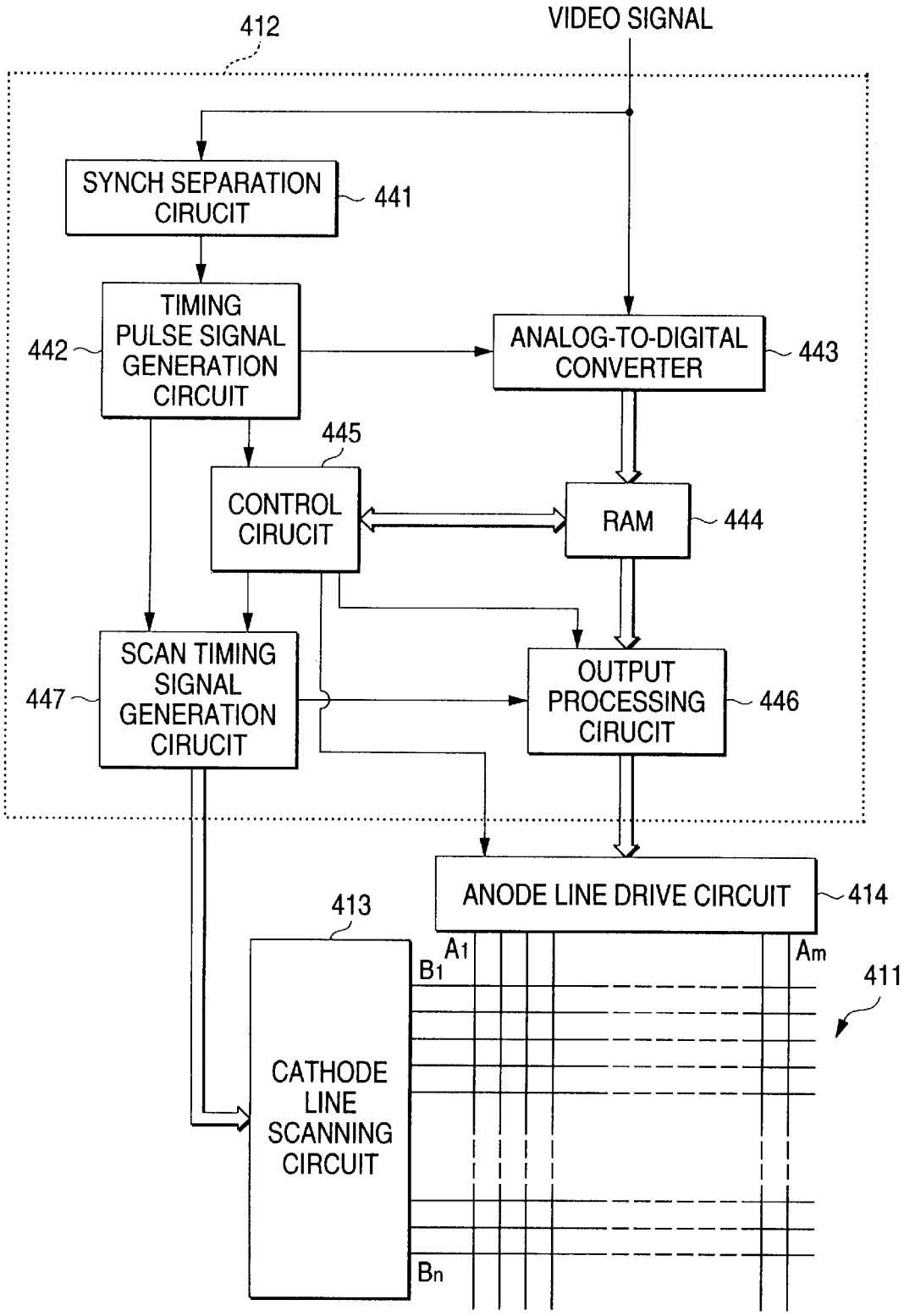
FIG. 28 is a block diagram showing the configuration of a luminescent display panel drive unit according to the present invention.

FIG. 28 schematically shows the configuration of a display which is embodied by application of the present invention to a luminescent display panel using EL elements as capacitive luminescent elements. The display comprises a capacitive luminescent display panel 411; a light-emission control section 412; a cathode line scanning circuit 413; and an anode drive circuit 414.

Figure 29:
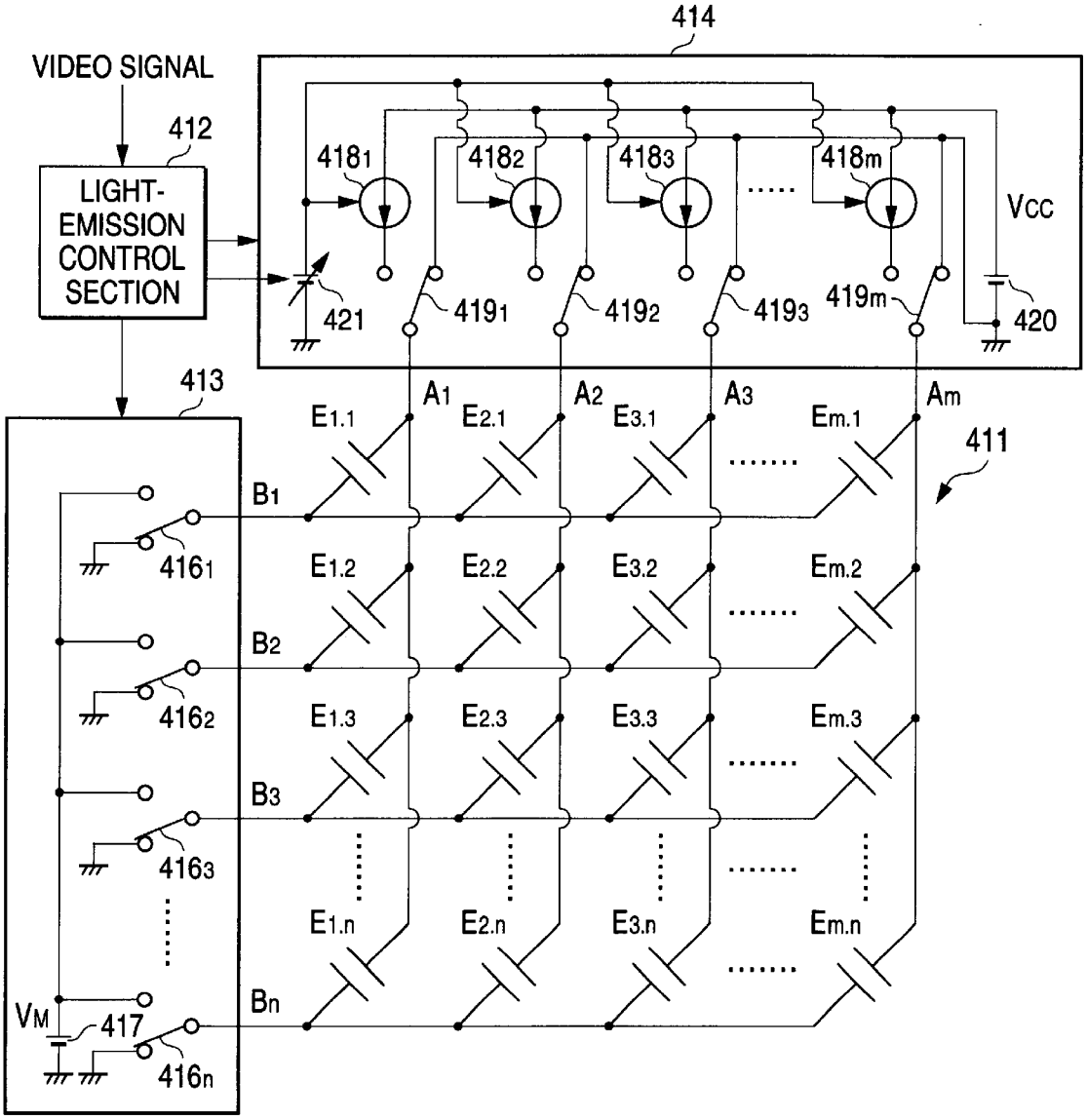
FIG. 29 is a block diagram specifically showing a luminescent display panel, a cathode line scanning circuit, and an anode line drive circuit of the drive unit shown in FIG. 7.

As shown in FIG. 29, the luminescent display panel 411 comprises a plurality of EL elements $E_{I,j}$ ($1 \leqq i \leqq m$, $1 \leqq j \leqq n$). As in the case of the EL elements shown in FIGS. 4 through 6, the plurality of EL elements are arranged in a matrix pattern at respective intersections between anode lines $A_1$ to $A_m$ serving as drive lines and cathode lines $B_1$ to $B_n$ serving as scanning lines. The EL elements are connected to the scanning lines and the drive lines. In other words, the EL elements are located at respective intersections between a plurality of drive lines extending substantially in parallel with each other and a plurality of scanning lines extending substantially at right angles to the drive lines. Each of the EL elements is connected to one of the scanning lines and one of the drive lines. The EL elements $E_{I,j}$ shown in FIG. 29 are depicted by capacitor symbols.

In the luminescent display panel 411, the cathode lines $B_1$ to $B_n$ are connected to the cathode line scanning circuit 413, and the anode lines $A_1$ to $A_m$ are connected to the anode line drive circuit 414. The cathode line scanning circuit 413 has a scanning switches $\mathbf{416}_1$ to $\mathbf{416}_n$ assigned to the respective cathode lines $B_1$ to $B_n$, and a voltage source 417. Each of the scanning switches $\mathbf{416}_1$ to $\mathbf{416}_n$ corresponds to a changeover switch having two stationary contacts. One of the stationary contacts is rounded, and movable contacts of the scanning switches $\mathbf{416}_1$ to $\mathbf{416}_n$ are connected to the respective cathode lines $B_1$ to $B_n$. The voltage source 417 produces a voltage $V_M$ for producing a reverse bias voltage $V_M$. The positive terminal of the voltage source 417 is connected to the remaining stationary contact of each of the scanning switches $\mathbf{416}_1$ to $\mathbf{416}_n$. The negative terminal of the voltage source 417 is grounded. Each of the scanning switches $\mathbf{416}_1$ to $\mathbf{416}_n$ supplies to a corresponding one of the cathode lines $B_1$ to $B_n$ ground potential or a reverse bias voltage $V_M$, which is the positive potential of the voltage source 417. Under control of the light-emission control section 412, the scanning switches $\mathbf{416}_1$ to $\mathbf{416}_n$ are switched to ground potential, in scanning sequence, during each horizontal scanning period. The cathode lines $B_n$ to $B_n$ set to ground potential act as scanning lines which enable illumination of EL elements connected to the cathode lines $B_n$ to $B_n$.

The anode line drive circuit 414 has variable current sources $\mathbf{418}_1$ to $\mathbf{418}_m$, drive switches $\mathbf{419}_1$ to $\mathbf{419}_m$, a voltage source 420, and a variable voltage source 421, the variable current sources and the drive switches being provided so as to correspond to the anode lines $A_1$ to $A_m$. The voltage source 420 produces a voltage Vcc, and the positive terminal of the voltage source 420 is connected to the input terminals of the current sources $\mathbf{418}_1$ to $\mathbf{418}_m$. The negative terminal of the voltage source 420 is grounded. Each of the drive switches $\mathbf{419}_1$ to $\mathbf{419}_m$ corresponds to a changeover switch having two stationary contacts. Movable contacts of the drive switches $\mathbf{419}_1$ to $\mathbf{419}_m$ are connected to the respective anode lines $A_1$ to $A_m$. One of the two stationary contacts belonging to each of the drive switches $\mathbf{419}_1$ to $\mathbf{419}_m$ is grounded, and the remaining contact is connected to an output terminal of the corresponding one of the current sources $\mathbf{418}_1$ to $\mathbf{418}_m$. The positive terminal of the variable voltage source 421 is connected to the current control terminal of each of the current sources $\mathbf{418}_1$ to $\mathbf{418}_m$. The negative terminal of the variable voltage source 421 is grounded. The voltage output from the variable voltage source 421 is controlled by the light-emission control section 412.

The light-emission control section 412 controls the cathode line scanning circuit 413 and the anode line drive circuit 414, so as to cause the luminescent display panel 411 to display an image in accordance with a video signal supplied from an unillustrated video signal generation system. Such a control operation is performed while being divided into a reset period and a scanning period.

The light-emission control section 412 produces a reset signal during a reset period, and the thus-produced reset signal is delivered to the cathode line scanning circuit 413 and the anode line drive circuit 414. The cathode line scanning circuit 413 performs a control operation for switching the scanning switches $\mathbf{416}_1$ to $\mathbf{416}_n$ such that a reverse bias voltage $V_M$ is applied to all the cathode lines $B_1$ to $B_n$ in accordance with the reset signal. The anode line drive circuit 414 performs a control operation for switching the drive switches $\mathbf{419}_1$ to $\mathbf{419}_n$ such that ground potential is applied to the anode lines $A_1$ to $A_n$ in accordance with the reset signal.

The light-emission control section 412 sends a scanning line selection control signal to the cathode line scanning circuit 413 during the scanning period. The scanning switches $\mathbf{416}_1$ to $\mathbf{416}_n$ are switched such that any cathode line corresponding to the horizontal scanning period of the video signal is selected from the cathode lines $B_1$ to $B_n$, and the thus-selected cathode line is set to ground potential, and such that the reverse bias voltage $V_M$ is applied to the remaining cathode lines The reverse bias voltage $V_M$ is applied from the constant-voltage source 417 connected to the cathode line, in order to prevent illumination of EL elements connected to intersections between the anode line through which a drive current is flowing and cathode lines which are not selected for scanning, which would otherwise be caused by crosstalk. During each horizontal scanning period, the scanning switches $\mathbf{416}_1$ to $\mathbf{416}_n$ are sequentially switched to ground potential. The cathode lines $B_1$ to $B_n$ set to ground potential act as scanning lines which Enable illumination of EL elements connected to the cathode lines $B_1$ to $B_n$.

The light-emission control section 412 produces a drive control signal indicating that one from the EL elements connected to a scanning line is to be illuminated, at any timing and for any period of time, in accordance with pixel information represented by a video signal during a scanning period. The thus-produced drive control signal is delivered to the anode line drive circuit 414. In response to the drive control signal, the anode line drive circuit 414 switches, to the current source side, any one of the drive switches $\mathbf{419}_1$ to $\mathbf{419}_m$ assigned to the anode line connected to the EL elements to be illuminated. By way of the corresponding one of the anode lines $A_1$ to $A_m$, a drive current corresponding to the pixel information is supplied to the EL elements. The remaining drive switches 419 are switched to grounded contacts, and ground potential is supplied to the remaining drive switches 419.

The internal circuit of the light-emission control section 412 is configured as shown in FIG. 28. As shown in FIG. 28, a synch separation circuit 441 extracts horizontal and vertical synch signals from a supplied input video signal. The thus-extracted horizontal and vertical synch signals are supplied to a timing pulse signal generation circuit 442. On the basis of the thus-extracted horizontal and vertical synch signals, the timing pulse signal generation circuit 442 produces a synch signal timing pulse signal. The thus-produced synch signal timing pulse signal is supplied to an analog-to-digital converter 443, a control circuit 445, and a scan timing signal generation circuit 447. The analog-to-digital converter 443 converts an input video signal into digital pixel data on a per-pixel basis, in synchronism with the synch signal timing pulse signal. The input video signal is supplied to memory 444. The memory 444 has at least a storage area for storing pixel data corresponding to one screen of the luminescent display panel 411. The control circuit 445 supplies a write signal and a read signal, which are synchronized with the synch signal timing pulse signal, to the memory 444. In response to the write signal, the memory 444 sequentially captures the pixel data supplied from the analog-to-digital converter 443. Further, in response to the read signal, the memory 444 sequentially reads pixel data stored therein and supplies the thus-read pixel data to an output processing circuit 446 provided in a subsequent stage. The scan timing signal generation circuit 447 produces various timing signals for controlling a scanning switch and a drive switch and delivers the thus-produced signals to the cathode line scanning circuit 413 and the output processing circuit 446. As a result, the scan timing signal generation circuit 447 supplies a scan selection control signal to the cathode line scanning circuit 413. In synchronism with a timing signal output from the scan timing signal generation circuit 447, the output processing circuit 446 supplies, to the anode line drive circuit 414, a drive control signal corresponding to the pixel data supplied from the memory 444. During a reset period, the control circuit 445 supplies a reset signal to the anode line drive circuit 414 by way of the output processing circuit 446, as well as to the cathode line scanning circuit 413 by way of the scan timing signal generation circuit 447.

Figure 30:
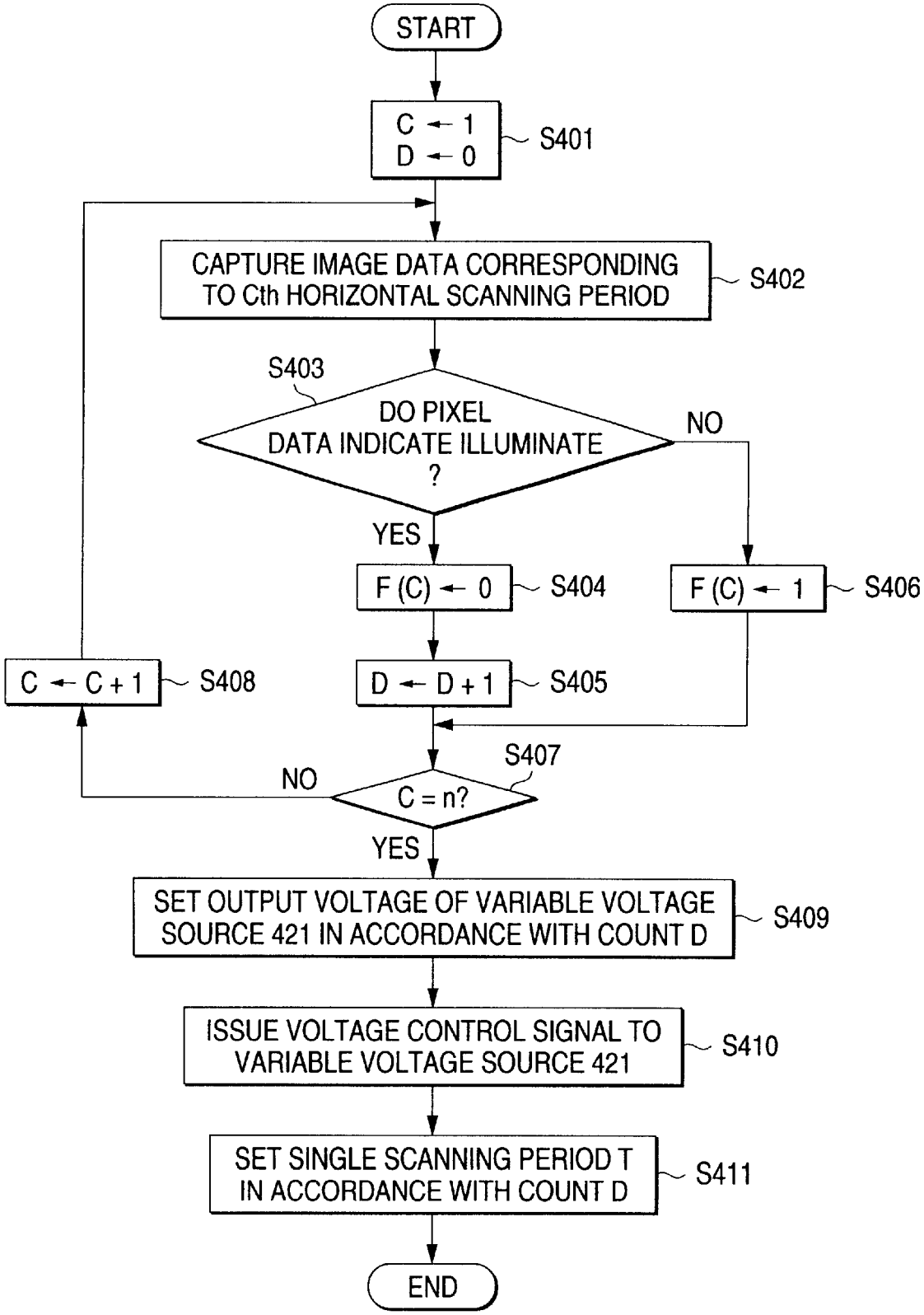
FIG. 30 is a flowchart for describing a light-emission determination operation performed by a control circuit.
Figure 31:
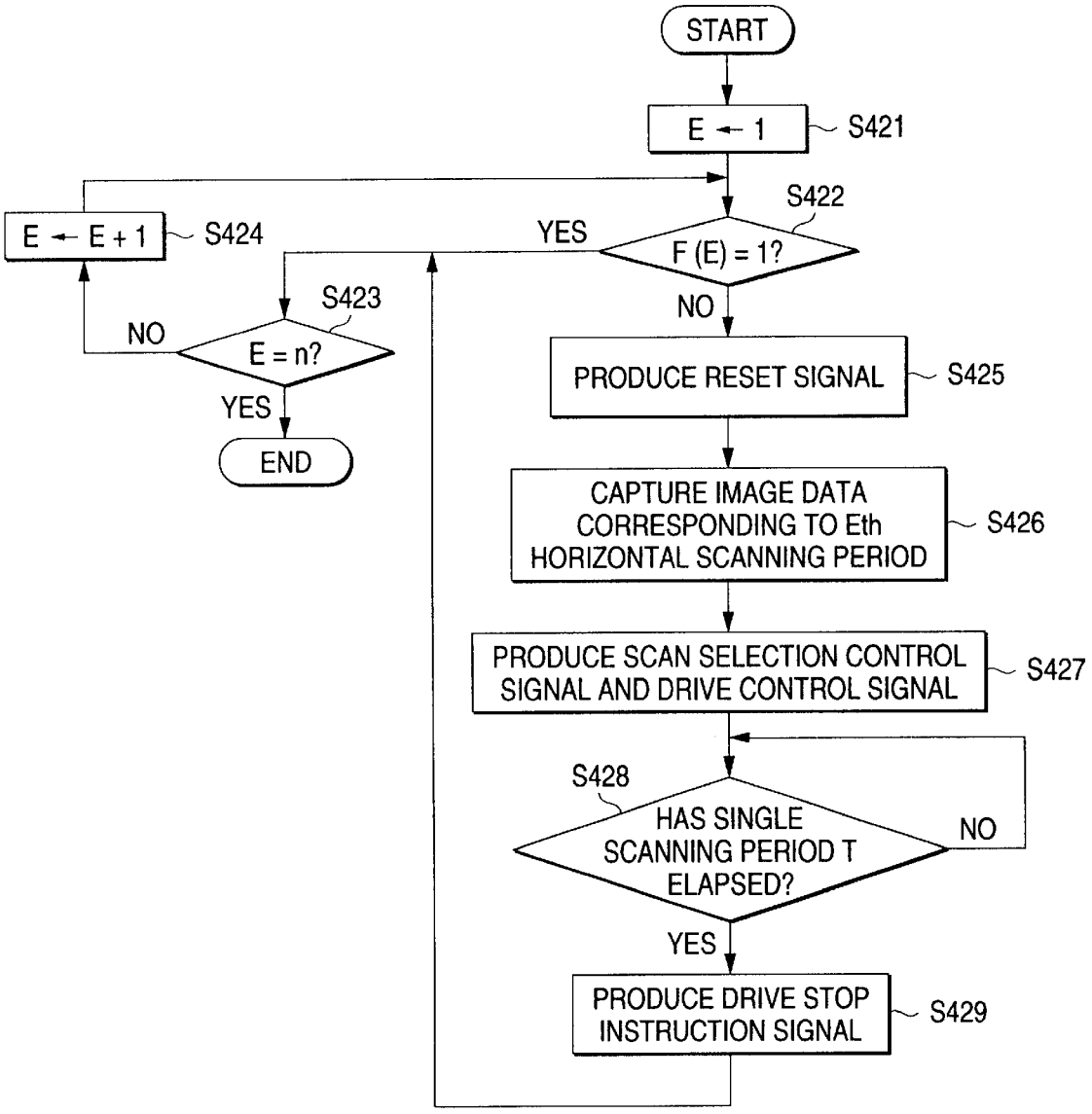
FIG. 31 is a flowchart for describing a light-emission drive operation performed by a control circuit.

The drive operation of the capacitive luminescent display panel performed by the control circuit 445 of the light-emission control section 412 will now be described by reference to flowcharts shown in FIGS. 30 and 31.

During each vertical scanning period of supplied pixel data (i.e., a period of a single frame), the control circuit 445 executes a light-emission determination routine. As shown in FIG. 30, during the light-emission determination routine, the control circuit 445 sets count C to a value of 1 and count D to a value of 0 (step S401). Count C designates a numeral determined by means of counting up in the sequence in which a single screen is scanned, and count D represents the number of scanning lines. Pixel data corresponding to a $C^{th}$ horizontal scanning period are captured from the memory 444 in the order of scanning (step S402). Since the pixel data corresponding to a single screen are stored in the memory 444 by means of the write signal, the control circuit 445 captures the pixel data corresponding to one horizontal scanning period, in the order of scanning. The control circuit 445 determines whether or not pixel data indicating illumination are included in the pixel data corresponding to the $C^{th}$ horizontal scanning period (step S403). If the pixel data indicating illumination are included, the $C^{th}$ cathode line Bc is considered to be a real scanning line. Therefore, a scanned/unscanned flag F(C) is set to a value of 0, which value indicates that scanning is effected (step S404). Count D is incremented by only one (step S405). In contrast, if the pixel data indicating illumination are not included, the scanned/unscanned flag F(C) is set to a value of 1, which value indicates that scanning is not effected (step S406). Count D is left, as is. The scanned/unscanned flag F(C), count C, and count D are preserved in memory (not shown) provided in the control circuit 404. Scanned/unscanned flags are formed as F(1), F(2), F(3), . . . , F(n).

After processing pertaining to step S405 or S406 has been performed, a determination is made as to whether or not count C has reached the number of cathode lines (n) (step S407). If C<n, count C is incremented by only one (step S408), and processing returns to step S2. In contrast, if C=n, the voltage output from the variable voltage source 421 is set in accordance with count D (step S409). There is output a voltage control signal for adjusting the voltage output from the variable voltage source 421 to the thus-set voltage (step S410). When count C assumes "n," count D represents the number of scanning lines of the current frame. In step S409, there is adjusted the voltage output from the variable voltage source 421 for setting the Electric current output from the current sources $\mathbf{418}_1$ to $\mathbf{418}_m$ corresponding to the number of scanning lines. The relationship between count D and the voltage output from the variable voltage source 421 is stored in the internal memory of the control circuit 445 in the form of a data table. Through use of the data table, the output voltage of the variable voltage source 421 is set so as to correspond to count D. The greater the value of count D, the higher the output voltage of the variable voltage source 421, thereby increasing the current output from the current sources $\mathbf{418}_1$ to $\mathbf{418}_m$.

After the processing pertaining to step S410 has been performed, a single scanning period T is set in accordance with count D (step S411). Provided that the period of a frame is constant, as count D becomes smaller, a single scanning period T is set to become longer. Since the relationship between count D and the single scanning period T has been stored beforehand in the internal memory of the control circuit 445 in the form of a data table, a single scanning period T corresponding to count D is set through use of the data table.

After having executed the light-emission determination routine, the control circuit 445 repeatedly executes a light-emission control routine. As shown in FIG. 31, during the light-emission control routine, the control circuit 445 sets count E to a value of 1 in the manner as shown in FIG. 31 (step S421) and determines whether or not a scanned/unscanned flag F(E) assumes a value of 1 (step S422) As the scanned/unscanned flag F(E), the flag used in step S404 or S406 of the light-emission determination routine is used. If F(E)=1, the cathode line is not scanned. A determination is made as to whether or not count E has reached the number of cathode Lines (n) (step S423). If E<n, count E is incremented by only one (step S424), and processing returns to step S422. In contrast, if E=n, the routine is terminated.

If in step S422 it is determined that F(E)=0, there is produced a reset signal for applying ground potential to all the anode lines $A_1$ to $A_m$ and the cathode lines $B_1$ to $B_n$ (step S425). As a result of production of the reset signal, a reset period R of predetermined duration is produced. The reset signal is supplied to the cathode line scanning circuit 413 and the anode line drive circuit 414. In response to the reset signal, the cathode line scanning circuit 413 switches the movable contacts of all the scanning switches $\mathbf{416}_1$ to $\mathbf{416}_n$ to grounded stationary contacts. In response to the reset signal, the anode line drive circuit 414 switches the movable contacts of all the drive switches $\mathbf{419}_1$ to $\mathbf{419}_n$ to grounded stationary contacts. As a result, the voltage developing across each of the EL elements $E_{i,j}$ becomes equal to ground potential, and the electric charge stored in the EL elements is discharged.

After the end of the reset period R, the control circuit 445 captures pixel data corresponding to the $E^{th}$ horizontal scanning period from the memory 444 (step S426). In accordance with the pixel information represented by the thus-captured pixel data, the control circuit 445 produces a scan selection control signal and a drive control signal (step S427).

The scan selection control signal is supplied to the cathode line scanning circuit 413. The cathode line scanning circuit 413 switches to ground the scanning switch (a scanning switch $\mathbf{416}_E$ of the scanning switches $\mathbf{416}_1$ to $\mathbf{416}_n$) assigned to a cathode line B (one of the cathode lines $B_1$ to $B_n$) corresponding to the current: horizontal scanning period represented by the scan selection control signal. The cathode line scanning circuit 413 switches to the voltage source 417 the scanning switches (all the scanning switches $\mathbf{416}_1$ to $\mathbf{416}_n$ exclusive of the scanning switch $\mathbf{416}_E$) for applying the reverse bias voltage $V_M$ to the remaining cathode lines.

The drive control signal is supplied to the anode line drive circuit 414. In the anode line drive circuit 414, a drive switch (any one of the drive switches $\mathbf{419}_1$ to $\mathbf{419}_m$) is switched to the stationary contact connected to a current source (i.e., the corresponding one of the current sources $\mathbf{418}_1$ to $\mathbf{418}_m$) Here, the drive switch is assigned to the one of the anode lines $A_1$ to $A_m$ that is connected to an EL element to be illuminated during the current horizontal scanning period represented by the drive control signal. Drive switches 418 assigned to the remaining anode lines are switched to grounded stationary contacts.

For example, in a case where the drive switch $\mathbf{419}_1$ is switched to a current source $\mathbf{418}_1$, a drive current flows from the current source $\mathbf{418}_1$ to a drive switch $\mathbf{419}_1$, the anode line $A_1$, an EL element $E_{1,s}$ a cathode line $B_S$, a scanning switch $\mathbf{416}_s$, and to ground. Since the electric current flowing through the EL element is proportional to illumination brightness, the EL element $E_{1,s}$ to which the drive current is supplied illuminates in accordance with the pixel information.

After having performed processing pertaining to step S427, the control circuit 445 determines whether or not the single scanning period T has elapsed (step S428). The scanning period T is set in accordance with, for example, brightness information included in the pixel data and a preset horizontal scanning period. The scanning period is determined through use of an unillustrated internal counter.

If the single scanning period T has elapsed, processing proceeds to step S429, where the control circuit 445 produces a drive stop signal for stopping illumination of the display panel. Subsequently, processing proceeds to step S423, which has been described above. A cathode line to which EL elements to be illuminated next are connected is scanned, and processing pertaining to steps S423 to S429 is iterated.

Figure 32:
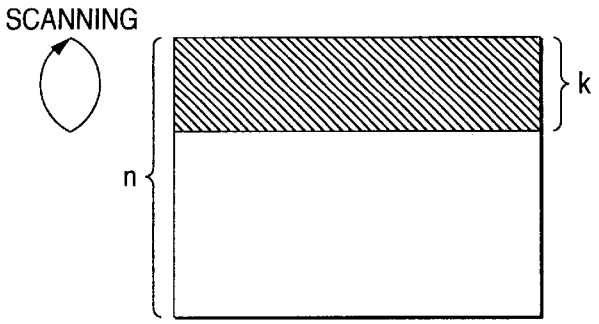
FIG. 32 is an illustration showing an example of scanning operation performed by the drive unit shown in FIG. 7.

As shown in FIG. 32, in a case where a single frame is formed from a total number of "n" scanning lines and where the EL elements connected to the first through $k^{th}$ cathode lines are illuminated, the first through $k^{th}$ cathode lines are scanned. Subsequently, the next frame is scanned without involvement of scanning of the remaining $k+1^{th}$ to $n^{th}$ cathode lines.

FIG. 10 shows the relationship between a reset period R and a scanning period T, which are determined for the foregoing illumination and drive operations. The scanning period T charges in accordance with count D, that is, the number of scanning lines of a current luminescent display frame.

In a case where all the cathode lines $B_1$ to $B_n$ of a single frame are sequentially scanned in the same manner as in a known display panel, one of the scanning switches $\mathbf{416}_1$ to $\mathbf{416}_n$ is switched to ground. Even if no EL elements to illuminate are connected to a cathode line assigned to the scanning switch, the reverse bias voltage $V_M$ is applied to and charged in the EL elements connected to the cathode lines assigned to the remaining scanning switches. However, the thus-stored electric charge is discharged during the reset period D which immediately follows the charging operation. Thus, the electric charges do not directly contribute to illumination and is uselessly dissipated. However, the present invention prevents scanning of cathode lines to which no EL elements to be illuminated are connected. Therefore, there can be diminished useless power dissipation, which would otherwise be caused by charging or discharging such EL elements.

According to the present invention, as the number of scanning lines becomes smaller, the duration of the single scanning period T can be made longer. Therefore, even if a reduction arises in the instantaneous brightness of the EL elements, sufficient per-frame brightness can be ensured. As the number of scanning lines becomes smaller, the drive current output from the current sources 418$_1$ to 418$_m$ can be made smaller, thus saving power.

Figure 33:
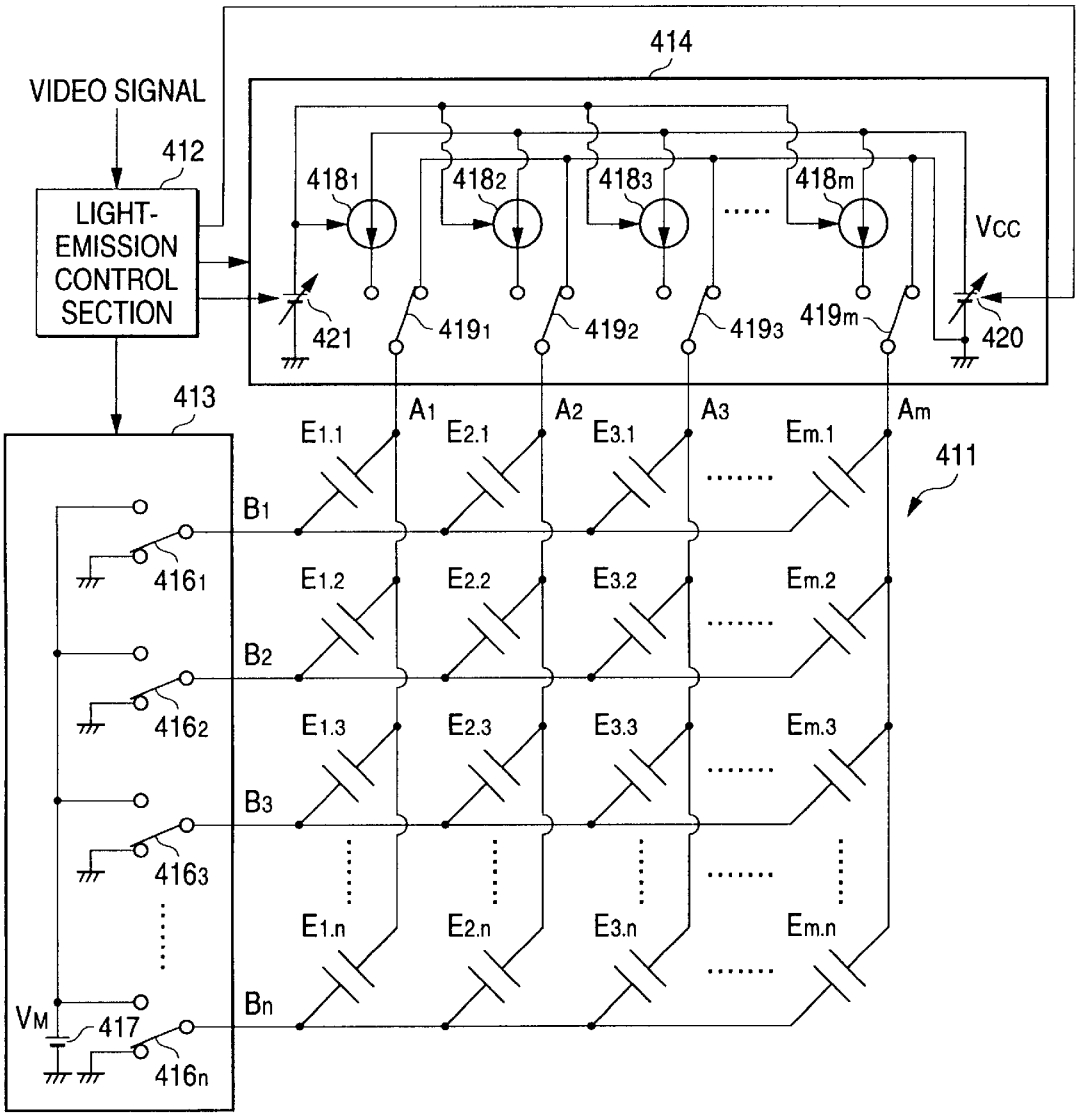
FIG. 33 is a block diagram specifically showing a luminescent display panel, a cathode line scanning circuit, and an anode line drive circuit of a luminescent panel drive unit according to another embodiment of the present invention.
Figure 34:
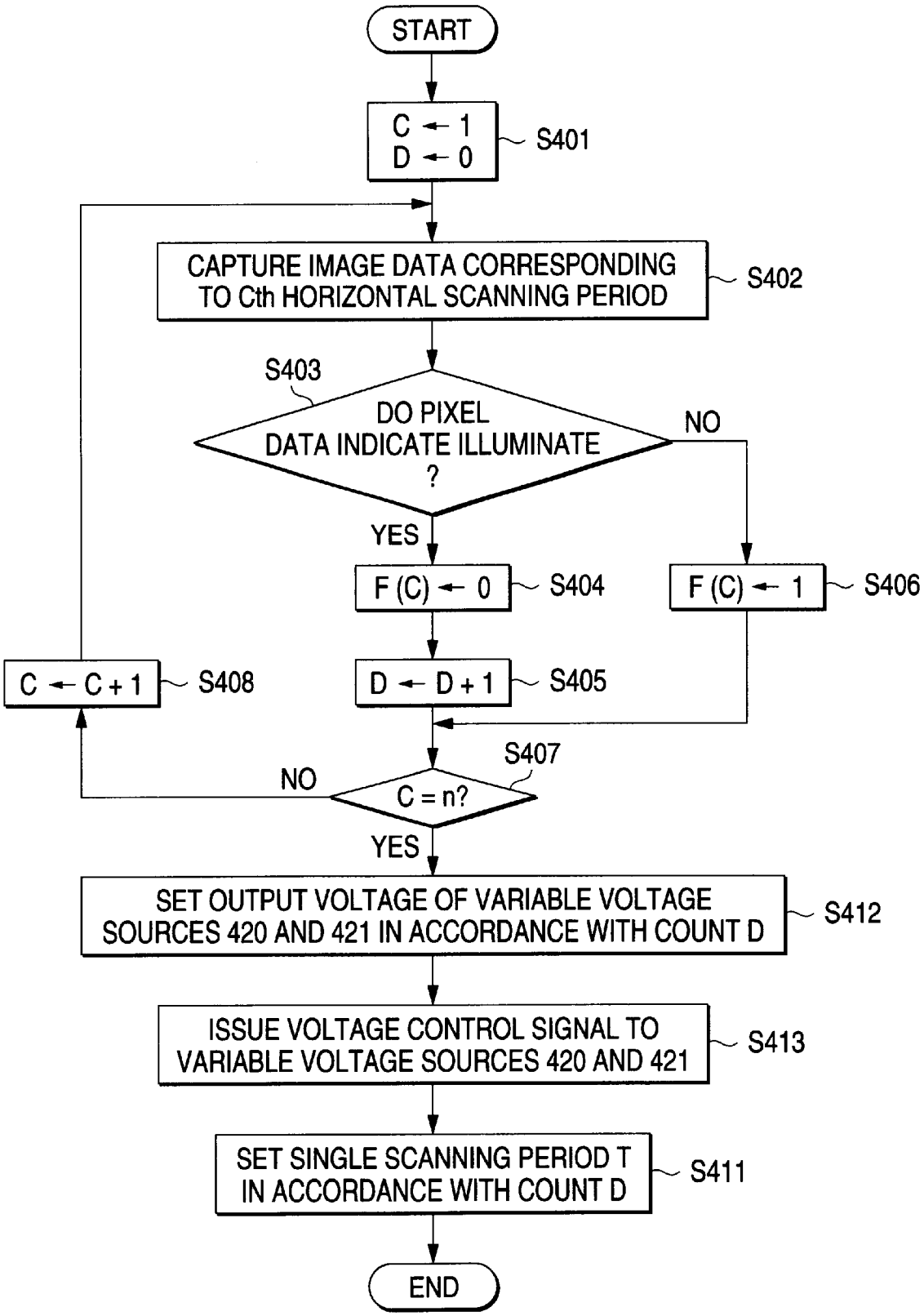
FIG. 34 is a block diagram for describing the light-emission determination operation shown in FIG. 33.

In the previous embodiment, the voltage source 420 outputs a constant voltage. However, as show in FIG. 33, the voltage source 420 may be replaced with a variable voltage source 420. The output voltage of the variable voltage source 420 is controlled in accordance with the voltage control signal output from the control circuit 445. If in step S407 of the light-emission determination routine it is determined that C=n, as shown in FIG. 34, the control circuit 445 sets the output voltage of the variable voltage source 420 and the output voltage of the variable voltage source 421 in accordance with count D (step S412). Further, the control circuit 445 outputs a control signal for adjusting the variable voltage source 420 to the thus-set voltage and a control signal for adjusting the variable voltage source 421 to the thus-set voltage (step S413). In step S412 the output voltage of the variable voltage source 420 and the output voltage of the variable voltage source 421 are set through use of individual data tables. As count D becomes greater, the output voltage of the variable voltage source 420 is set higher. In other respects, operations pertaining to the light-emission determination routine and the light-emission control routine are the same as those shown in FIGS. 30 and 31.

Figure 1:
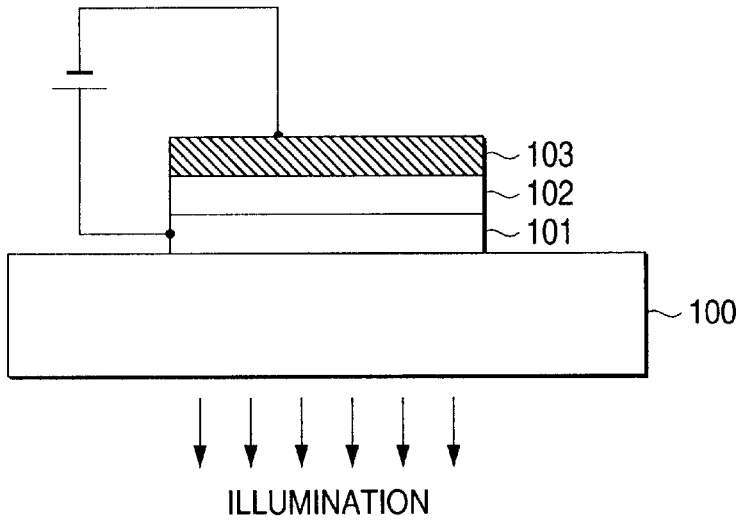
FIG. 1 is a cross-sectional view of an EL element.
Figure 2:
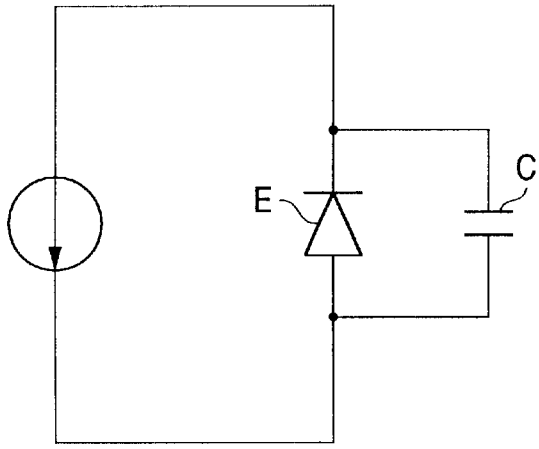
FIG. 2 is an equivalent circuit of the EL element.
Figure 3:
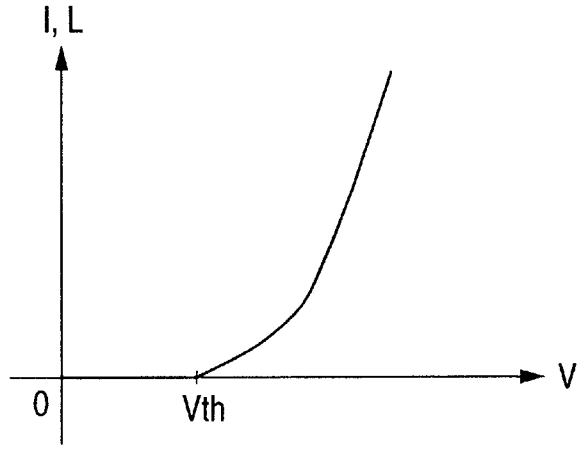
FIG. 3 is a plot schematically showing a drive voltage-current-luminous brightness characteristic of the EL element.

If the current flowing through the EL elements is diminished for reducing the instantaneous illumination brightness in accordance with a reduction in the number of scanning lines, the forward voltage applied to the EL elements is also decreased, as can be seen from the voltage V-current I characteristic of an EL element shown in FIG. 3. Accordingly, even if the output voltage of the variable voltage source 420 is reduced, a desired current flows from the current sources 418$_1$ to 418$_m$ to EL elements to be illuminated. Thus, the voltage applied to the EL elements to be illuminated can be ensured. As mentioned above, the output voltage of the variable voltage source 420, which is the drive source of the EL elements, is diminished, thereby reducing power to be dissipated by the current sources 418$_1$ to 418$_m$.

Figure 35:
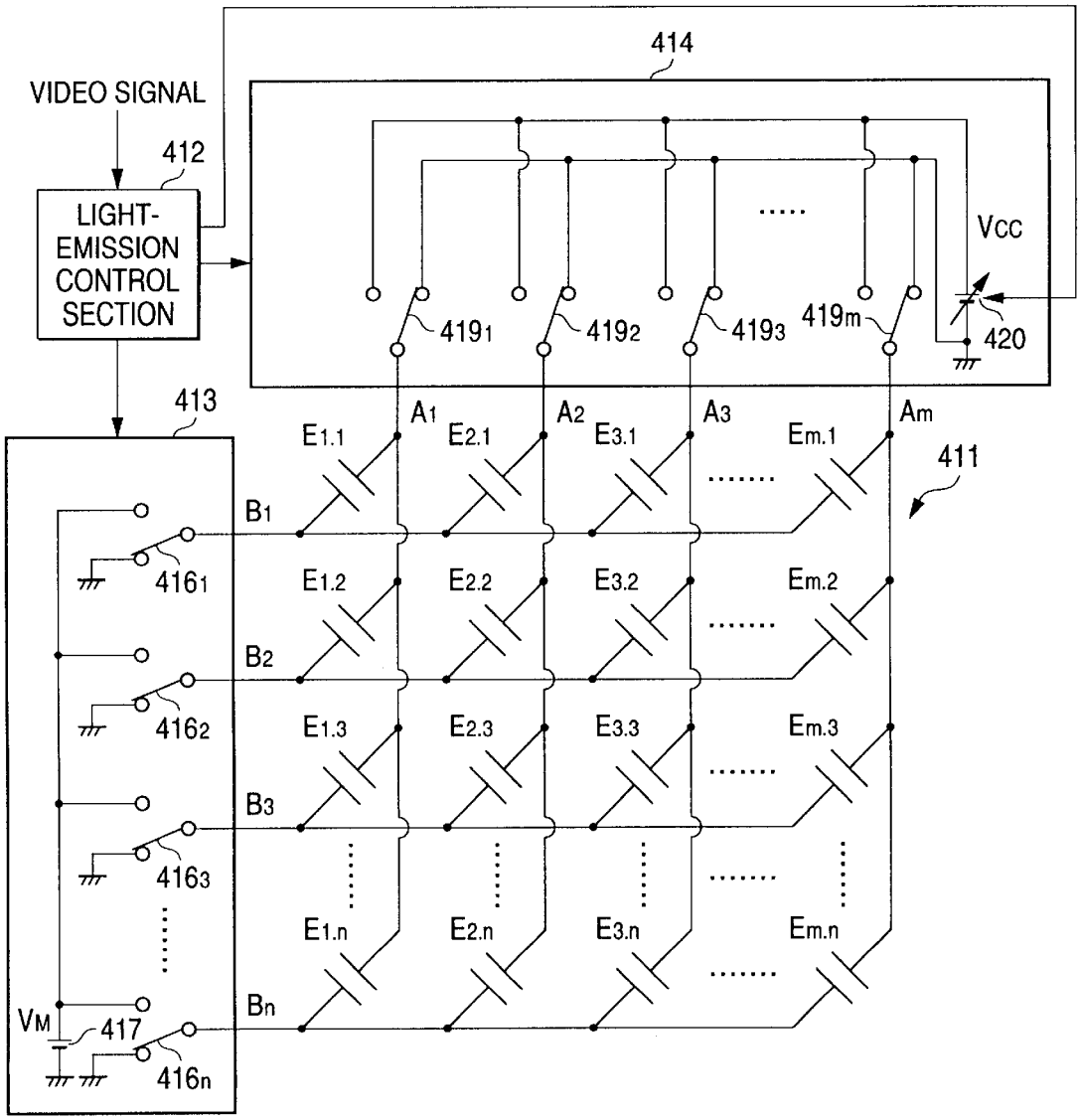
FIG. 35 is a block diagram specifically showing a luminescent display panel, a cathode line scanning circuit, and an anode line drive circuit of a luminescent panel drive unit according to yet another embodiment of the present invention.
Figure 36:
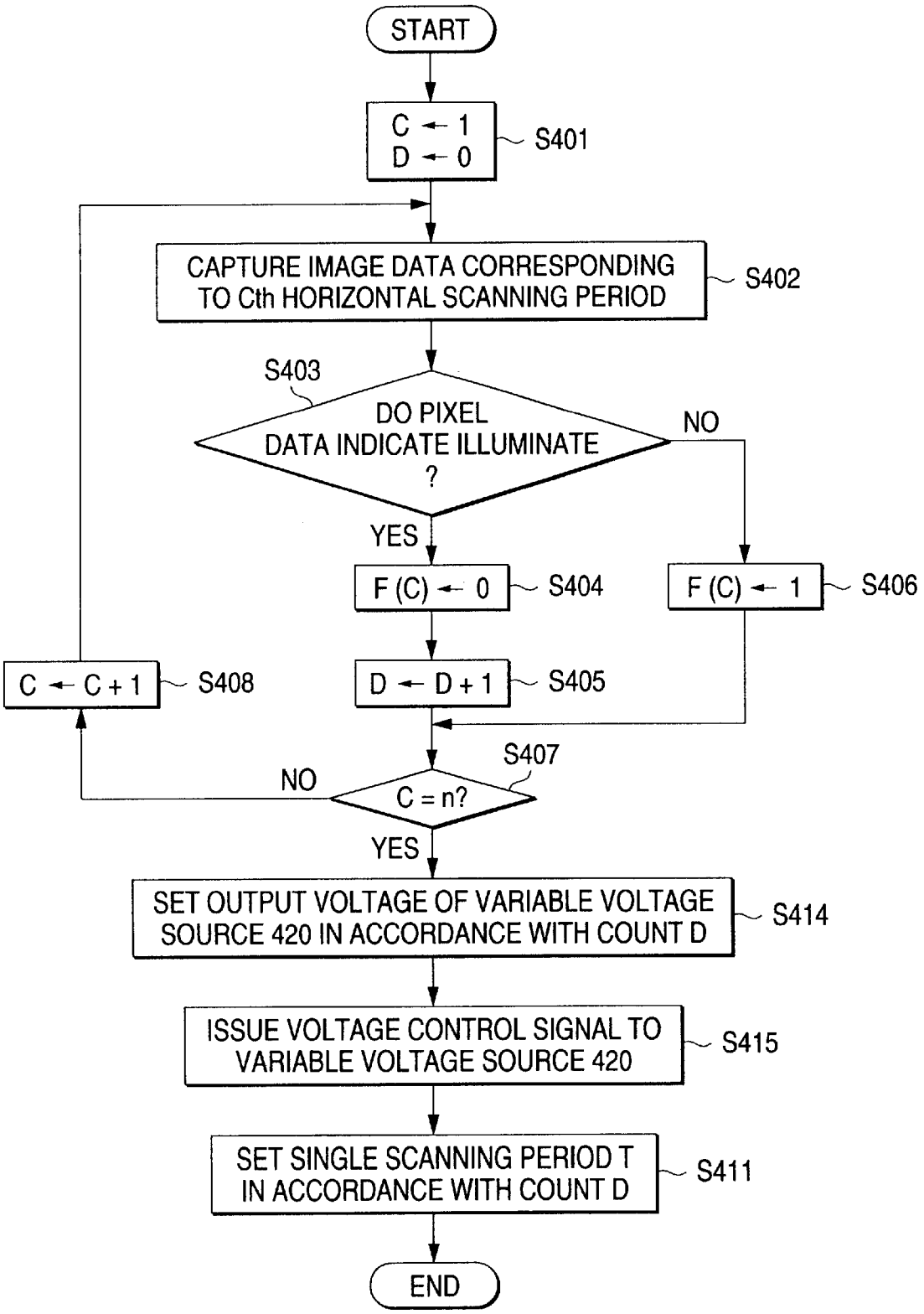
FIG. 36 is a block diagram for describing the light-emission determination operation shown in FIG. 35.

The previous embodiment has described a drive unit of current drive method which supplies, from current sources, an electric current to EL elements to be illuminated. However, the present invention may also be applied to a drive unit of voltage drive method which applies a voltage, from a voltage source, directly to EL elements to be illuminated. FIG. 35 shows a display equipped with a drive unit employing the voltage drive method. In this unit, one of stationary contacts of each of the drive switches 419$_1$ to 419$_m$ is grounded. The remaining stationary contact is connected directly to the positive terminal of the variable voltage source 420. In other respects, the display is identical in structure with that shown in FIG. 29. If in step S407 of the light-emission determination routine it is determined that C=n, as shown in FIG. 36, the control circuit 445 sets the output voltage of the variable voltage source 420 in accordance with count D (step S414) and outputs a voltage control signal for adjusting the variable voltage source 420 to the thus-set voltage (step S415). In other respects, operations pertaining to the light-emission determination routine and the light-emission control routine are the same as those shown in FIGS. 30 and 31.

In the previous embodiment, a video signal having a constant frame period is supplied to a drive unit. However, the present invention is not limited to such an embodiment. In a case where an image pertaining to a single video signal is repeatedly displayed until the content of video data is changed, the frame period does not need to have a constant length. According to the present invention, a frame frequency can be increased.

As mentioned above, according to the present invention, a comparatively-low reverse bias voltage is applied to respective capacitive luminescent elements located in intersections between scanning lines except one scanning line and drive lines except an illumination drive line. Electric charges which are stored in the luminescent elements with the reverse bias voltage and which do not contribute to illumination are diminished as compared with those charged in luminescent elements in a known display panel, thus reducing useless power dissipation.

As mentioned above, according to the present invention, a comparatively-low reverse bias voltage is applied to respective capacitive luminescent elements located in intersections between scanning lines except one scanning line and drive lines except an illumination drive line. Electric charges which are stored in the luminescent elements with the reverse bias voltage and which do not contribute to illumination are diminished as compared with those charged in luminescent elements in a known display panel, thus reducing useless power dissipation.

According to the present invention, the electric charges—which are stored in the capacitive luminescent elements connected to non-reset drive lines by means of the reverse bias voltage—are held without being discharged. Even when the reverse bias voltage is applied to the capacitive luminescent elements during the next scanning period, charging or discharging barely arises in the luminescent elements, thereby reducing useless power dissipation.

As mentioned above, according to the present invention, a comparatively-low reverse bias voltage is applied to respective capacitive luminescent elements located in intersections between scanning lines except one scanning line and drive lines except an illumination drive line. Electric charges which are stored in the luminescent elements with the reverse bias voltage and which do not contribute to illumination are diminished as compared with those charged in luminescent elements in a known display panel, thus reducing useless power dissipation.

According to the present invention, the electric charges—which are stored in the capacitive luminescent elements connected to non-reset drive lines by means of the reverse bias voltage—are held without being discharged. Even when the reverse bias voltage is applied to the capacitive luminescent elements during the next scanning period, charging or discharging barely arises in the luminescent elements, thereby reducing useless power dissipation.

As has been mentioned above, according to the present invention, scanning lines to which capacitive luminescent elements to be illuminated are connected are scanned, and the remaining scanning lines are not scanned. Useless power dissipation can be diminished, by the amount corresponding to the power required for scanning the scanning lines to which capacitive luminescent elements to be illuminated are not connected.

What is claimed is:

1. A luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, said drive unit comprising:

control means for setting a scanning period during which a single scanning line is selected from the plurality of scanning lines in accordance with a scan timing of an input video signal, for specifying a light-emission drive line assigned to said capacitive luminescent element which is connected to the single scanning line and is to be illuminated in accordance with the input video signal during the scanning period, and for setting a reset period during an interval between scanning periods;

scanning means for applying a first potential lower than an illumination threshold voltage of said capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to said capacitive luminescent element to be illuminated, for applying a third potential slightly lower than the illumination threshold voltage to the drive lines other than the illumination drive line, and for supplying during the reset period a fourth potential equal to the second potential to all the drive lines.

2. The luminescent display panel drive unit as defined in claim 1, wherein the first potential is ground potential, and the second potential is substantially equal to a specified illumination voltage of said capacitive luminescent element.

3. The luminescent display panel drive unit as defined in claim 1, wherein the drive current is supplied from a current source.

4. The luminescent display panel drive unit as defined in claim 1, wherein said capacitive luminescent element is an organic electroluminescent element.

5. A luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, said drive unit comprising:

control means for setting a scanning period during which a single scanning line is selected from the plurality of scanning lines in accordance with a scan timing of an input video signal, for specifying a light-emission drive line assigned to said capacitive luminescent element which is connected to the single scanning line and is to be illuminated in accordance with the input video signal during the scanning period, for setting a reset period during an interval between scanning periods, and for specifying, as a non-reset drive line, at least the drive line having connected to said capacitive luminescent element to remain unilluminated during the scanning periods before and after the reset period;

scanning means for applying a first potential lower than an illumination threshold voltage of said capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to said capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

6. The luminescent display panel drive unit as defined in claim 5, wherein the first potential is ground potential, and the second potential is substantially equal to a specified illumination voltage of said capacitive luminescent element.

7. The luminescent display panel drive unit as defined in claim 5, wherein the drive current is supplied from a current source.

8. The luminescent display panel drive unit as defined in claim 5, wherein said capacitive luminescent element is an organic electroluminescent element.

9. A luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, said drive unit comprising:

control means for setting a scanning period during which a single scanning line is selected from the plurality of scanning lines in accordance with a scan timing of an input video signal, for specifying a light-emission drive line assigned to said capacitive luminescent element which is connected to the single scanning line and is to be illuminated in accordance with the input video signal during the scanning period, for setting a reset period during an interval between scanning periods, and for specifying, as a non-reset drive line, only the drive line connected to only said capacitive luminescent element to remain unilluminated during the scanning period subsequent to the reset period;

scanning means for applying a first potential lower than an illumination threshold voltage of said capacitive luminescent element to the single scanning line during the scanning period, for applying a second potential higher than the illumination threshold voltage to scanning lines other than the single scanning line, and applying the second potential to all the scanning lines during the reset period; and drive means for supplying a drive current to the illumination drive line for forwardly applying, during the scanning period, a positive voltage higher than the illumination threshold voltage to said capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

10. A luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, said drive unit comprising:

control means for setting a scanning period during which a single scanning line is selected from the plurality of scanning lines in accordance with a scan timing of an input video signal, for specifying a light-emission drive line assigned to said capacitive luminescent element which is connected to the single scanning line and is to be illuminated in accordance with the input video signal during the scanning period, for setting a reset period during an interval between scanning periods, and for specifying, as a non-reset drive line, only the drive line having connected to said capacitive luminescent element to remain unilluminated during the scanning periods before and after the reset period;

scanning means for applying a first potential lower than an illumination threshold voltage of said capacitive luminescent element to the single scanning line during the scanning period, for applying a second potential higher than the illumination threshold voltage to scanning lines other than the single scanning line, and for applying the second potential to all the scanning lines during the reset period; and drive means for supplying a drive current to the illumination drive line for forwardly applying, during the scanning period, a positive voltage higher than the illumination threshold voltage to said capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

11. The luminescent display panel drive unit as defined in claim 10, wherein the first potential is ground potential, and the second potential is substantially equal to a specified illumination voltage of said capacitive luminescent element.

12. The luminescent display panel drive unit as defined in claim 10, wherein the drive current is supplied from a current source.

13. The luminescent display panel drive unit as defined in claim 10, wherein said (capacitive luminescent element is an organic electro-luminescent element.

14. A luminescent display panel drive unit including a plurality of drive lines and a plurality of scanning lines, which intersect each other; and a plurality of capacitive luminescent elements which are provided in respective intersections between the drive lines and the scanning lines and connected to the scanning lines and drive lines and which have polarities, said drive unit comprising:

control means for setting a scanning period during which a single scanning line is selected from the plurality of scanning lines in accordance with a scan timing of an input video signal, for specifying a light-emission drive line assigned to said capacitive luminescent element which is connected to the single scanning line and is to be illuminated in accordance with the input video signal during the scanning period, for setting a reset period during an interval between scanning periods, and for specifying, as a non-reset drive line, only the drive line connected to only said capacitive luminescent element to remain unilluminated during the scanning period subsequent to the reset period;

scanning means for applying a first potential lower than an illumination threshold voltage of said capacitive luminescent element to the single scanning line during the scanning period, for applying a second potential higher than the illumination threshold voltage to scanning lines other than the single scanning line, and applying the second potential to all the scanning lines during the reset period; and drive means for supplying a drive current to the illumination drive line for forwardly applying, during the scanning period, a positive voltage higher than the illumination threshold voltage to said capacitive luminescent element to be illuminated, for applying a third potential slightly lower than the illumination threshold voltage to the drive lines other than the illumination drive line, for supplying during the reset period a fourth potential equal to the second potential to the plurality of drive lines exclusive of the non-reset drive line, and for applying the third potential to the non-reset drive line.

15. A luminescent display panel drive unit including a plurality of drive lines and a plurality of scanning lines, which intersect each other; and a plurality of capacitive luminescent elements which are provided in respective intersections between the drive lines and the scanning lines and are connected to the scanning lines and drive lines and which have polarities, said drive unit comprising:

determination means for distinguishing, as real scanning lines from the plurality of scanning lines, scanning lines which are connected to said capacitive luminescent elements to be illuminated during each scanning period;

control means which sequentially specifies one scanning line from the real scanning lines and specifies light-emission drive lines assigned to said capacitive luminescent elements to be illuminated every time one scanning line is specified, said luminescent elements being connected to the specified scanning line; and drive means for forwardly supplying a drive current to said capacitive luminescent elements to be illuminated, by way of the scanning line and the light-emission drive line every time one scanning line is specified.

16. The luminescent display panel drive unit as defined in claim 15, wherein said control means sets the duration of the scanning period so as to correspond to the number of real scanning lines.

17. The luminescent display panel drive unit as defined in claim 15, wherein said control means has a variable current source for outputting, to said capacitive luminescent elements to be illuminated, a drive current of a level corresponding to the number of real scanning lines.

18. The luminescent display panel drive unit as defined in claim 15, wherein said drive means has a variable voltage source for producing a voltage of a level corresponding to the number of real scanning lines, and a variable current source for outputting into said capacitive luminescent elements to be illuminated the drive current of a level corresponding to the number of real scanning lines.

19. The luminescent display panel drive unit as defined in claim 15, wherein said drive means has a variable voltage source for applying to said capacitive luminescent elements to be illuminated a voltage of a level corresponding to the number of real scanning lines.

20. The luminescent display panel drive unit as defined in claim 15, wherein said (control means sets a reset period between the scanning periods, and said drive means brings all the drive lines and all the scanning lines into a single potential during the reset period.

21. The luminescent display panel drive unit as defined in claim 15, wherein said capacitive luminescent element is an organic electroluminescent element.

22. A method of driving a luminescent display panel including a plurality of drive lines and a plurality of scanning lines, which intersect each other; and a plurality of capacitive luminescent elements which are provided in respective intersections between the drive lines and the scanning lines and are connected to the scanning lines and drive lines and which have polarities, said method comprising the steps of:

distinguishing, as real scanning lines from the plurality of scanning lines, scanning lines which are connected to capacitive luminescent elements to be illuminated during each scanning period;

sequentially specifying one scanning line from the real scanning lines and specifies light-emission drive lines assigned to said capacitive luminescent elements to be illuminated every time one scanning line is specified, the luminescent elements being connected to the specified scanning line; and forwardly supplying a drive current to said capacitive luminescent elements to be illuminated, by way of the scanning line and the light-emission drive line every time one scanning line is specified.

* * * * *

UNITED STATES PATENT AND TRADEMARK OFFICE

CERTIFICATE OF CORRECTION

PATENT NO. : 6,351,076 B1
DATED : February 26, 2002
INVENTOR(S) : Takayoshi Yoshida and Yoichi Satake It is certified that error appears in the above-identified patent and that said Letters Patent is hereby corrected as shown below:

Column 42,
Line 6, please delete "(".

Column 44,
Line 1, please delete "(".
Line 25, please delete "specifies" and insert -- specifying --.

Signed and Sealed this

Eighteenth Day of June, 2002

*Attest:*

*Attesting Officer*

JAMES E. ROGAN
*Director of the United States Patent and Trademark Office*